US011639845B2

(12) United States Patent
Bruno et al.

(10) Patent No.: US 11,639,845 B2
(45) Date of Patent: May 2, 2023

(54) MID-BODY MARKING PROJECTILE

(71) Applicant: NOSTROMO, LLC, Kennebunk, ME (US)

(72) Inventors: Nicolas Horacio Bruno, Arundel, ME (US); Marcelo Moreno, Sao Paulo (BR)

(73) Assignee: NOSTROMO, LLC, Kennebunk, ME (US)

( * ) Notice: Subject to any disclaimer, the term of this patent is extended or adjusted under 35 U.S.C. 154(b) by 188 days.

(21) Appl. No.: 17/089,666

(22) Filed: Nov. 4, 2020

(65) Prior Publication Data

US 2021/0318106 A1 Oct. 14, 2021

Related U.S. Application Data

(63) Continuation-in-part of application No. 16/111,525, filed on Aug. 24, 2018, now Pat. No. 10,845,172.

(60) Provisional application No. 62/549,596, filed on Aug. 24, 2017.

(51) Int. Cl.

| | |
|---|---|
| ***F42B 8/14*** | (2006.01) |
| ***F42B 12/40*** | (2006.01) |
| ***F42B 12/50*** | (2006.01) |
| *F42B 10/26* | (2006.01) |
| *F42B 10/46* | (2006.01) |
| *F42B 8/16* | (2006.01) |

(52) U.S. Cl.

CPC ..... *F42B 12/40* (2013.01); *F42B 8/14* (2013.01); *F42B 12/50* (2013.01); *F42B 8/16* (2013.01); *F42B 10/26* (2013.01); *F42B 10/46* (2013.01)

(58) Field of Classification Search

CPC .... F42B 8/14; F42B 8/16; F42B 10/26; F42B 10/46; F42B 12/40; F42B 12/46; F42B 12/50

USPC ..... 102/513

See application file for complete search history.

(56) References Cited

U.S. PATENT DOCUMENTS

| | | | | |
|---|---|---|---|---|
| 5,565,649 | A * | 10/1996 | Tougeron | F42B 12/36 102/370 |
| 6,619,211 | B1 | 9/2003 | Haeselich | |
| RE40,482 | E | 9/2008 | Haeselich | |
| 8,065,962 | B2 | 11/2011 | Haeselich | |
| 8,424,456 | B2 | 4/2013 | Broden | |

(Continued)

FOREIGN PATENT DOCUMENTS

| | | | | |
|---|---|---|---|---|
| WO | WO-2019040873 A1 * | 2/2019 | | F42B 10/26 |
| WO | WO-2022154851 A2 * | 7/2022 | | |

*Primary Examiner* — James S Bergin

(74) *Attorney, Agent, or Firm* — TaeRa Franklin; Eckert Seamans Cherin & Mellott, LLC

(57) ABSTRACT

A cartridge incorporating a projectile assembly, the projectile assembly having a base, mid body component housing a marking powder and metallic nose cap. The projectile's mid-body component houses liquids in a cylindrical compartment, where set-back and rotation induce chemical mixing, and in flight allowing for a chemical reaction, and at impact the projectile undergoes wall failure in the mid body, resulting from shear and residual rotational momentum, the actions in combination releasing and expelling marking materials, the ejection suspended signature producing materials, including liquid, powdered metals or fine particles released into the atmosphere emit and reflect light, the signature materials producing an observable signature at the projectile's impact location.

14 Claims, 55 Drawing Sheets

(56) References Cited

U.S. PATENT DOCUMENTS

| | | | | |
|---|---|---|---|---|
| 8,640,621 | B2 * | 2/2014 | Broden | F42B 8/16 102/444 |
| 8,783,186 | B2 * | 7/2014 | Scanlon | F42B 8/14 102/513 |
| 10,845,172 | B2 * | 11/2020 | Moreno | F42B 8/16 |
| 2006/0032393 | A1 | 2/2006 | Haeselich | |
| 2007/0119329 | A1 * | 5/2007 | Haeselich | F42B 12/40 102/513 |
| 2008/0178758 | A1 * | 7/2008 | Kapeles | F42B 12/40 102/502 |
| 2012/0227614 | A1 * | 9/2012 | Sullivan | F42B 8/14 102/513 |
| 2012/0255458 | A1 * | 10/2012 | Sullivan | F42B 12/42 102/513 |
| 2015/0268018 | A1 * | 9/2015 | Sullivan | F42B 12/40 102/513 |
| 2019/0072370 | A1 * | 3/2019 | Moreno | F42B 12/40 |

* cited by examiner

56

| Range [m] | Impact Angle [°] |
|---|---|
| 500 | -22.2 |
| 1000 | -12.6 |
| 1500 | -11.0 |
| 2000 | -12.1 |
| 2500 | -15.4 |

| Range [m] | Impact Angle [°] |
|---|---|
| 500 | -3.4 |
| 750 | -4.0 |
| 100 | -9.9 |
| 1250 | -15.0 |
| 1500 | -21.7 |

56

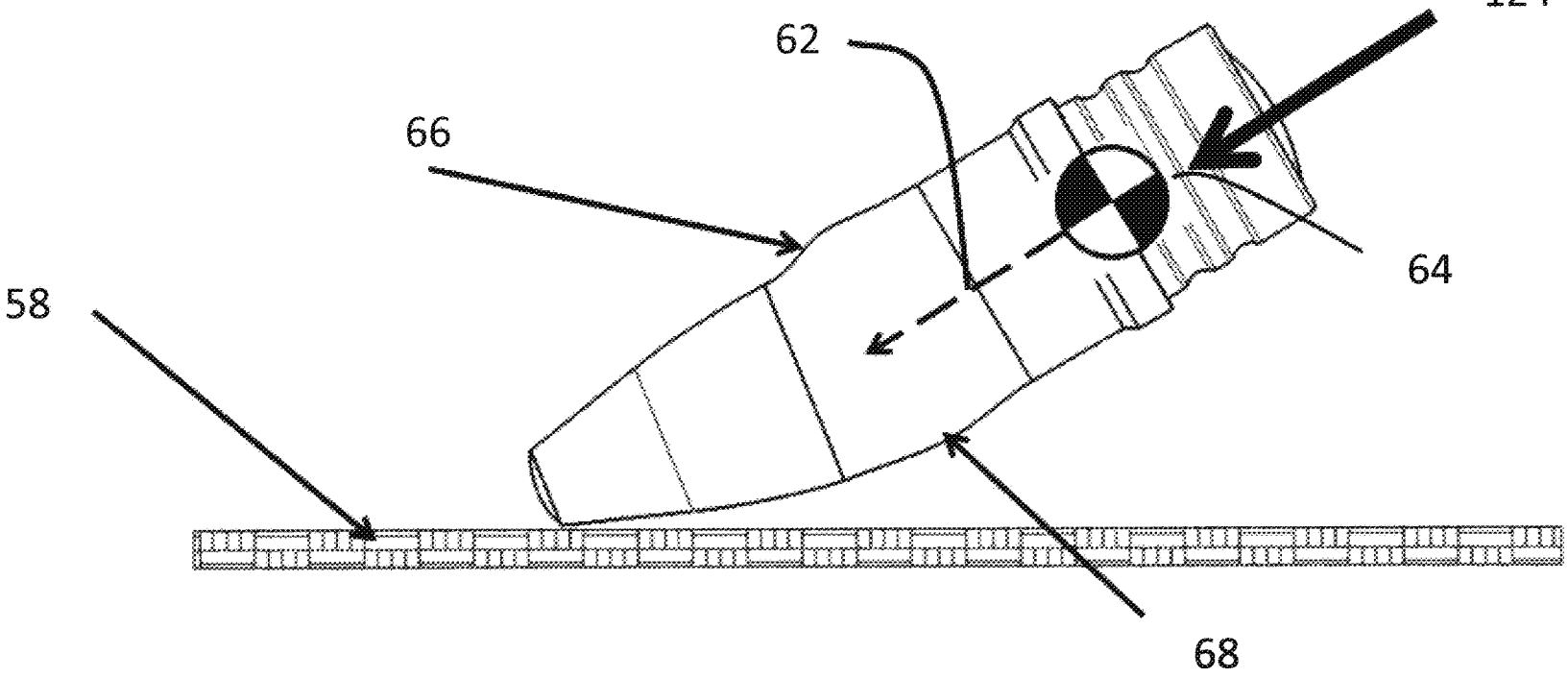
Figure 10B1

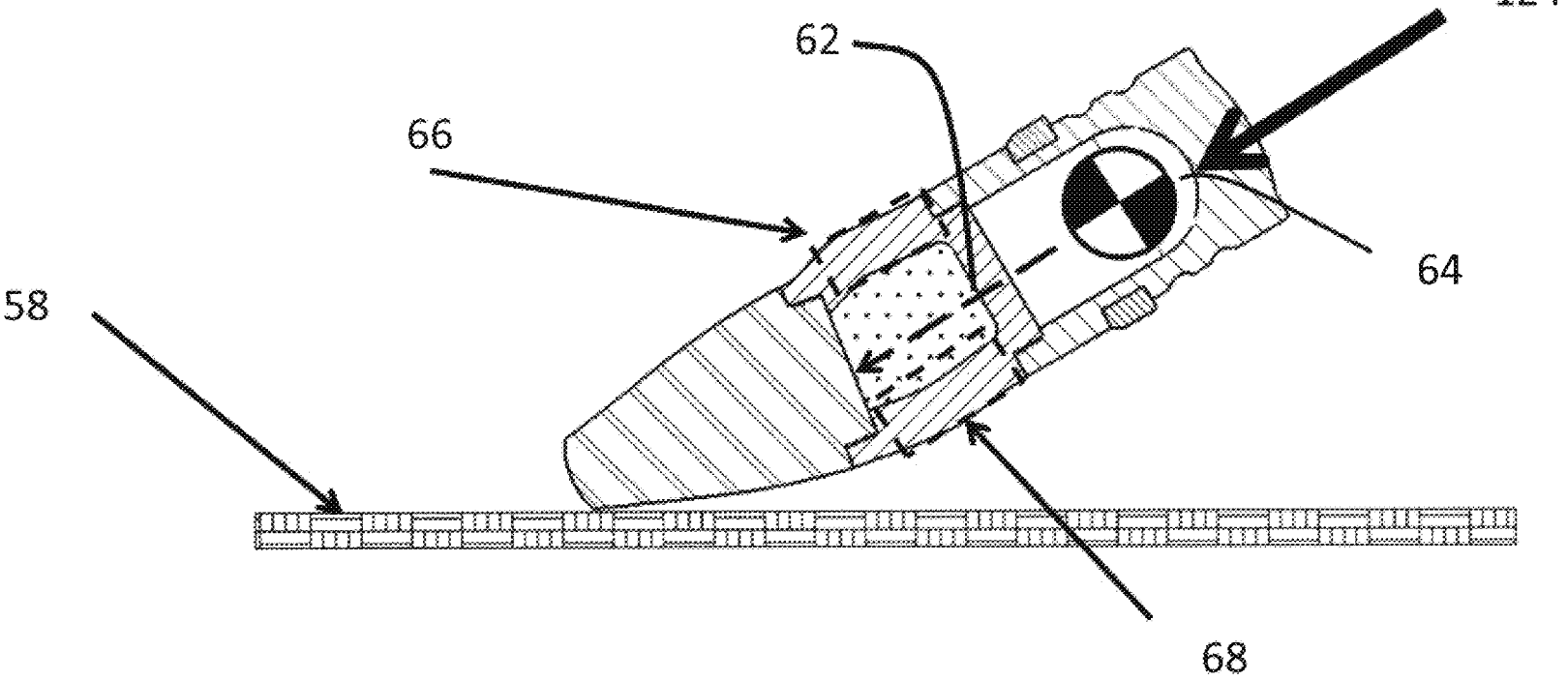
Figure 10B2

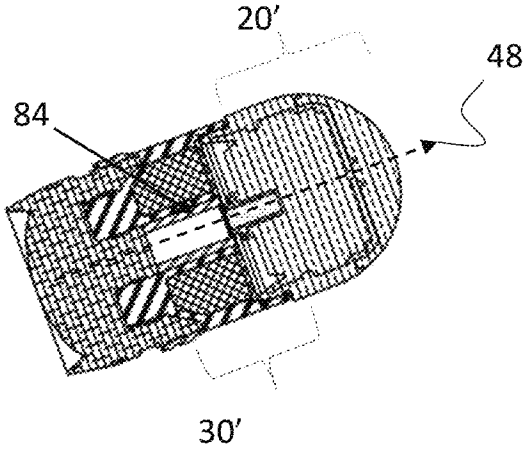
Figure 17B
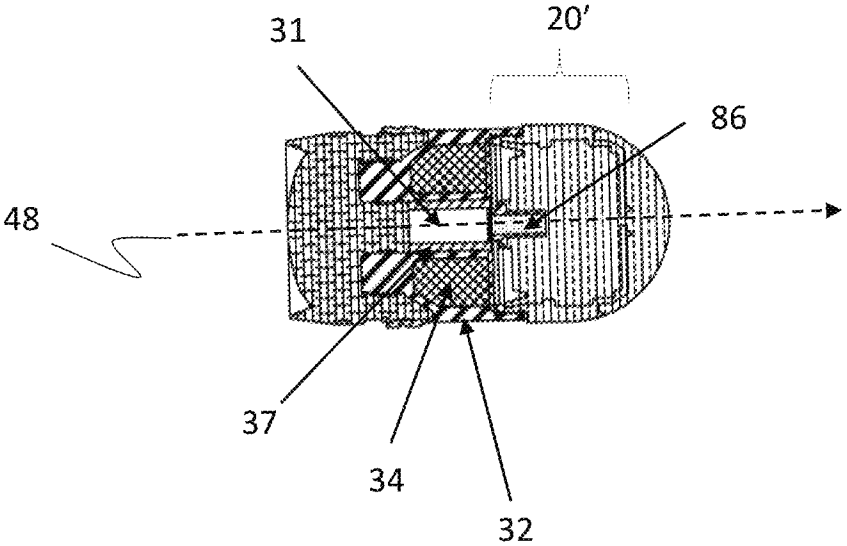

MID-BODY MARKING PROJECTILE

CROSS REFERENCE TO RELATED APPLICATION

This present application is a continuation-in-part application of U.S. Non-provisional application Ser. No. 16/111,525 filed 24 Aug. 2018, which claims benefit of priority from U.S. Provisional Application Ser. No. 62/549,596 filed 24 Aug. 2017, entitled "Mid-Body Marking Projectile." The subject matters of the U.S. Non-provisional application Ser. No. 16/111,525 and the provisional application No. 62/549,596 are incorporated herein by reference in their entireties.

BACKGROUND OF THE INVENTION

Many militaries around the world typically become increasingly sensitive to the environmental impact of military training. Unexploded ordnance and associated clean up liabilities, are a significant consideration for procurement officials purchasing ammunition. In the field of spin stabilized, gun fired ordnance the US Army Research Development and Engineering Center (ARDEC) located at Picatinny Arsenal, developed the inexpensive M781 "chalk" round, that provided a visual signature for draft era conscripted soldiers. The frangible ogive of the M781 projectile was fabricated from plastic material, the plastic ogive further containing a marking powder. Normally, a training cartridge would have to survive a standard five-foot drop test; however, in the interest of reducing costs the Army waived the drop requirement supporting fielding of the M781, as the M781 dropped on a hard surface had a propensity to break open and spill the marking chalk from the ogive. Appearing in the early 1990s, 40 mm AGL's like the MK19, MK47, Santa Barbara 40 mm, H&K 40 mm provided users with exceptional firepower, firing a 40 mm projectile to a distance of two kilometers. The initial training cartridges offered with the US M918 cartridge which included fuzed pyrotechnics that were inherently expensive to produce and further produced a significant volume of problematic unexploded ordnance (UXO). Seeing a market opportunity, Nico Pyrotechnik GmbH & Co Kg developed a high velocity 40 mm cartridge with a nose mounted marker. This Nico design depicted in WO 2005/098345A8 was able to survive a typical rough handling test, as the cartridge included a useful internal container to insure marking powder did break and spill encapsulated marking powder into the weapon during feeding. This cartridge entered service with the US Marine Corps and USSOCOM with the nomenclature MK281 MOD 0. Nico, having been purchased by Rheinmetall, then incorporating useful chemiluminescent markers using technology taught in U.S. Pat. Nos. 6,619,211, RE40482 and 6,990,905 and WO 2007/0054077A1, the new technology providing a day and night signature, at impact. The updated US Marine Corp cartridge adopted these technologies and receiving the updated designation MK281 MOD1.

We should also note that General Dynamics (Canada) has been awarded U.S. Pat. No. 9,157,715 B1 Polymer Marking Projectile with Integrated metallic Sealing Ring (GD Canada). This General Dynamics Canada design has a polymer ogive and body that, upon impact, compresses, to deform the polymer nose, the resulting deformation expelling a marking compound. We should note that the resulting deformation of the polymer body creates vents with an orientation parallel to a projectile's axis of rotation. In this impact configuration, the marking material is ejected from the vents, and the ejected marking powder attaches itself to the target.

The U.S. Army Material Command (AMC) Pamphlet 706-165, published in April 1969 and approved for release to the public in January 1972, provides an authoritative overview of the challenges associated with designing liquid filled projectiles. The opening paragraph states "the problem of the unpredictable behavior of liquid-filled projectiles in flight has been known to designers for a long time." This AMC Pamphlet was published to assist Army ammunition designers in producing ammunition with payloads such as white phosphorus that, under certain conditions, could liquefy and create flight instability.

Solid-Liquid Mass Ratio: In cases where the amount of solid mass is significantly greater than a projectile's liquid mass, the mathematical calculations regarding stability and instability are greatly simplified. The AMC Pamphlet 701-165 states:

> "For a heavy projectile filled with a comparatively small mass of liquid, the stability of problems reduces the problem of calculating the Eigen frequencies (of the liquid) and associated residues."

Further, The AMC Pamphlet pp. 706-165 states:

> "It was shown again that resonance between the natural frequencies of fluid and the projectile is the cause of the dynamic instability of the projectile containing such liquid filled cavities."

For a complete understanding of the invention, it is important to recognize that projectile's with a liquid filled cavities or capsules, are acted on by forces, oscillations and perturbations resident in the liquid and imparted by the liquid at the boundary inside the projectile. The oscillations and perturbations tend to accentuate a projectile's spin decay and yaw. In this application we wish to utilize the unique physics associated with projectiles housing liquids where the inclusion of certain features in a novel configuration will, after spin-up in a barrel, transition to ballistic flight where yaw, pitch, precession and nutation exhibited by a projectiles is in minimized and the destabilizing perturbations retained in the liquid are also minimized, thus the novel cartridge and projectile provides for stable ballistic flight of a direct fire projectile.

Liquids in a Projectile's Void: It is known that liquids generally exhibit nine hundred times more resistance to motion when compared to that of a gas. Liquids may also exhibit a resonance that can influence objects in flight. Prior work has shown that configurations with of a projectile's liquid filled void often had an infinite set of initial boundary conditions and projectiles have frequently been troublesomely susceptible to picking up resonances which have imparted un-predictable forces that act on the projectile in flight. Early designers of liquid fuel rockets went to extensive efforts to understand and manage the complicated characteristics exhibited by liquid fuels in the rockets during flight. Like a spinning top, a projectile's gyroscopic stability is achieved by optimizing the mass rotating around center of gravity and the axis of rotation. By understanding the physics associated with a projectile housing liquids, it is possible to configure the overall geometry to minimize the accentuation of the projectile's yaw amplitude and frequency at muzzle exit, optimizing the projectile's exit flight stability.

The AMC Pamphlet 706-165 further notes the challenge in establishing repeatable initial boundary conditions for a projectile containing a liquid. The pamphlet notes that "spin up" of the projectile in the barrel after set-back and before barrel exit often produces severe transient instability that renders a liquid-filled projectile useless in practice and can, further, render Stewartson's equations irrelevant. The feeding and handling of a projectile and its subsequent chambering in a breach creates an almost infinite set of initial boundary conditions making it almost impossible to establish a design that produces repeatable performance at barrel exit. Spin-stabilized projectiles, housing liquid material that retain transient spin instabilities that vastly complicate a designer's ability to reliably induce derogation of flight ballistics. 706-165, section 9-1 (Introduction) published noted:

"To design a well behaved i.e. dynamically stable, liquid-filed projectile sometimes is very difficult. This is large because of the constraints imposed upon the design such as the size of the projectile, its weight, and the amount of chemical filler the projectile is to carry to maximize effectiveness. The parameters at the disposal of the designer within the above limitations are the geometry of the cavity, its fitness ratio and the fill-ratio."

It is apparent that the authors of (AMC) Pamphlet 706-165 were not optimistic regarding the possibility that designers could design an array of projectiles with liquid payloads, recognizing the significant complexity of the associated physics. While Haeselich (prior art) produced a configuration that was will deliver a modest, chemical payload, our application identifies a useful alternate configuration, that will deliver a larger volume of liquid payload to an impact location. Our solution uniquely sets forth a novel configuration for encapsulating the liquid in the projectile and identifying external features that align the projectile geometry, so that external spin is balanced, and liquid spin in a cylinder is also correctly balanced, so in bore balloting is minimized and the configuration further minimizing perturbations transferred into the liquid by projectile spin-up and barrel exit.

Cylindrical Projectile Capsules Housing Liquids: Cylindrical cavities are useful when producing ammunition since most projectiles have a basic cylindrical form with the cylinder capped by a conical nose. Forming processes for cup-shaped forms have long been a cost-effective method of metal forming in ammunition manufacture. Therefore, it is practical to form projectiles with cylindrical forms. Stewartson's equations, published by the Ballistics Research Lab (BRL) in 1959, set forth the mathematical boundary conditions for instability, for liquid cylindrical cavities. The set of equations allows designers to design ammunition that induces predictable instability. Karpov's publication of "Dynamics of Liquid Filled Shell: Resonances in Modified Cylindrical Cavities" was published in 1966 and added to Stewartson's body of work. Thus, considering the physics associated with liquid filled projectiles, it is useful to use a cylindrical form factor to encapsulate a liquid proximate to the projectile's center of gravity and central to the projectile's axis of rotation. Observing the fact that a projectile with a reactive liquid capsule should allow for 20-30% of the volume in a capsule to be air, the air gap and chemicals in combination allow chemicals to mix and react, a designer recognizes certain cylindrical configurations minimize liquid payload shifts, allow for good mixing, thus optimum for accommodating a reactive liquid payload. Fortunately, locating the liquid payload proximate to the center of gravity, and sustaining laminar liquid flow in a cylindrical capsule, act in combination, to minimize shifting liquids and it is possible to select chemicals that when mixed, have the requisite desired viscosity, the combination reducing retained oscillation, and the desired configuration minimizes the forces imparted on the solid projectile and the configuration thus prevents a deleterious degradation in a projectile's ballistic flight stability. Remaining mindful that retained liquid perturbations tend to exponentially magnify themselves when in a projectile, initial conditions are thus critical to sustained projectile flight stability, we recognize that certain mixed liquids, housed in a cylindrical cavity or capsule, allow our design to accommodate the sequential environments of set-back, spin, rapid acceleration followed by deacceleration and 6DOF movement in the capsule, and the form allows for the chemicals to properly mix under laminar flow conditions, while in flight, and after reacting be ejected from the projectile, to provide a marking signature. While this configuration may not work for indirect fire conditions, this projectile will typically function in direct fire projectiles. Typically, at set-back, liquid will momentarily moves aft in the projectile, and then as the projectile's exterior features engage the inner diameter of the barrel, the liquid encounters spin-up where rotational forces and centrifugal forces induce laminar flow of liquids in a capsule. As the projectile transits the barrel, balloting in the barrel imparts oscillations on the swirling liquid. When the projectile exits the barrel, the liquid flowing in a projectile will encounter a $2^{nd}$ significant disruption of liquid flow, as the exiting projectile immediately undergoes deacceleration as air-resistance slows the projectile. The rapid change in environments—acceleration, spin and deacceleration induces forces shifting the liquid in a cavity from the aft to the nose. Where a projectile has a partially filled liquid capsule, balloting shifts the liquid about the center of gravity, inducing retained perturbations in the liquid cavity. Our design goal is for the projectile, at barrel exit, leave the muzzle with the encapsuled liquid having sustained laminar flow about the axis of rotation. Accordingly, our optimized direct fire configuration operates across all environments (1) set-back, (2) barrel spin up, (3) transit in the barrel, and (4) exit and transition to free ballistic flight. It is important that laminar flow is sustained over the course of the projectile's entire flight path, and the reacting chemical may change in characteristic viscosity. Also, a designer must be mindful that problematic perturbations, such as oscillation and resonance, as typically retained and amplified in liquid payloads. Thus in minimizing perturbations at barrel exit, it is advantageous to align the cylindrical cavity housing the liquid, the outer diameter bore firing features, and the axis of the barrel allowing spin-up to occur in an environment with minimal in-bore balloting. Thus, an optimized projectile geometry allows for muzzle exit and transition to flight, such that the projectile exiting the barrel has minimum pitch and yaw at band exit. To prevent balloting in the barrel and minimize inducement of perturbations in a liquid having laminar flow at barrel exit, we note that it is thus advantageous to configure the liquid payload near the projectile's center of gravity. Further, to minimize balloting and again minimize perturbations, we note that it is advantageous to incorporate a forward bore riding feature in an ogive and a driving band aft, the critical features being equidistant to the projectile's center of gravity the forgoing configuration and features thus applying rotational forces about the cylindrical liquid cavity at spin up.

By controlling key characteristics of a projectile's design, we have concluded that it is possible to design a new novel liquid filled projectile that minimizes balloting, where key features of the projectile, in combination allow the projectile to have a "clean muzzle exit" and transitioning to stable ballistic flight. This novel configuration incorporates a frangible mid-body marking material that, on impact, disperses a marking liquid or powder/liquid combination of materials in the vicinity of impact. Further, housed liquids may utilize a mix of chemicals that generating chemiluminescent light output and/or heat emitting exothermic reactions while in flight and then releasing the reacting materials into the atmosphere, producing observable marking signature's in the vicinity of the projectile's impact point.

The present disclosure sets forth a novel training projectile design with a cylindrical cavity, allowing for storage of segregated chemicals, to puncture segregation bathers at set-back, and allow for mixing of segregated chemicals during spin up, the chemicals continuing to mix and react when in laminar flow, the flow of mixing chemicals aligned to coincide with the projectile's center of gravity, the capsule located approximately equidistant from the aft driving band and forward bore riding surfaces located on the forward metal ogive. The projectile design has exterior features that will minimize balloting in spin-up, having a forward bore rider, fabricated from a ductile metal and incorporated into the ogive and driving band in the base of the projectile, the features, in combination minimizing the balloting in projectile spin-up, and further minimizing the yaw and pitch amplitude exhibited at muzzle exit, thus the smooth transition from the barrel to free flight minimizing perturbations induced on the liquid flowing in the projectile's cavity, the liquid in laminar flow of mixing chemicals continuing about the projectile's axis of rotation. The configuration further incorporates a frangible mid body marker, the frangible body housing that disperses a liquid at target impact, the combination set forth being novel and inventive. It is useful to utilize the laminar flow of the liquid in a capsule, to mix reactive chemicals, provided the reaction is substantially completed in the short period of flight. The set-back of the projectile in the barrel, is thus configured to allow for chemical compartments segregated by bathers in storage, mix in spin up, and in flight. The configuration has the following characteristics and functionality (1) a mid-body liquid payload, configured in a projectile that (2) optimally exit the barrel's muzzle by incorporating features that minimize in barrel balloting, (3) the projectile further configured to undertake stable flight, (4) the liquid mixing during spin-up and in flight to create either a chemiluminescent or exothermic chemical reaction and (5) the projectile configured to impact on a target, breaking the impacting projectile with frangible features (6) ejecting a liquid payload perpendicular to the angle of impact, (7) the ejected liquid atomized, dispersed and momentarily suspended in the air, (8) the suspended atomized material reflecting or emitting light in a spectrum observable from the firing point.

Air Burst Munition Training: SOCOM has fielded the MK215 and MK314 projectiles and the US Army is now testing two air-burst munitions identified as the XM1166 (LV 40 mm×46 LV ABM projectile) and a XM1176 (HV 40 mm×53 HV ABM projectile). Training projectiles providing ABM functionality will be of military interest as the operational air-burst munitions are expensive. Accordingly, a nose fuzed projectile that is optimized to provide a marking function, especially producing a multi-spectral marking signature, that ejects marking material perpendicular to the flight trajectory will be of military interest. The perpendicular ejection caused by an ignition source, transferring heat to a frangible powdered metal, silicate or ceramic, the material retaining heat imparted by ignition and the material radiating heat at the time of ejection, the radiating material momentarily suspended in the atmosphere and emitting an observable optical and/or thermal signature, observable at the firing point.

SUMMARY OF THE INVENTION

The cartridge incorporating a marking projectile, that affords gunners with a visual impact cue to identify the location of a projectile's impact. The cartridge survives typical drop testing and can function in a machine gun or cannon. At impact in the vicinity of a target, impact forces act on the projectile body inducing a wall failure that expels marking powder into the atmosphere. The projectile's break up on impact, reduce the risk of ricochet.

Use and Function Fire: Advantageously, the new product provides for a marker that will function in most terminal conditions, without producing UXO. The design incorporates a base with a substantial mass that, at the moment of impact, harvests the forward inertia of the mass in the base, the mass compressing a mid-body component that encapsulates a marking powder. Also, the walls will normally have adequate strength allowing the cartridge to survive typical drop tests. These drop tests reflect user requirements that a cartridge remain intact when being transported and handled in a military environment. The design includes a robust metal nose, providing a feature that allows for a projectile to pass a typical 5-foot drop test. As training cartridges generally have a ballistic match requirement to operational projectiles, the design must establish a center of gravity in the projectile affording a good match to operational cartridges. Where a designer desires to move the center of gravity forward, the preferred design may include a steel nose. Where the designer needs to move the center of gravity to the rear of the projectile, the designer can utilize an aluminum nose. In addition to surviving drop tests, a cartridge may have to function in sever compression. By way of example, a MK19 MOD 3 40 mm AGL will induce significant tension and compression on the cartridge when the weapon delinks the projectile from the ammunition belt and the cartridge undergoes compression when the bolt and extractors force the cartridge forward in the MK19s base feeder. Thus, a 40 mm AGL projectile utilizing a mid-body marker design must ensure the mid-body wall provides requisite strength for feeding, and break on impact.

Impact Marking Function. At impact, the combination of forces act to induce failure in the projectile's mid body wall, releasing and then expelling the encapsulated powder from the disintegrating body. While the mid-body wall fails in impact conditions, the walls have adequate strength to undergo compression, as many cartridges undergo considerable compression in weapon feeding. The wall failure, at impact, depends on material selection. Generally, a designer can use a typically polymer that will shatter and separate from the projectile at impact, where the nose undergoes an abrupt de-acceleration, and the inertia in the base squeezes the mid-body marker wall, causing failure and allowing forces to eject the marking powder, and allowing the heavier metal base to continue forward movement after wall failure, compressing and causing ejection of the powder, post wall failure.

Marker and Marker Ejection at Impact: Advantageously at impact, shear forces, rotational forces and collapsing mid boy walls, all act on the powder to eject the marker into the atmosphere. Typically, the marking powder is a low-density material that includes pigmentation or dyes that provide a strong contrast with the colors in the ambient environment. Typically, the marking powder is ejected in a pattern from the mid-body, such that the ejected material is buoyed in the atmosphere proximate to the impact and perpendicular to the projectiles axis of rotation.

Liquid at Spin Up and Transitioning to Ballistic Flight: A mid-body design allows for alignment of a cylindrical liquid capsule proximate to the projectile's center of gravity. Further the configuration facilitates effective function when fired from a direct fire weapon, imparting minimum perturbations, at spin up. At barrel exit from a direct fire weapon, the configuration minimizes the pitch and yaw exhibited by the projectile, as the configuration sustains and the laminar flow of liquids housed in a cylindrical capsule, where centrifugal force caused by rotation of the projectile about the axis of rotation causes the liquid to flow with minimum perturbations while the projectile fly's along it ballistic trajectory.

Liquid Ejection at Impact: The configuration with a mid-body liquid payload advantageously ejects liquid, and an alternate embodiment also ejects both a liquid and powdered a marking material, in both cases the liquid material flung perpendicular to the axis of rotation, from the disintegrating frangible mid-body container. Optimally, a heated liquid is ejected at impact and ejection caused by residual rotation of the projectile's components, and the centrifugal forces acting on the liquid and atomized droplets of chemicals, and further the droplets may transition to a heated gas when released from a pressurized heated capsule, the evaporating liquid and droplets buoyed and suspended in the atmosphere proximate to the impact and perpendicular to the projectile's axis of rotation.

Ejection by Fuze Function: In an alternate configuration ignition of an energetic causes a powdered metal cylinder to break into a powder, the cylinder being proximate to ignition of an energetic, the energetic reaction imparting heat transferred to the powdered metal, the escaping gases act to pressurize a mid-body cavity, failure in the frangible walls propelling a marking material, and heated powdered metal, to be ejected into the atmosphere perpendicular to the projectile's trajectory, the ejected material quickly deaccelerating and becoming suspended in the atmosphere, the heated materials suspended in the atmosphere emitting heat observable at the location of a gunner.

Reduced Ricochet: At impact the body, disintegrates producing aero-ballistically inefficient fragments, with reduced mass, the terminal impact in combination reduce the risk of fragment ricochet. Ranges with exposed rocky outcrops frequently produce ricochets. Ricochet fragments frequently require militaries to set aside significant amounts of land as surface danger zones.

In the primary embodiment set forth in this application, a training projectile houses a liquid chemical payload, in a central mid-body cylindrical capsule that is aligned with the projectiles axis of rotation and proximate to the projectile's center of gravity. A $2^{nd}$ dry marker material may be packaged surrounding the chemical liquid payload, within the mid body container. The projectile has a forward bore rider on the metal ogive and a driving band aft of the capsule housing a liquid. Projectile set-back allows for the mixing of chemical segregated in compartments in a centrally aligned capsule, and spin-up in the interior diameter of a barrel imparts rotation on the projectile, the rotation allowing segregated chemicals to mix. As the projectile enters free ballistic flight, the chemicals react and produce a chemiluminescent liquid or a thermally heated liquid. At impact, the chemical reaction is predominantly complete, so that the liquids when released, exhibit chemiluminescence or are thermally emissions. The projectile, upon impact with a surface, having mid body components been fabricated from frangible materials such a polymers, structurally fails at impact due to combined stress of compression, torque and shear, forces action on the projectile, the break-up of the frangible components releasing a liquid marking chemical into the atmosphere, creating an observable marking signature. An alternate embodiment sets forth a fuzed air-burst training projectile, having a similar configuration, with the mid body component carrying a marker, the ignition of an energetic transfers heat to a powdered metal, the disintegrating powdered metal and escaping combustion gases, cause the mid body of the projectile to burst, the released marking material is ejected perpendicular to the axis of projectile travel.

DESCRIPTION OF PREFERRED EMBODIMENTS

The preferred embodiments of the present invention will now be described with reference to FIGS. 1A to FIG. 19 of the reference drawings. Identical elements of the various figures are designated with the same reference numbers, incorporated into three different types of gun fired cartridges depicted herein in three configurations—30 mm×113 cartridge, 40 mm×53 cartridge and a 105 mm Tank cartridge.

FIGS. 1A-8C depicts embodiments of the cartridge configuration in 30 mm, 40 mm and 105 mm projectiles.

FIG. 1A depicts 30 mm gun fired cartridges (2) with driving bands (42). A cartridge case (4) encloses propellant powder (8).

Figure 3A:
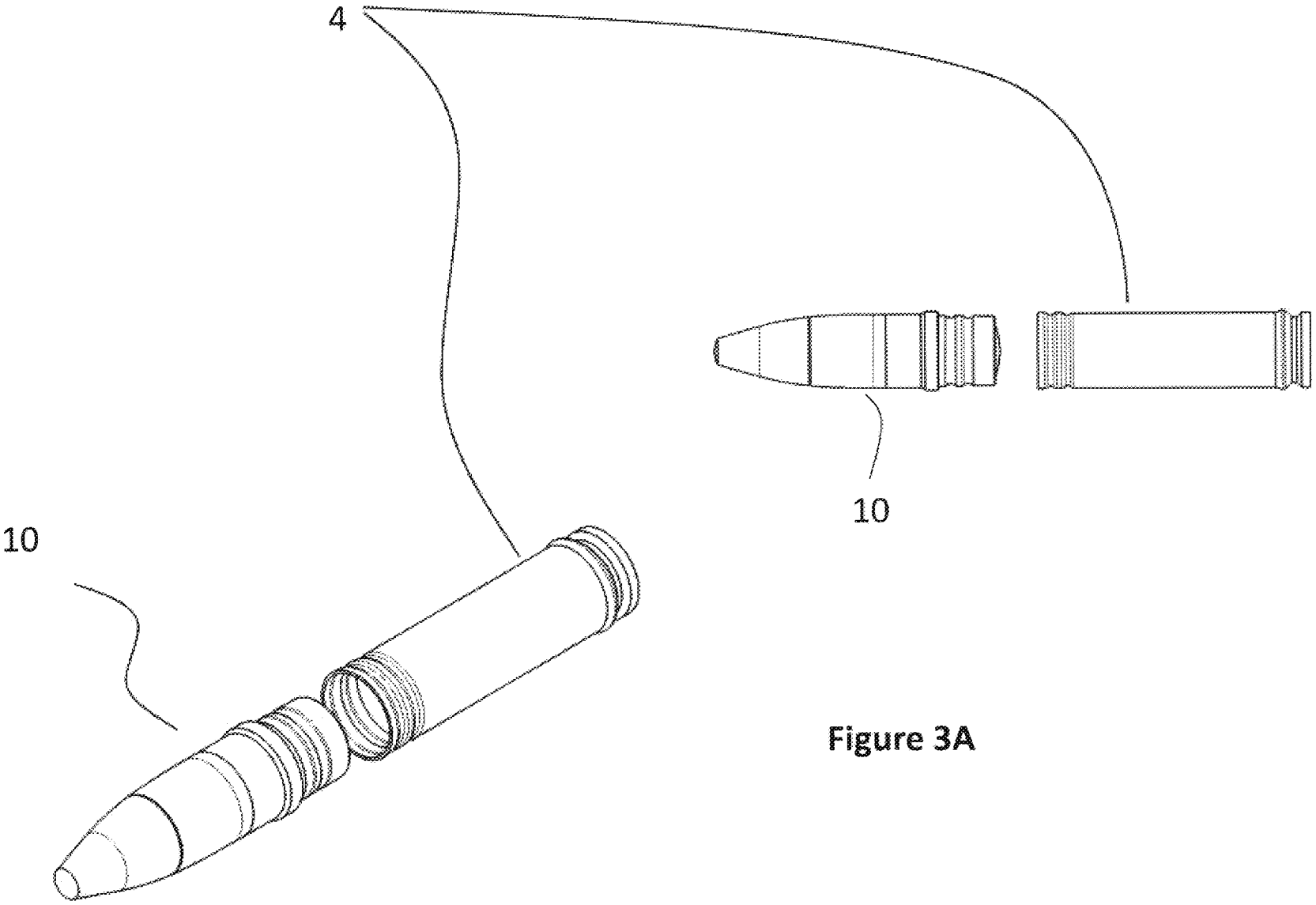
Figure 3B:
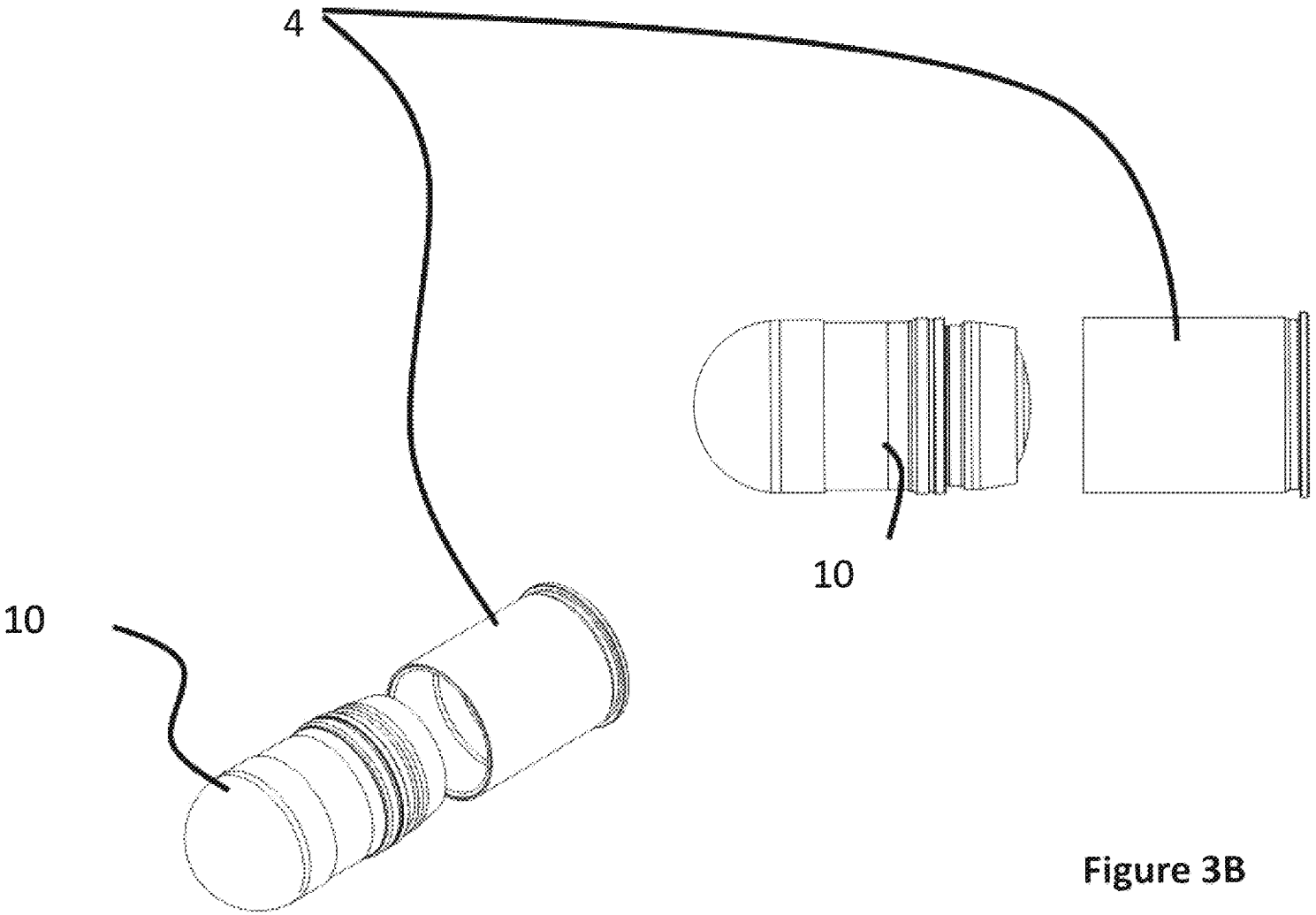
Figure 3C:
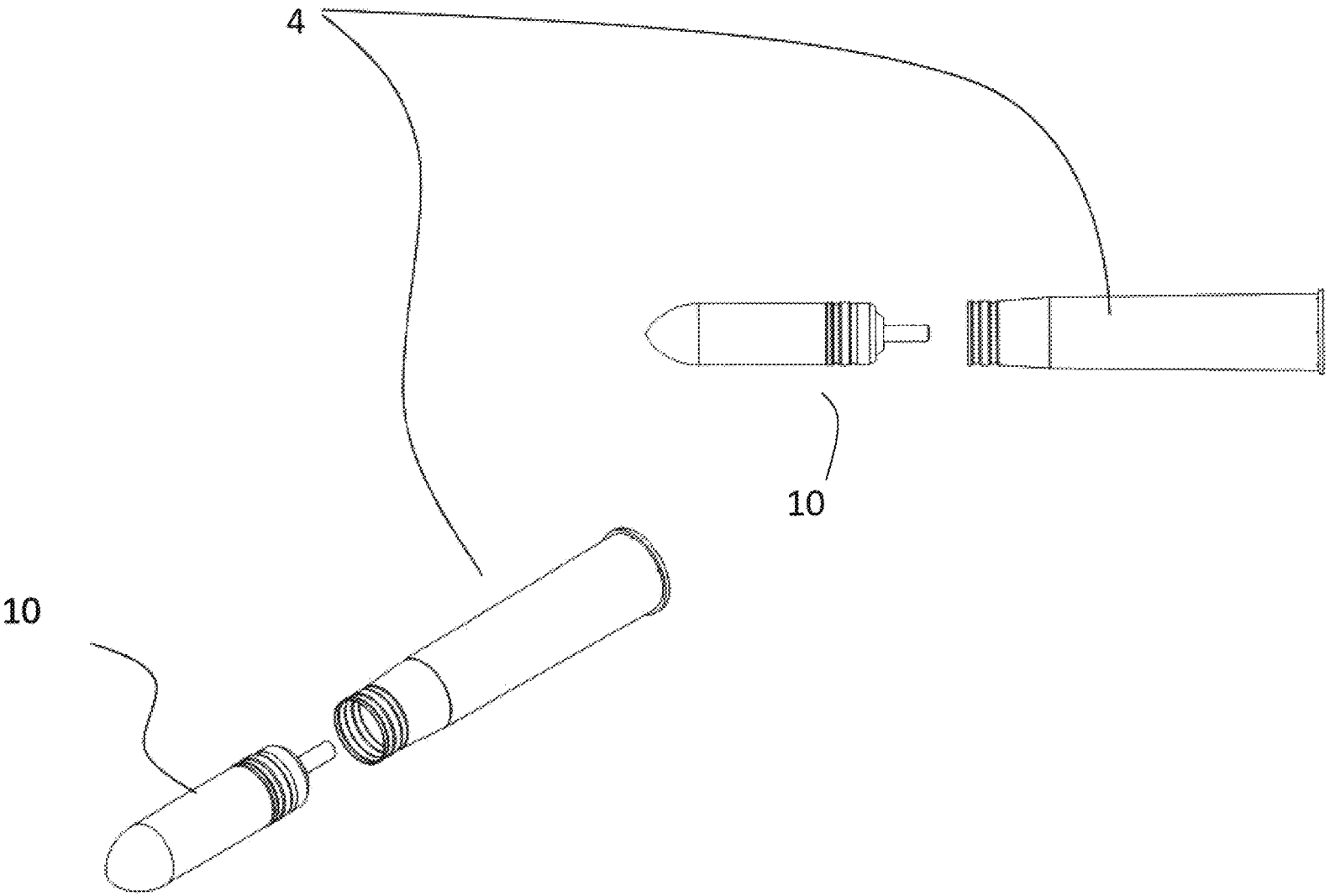

FIG. 3A depicts a 30 mm projectile (10) incorporated into a cartridge case (4). FIG. 3B depicts a 40 mm projectile (10) and cartridge case (4). FIG. 3C depicts a 105 mm tank projectile (10) and a cartridge case (4).

Figure 4A:
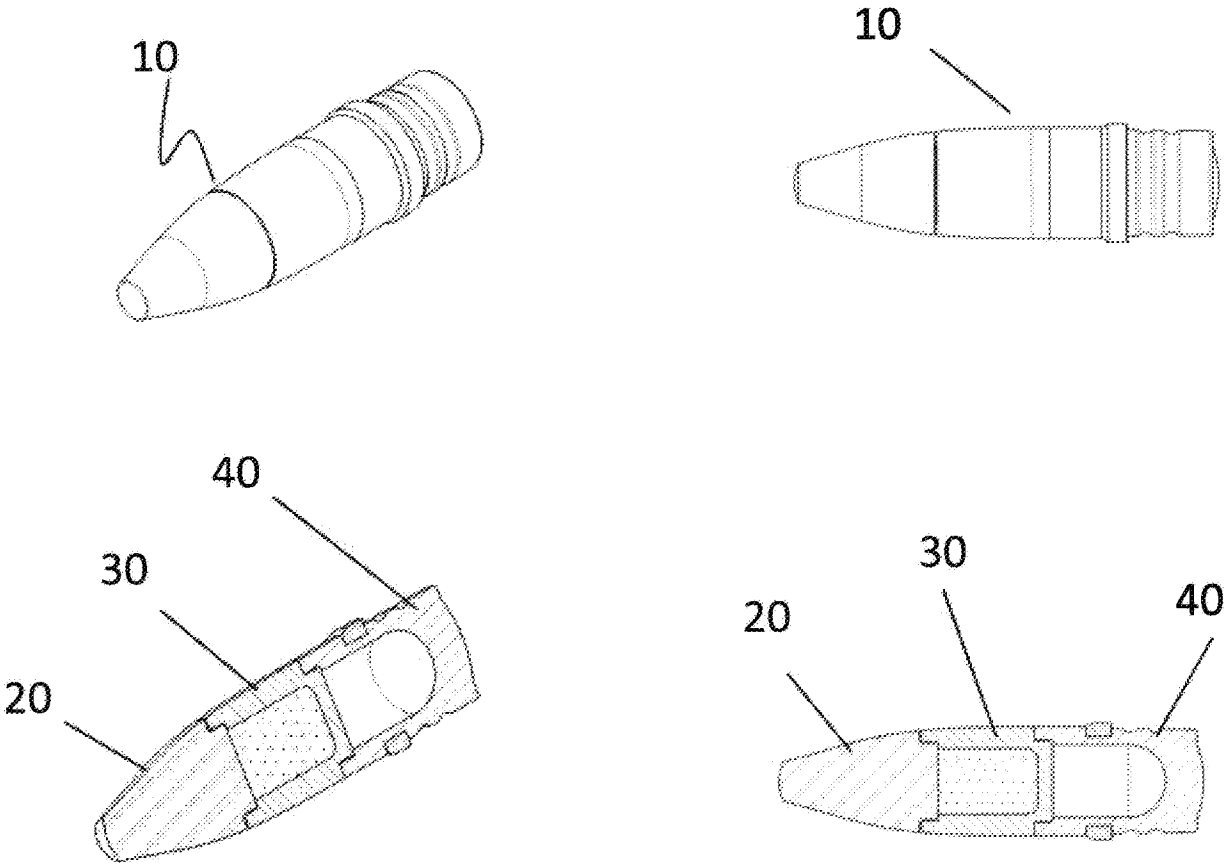

FIG. 4A depicts external and section views of a 30 mm marking projectile (10) composed of three principle components—a nose cap (20), marking body (30) and a metallic, non-frangible projectile base (40).

Figure 4B:
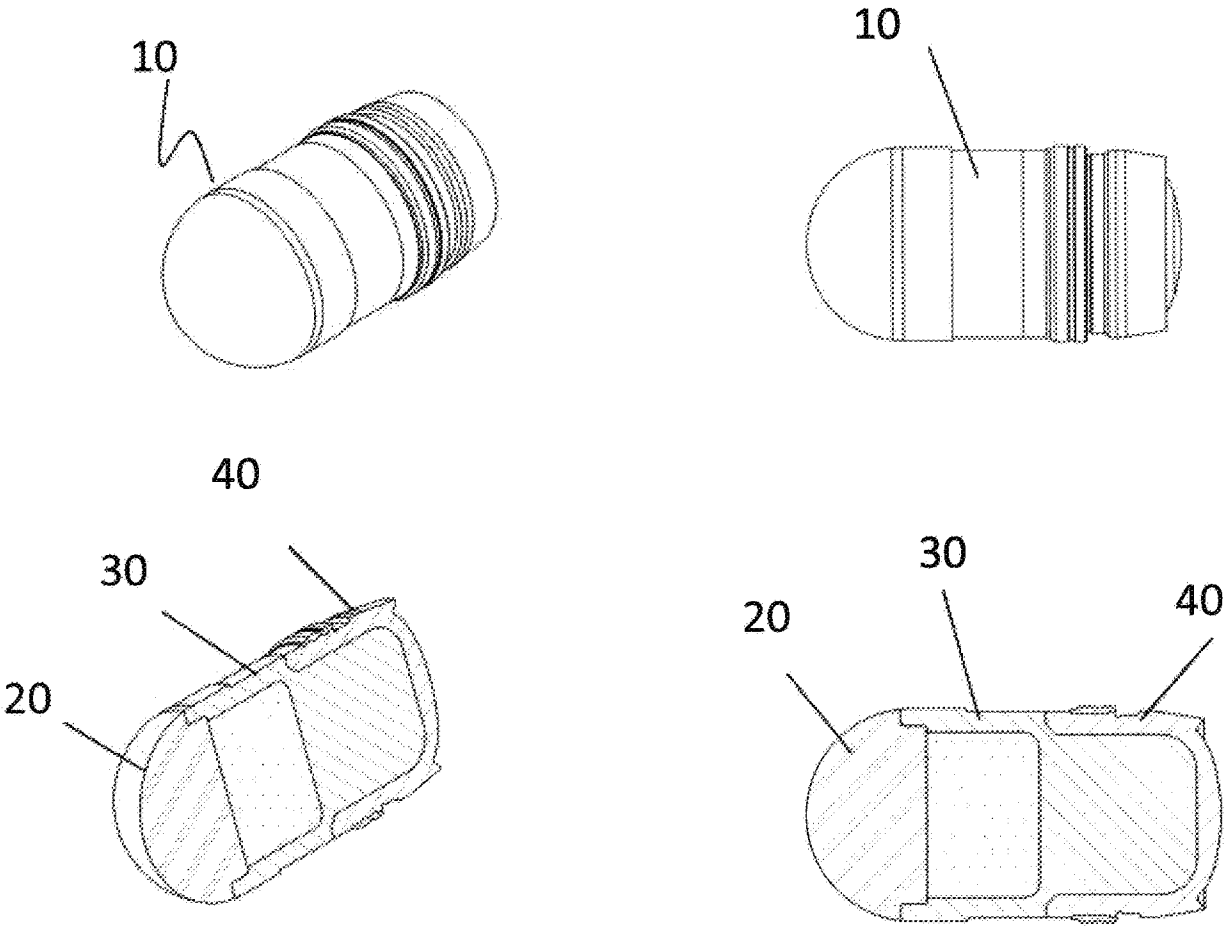

FIG. 4B depicts external and section views of a 40 mm marking projectile (10) composed of three principle components—a nose cap (20), marking body (30) and a metallic, non-frangible projectile base (40).

Figure 4C:
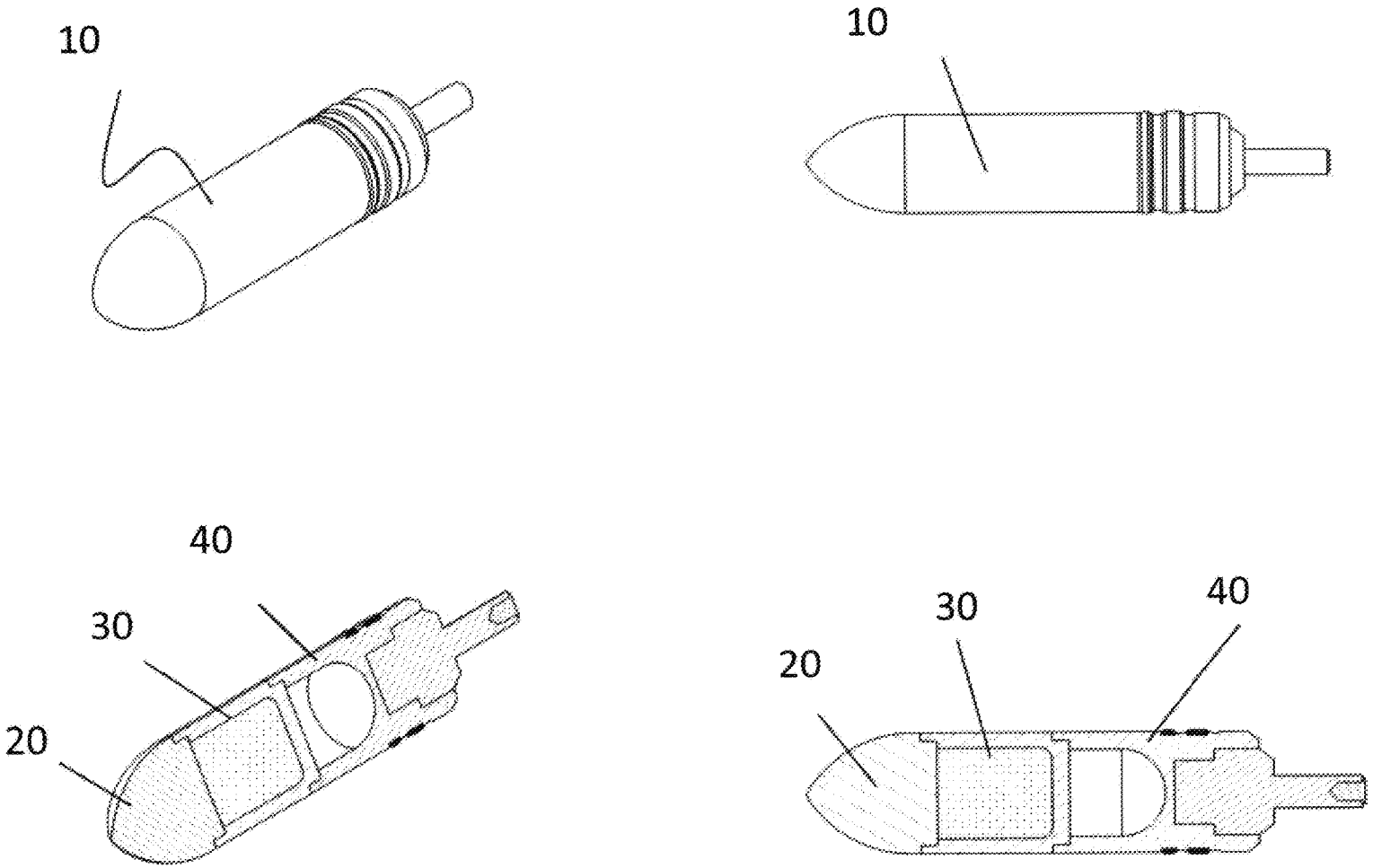

FIG. 4C depicts external and section views of a 105 mm marking projectile (10) composed of three principle components—a nose cap (20), marking body (30) and a metallic, non-frangible projectile base (40).

Figure 5A:
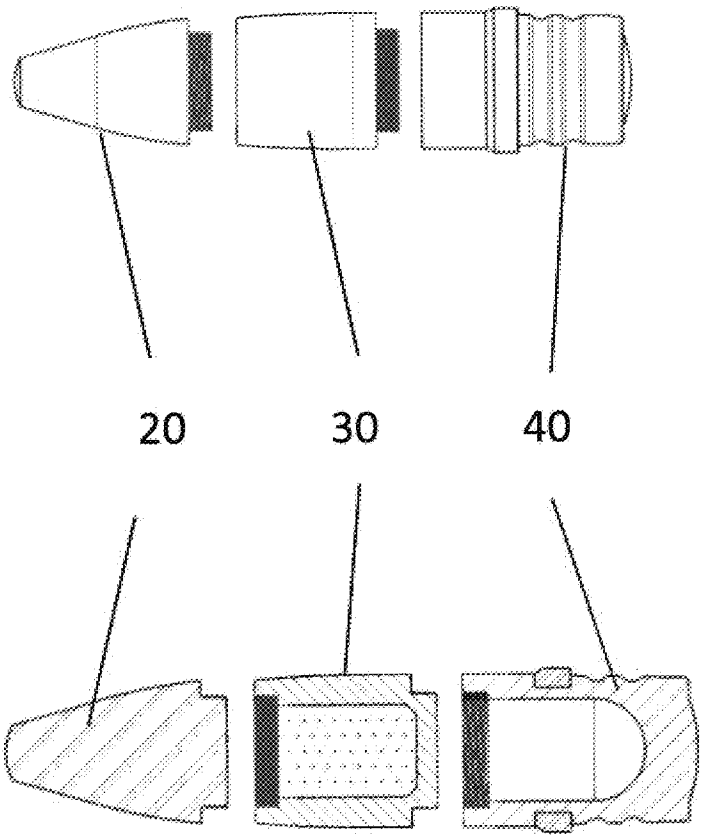
Figure 5A:
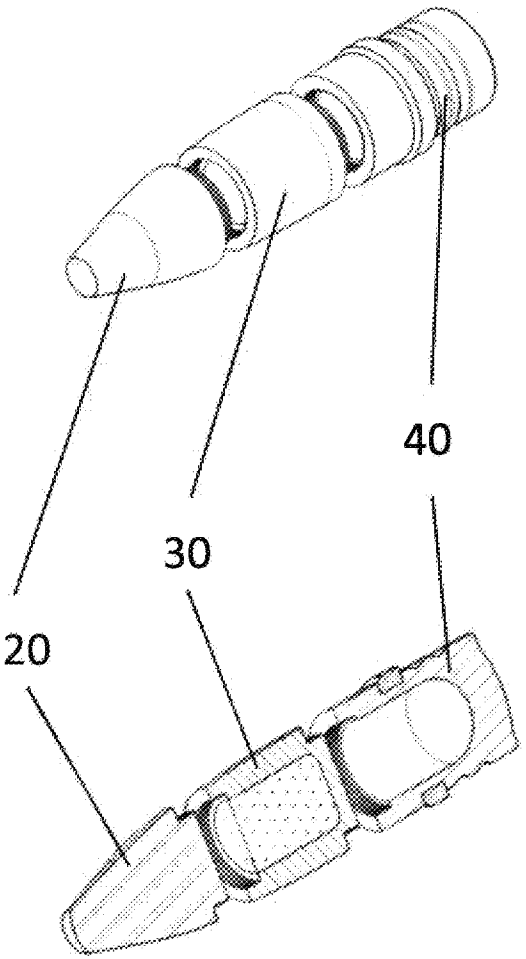

FIG. 5A depict an exploded view of a 30 mm marking projectile (10) and the principle elements—a nose cap (20), marking body (30) and a metallic, non-frangible projectile base (40).

Figure 5B:
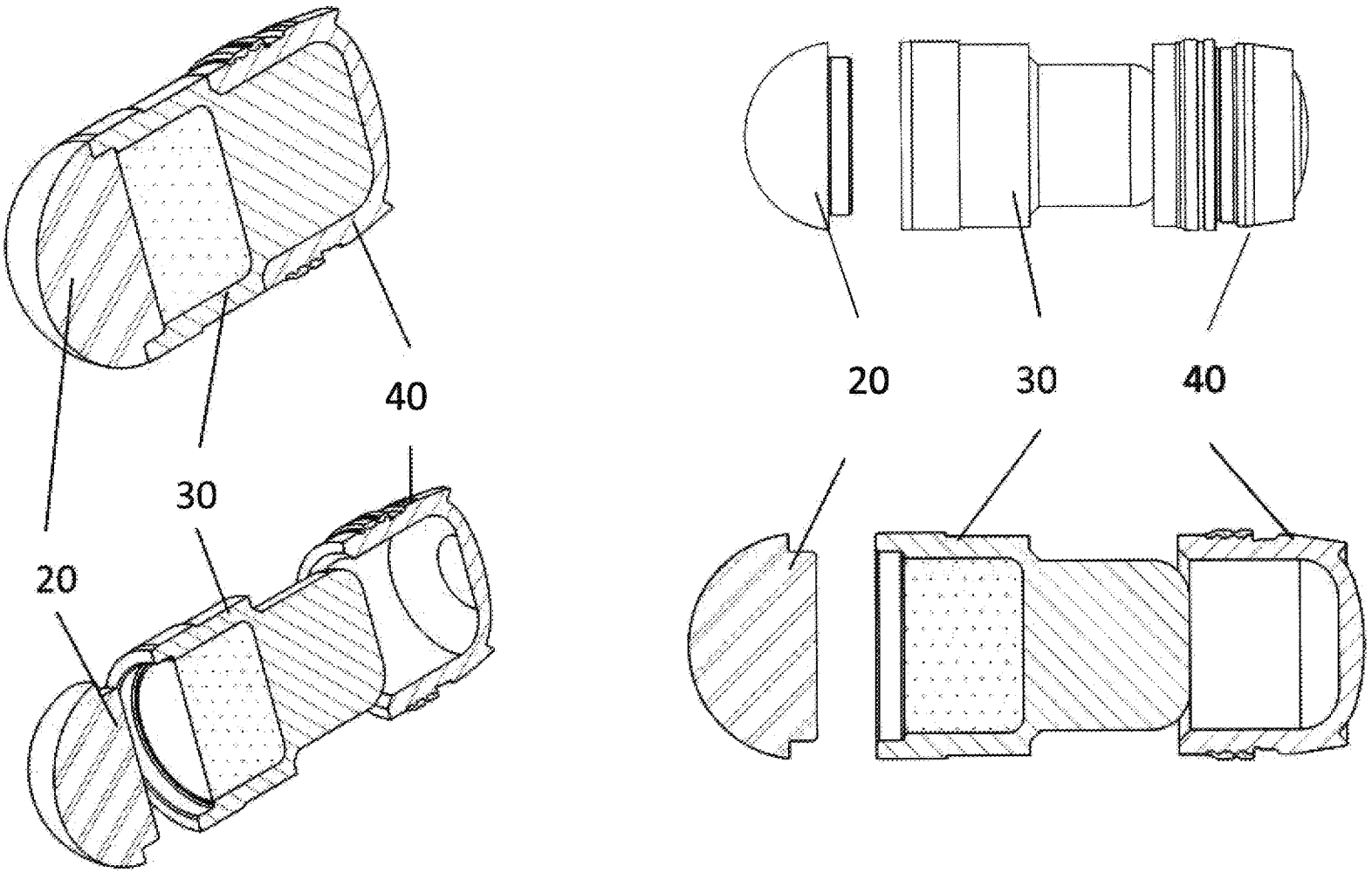

FIG. 5B depict an exploded view of a 40 mm marking projectile (10) and the principle elements—a nose cap (20), marking body (30) and a metallic, non-frangible projectile base (40).

Figure 5C:
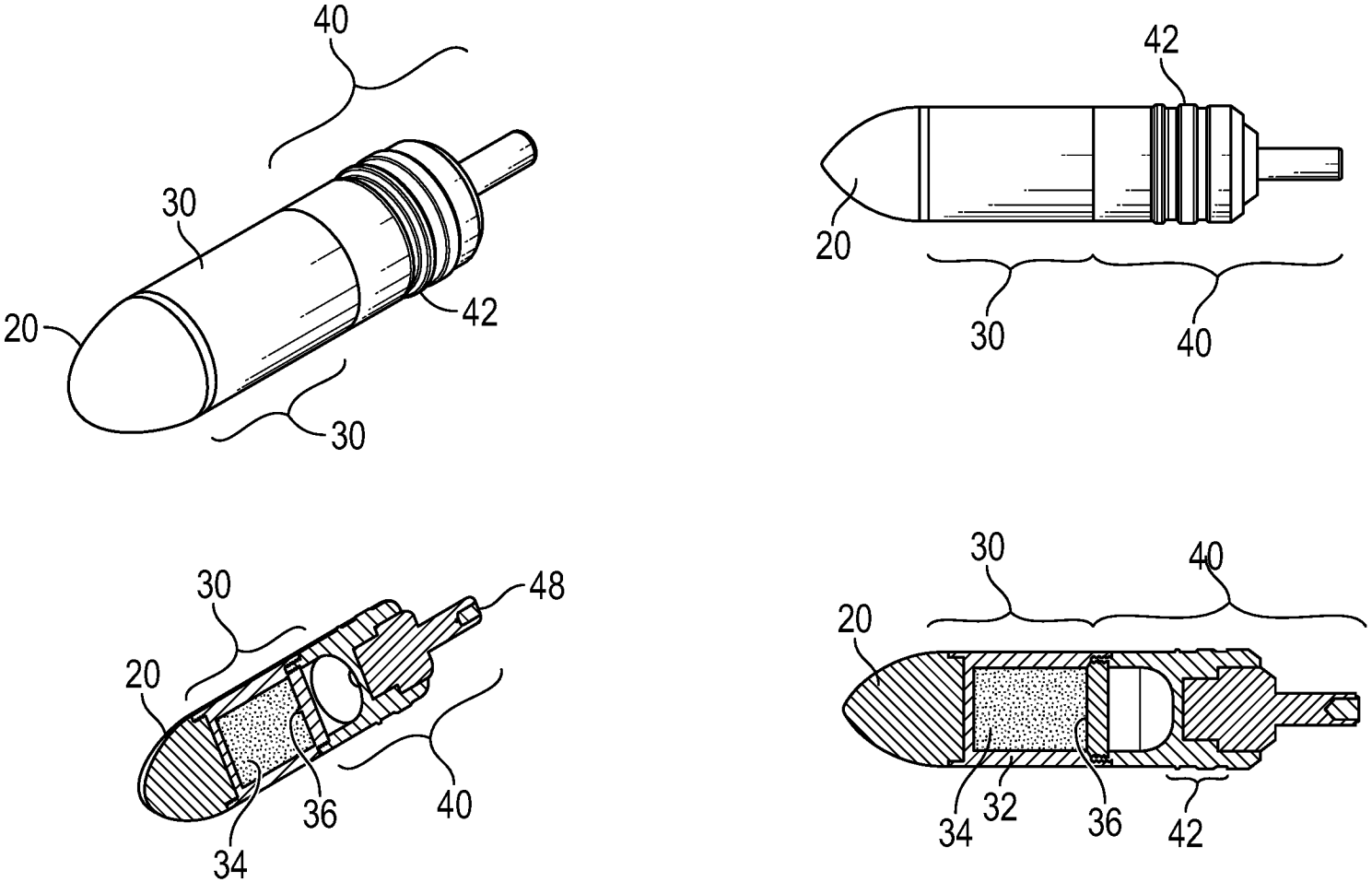

FIG. 5C depict an exploded view of a 105 mm marking projectile (10) and the principle elements—a nose cap (20), marking body (30) and a metallic, non-frangible projectile base. The base may also include a tracer assembly (46) or tracer element (48), the tracer providing a visual cue of the projectile's flight path.

Figure 5D:
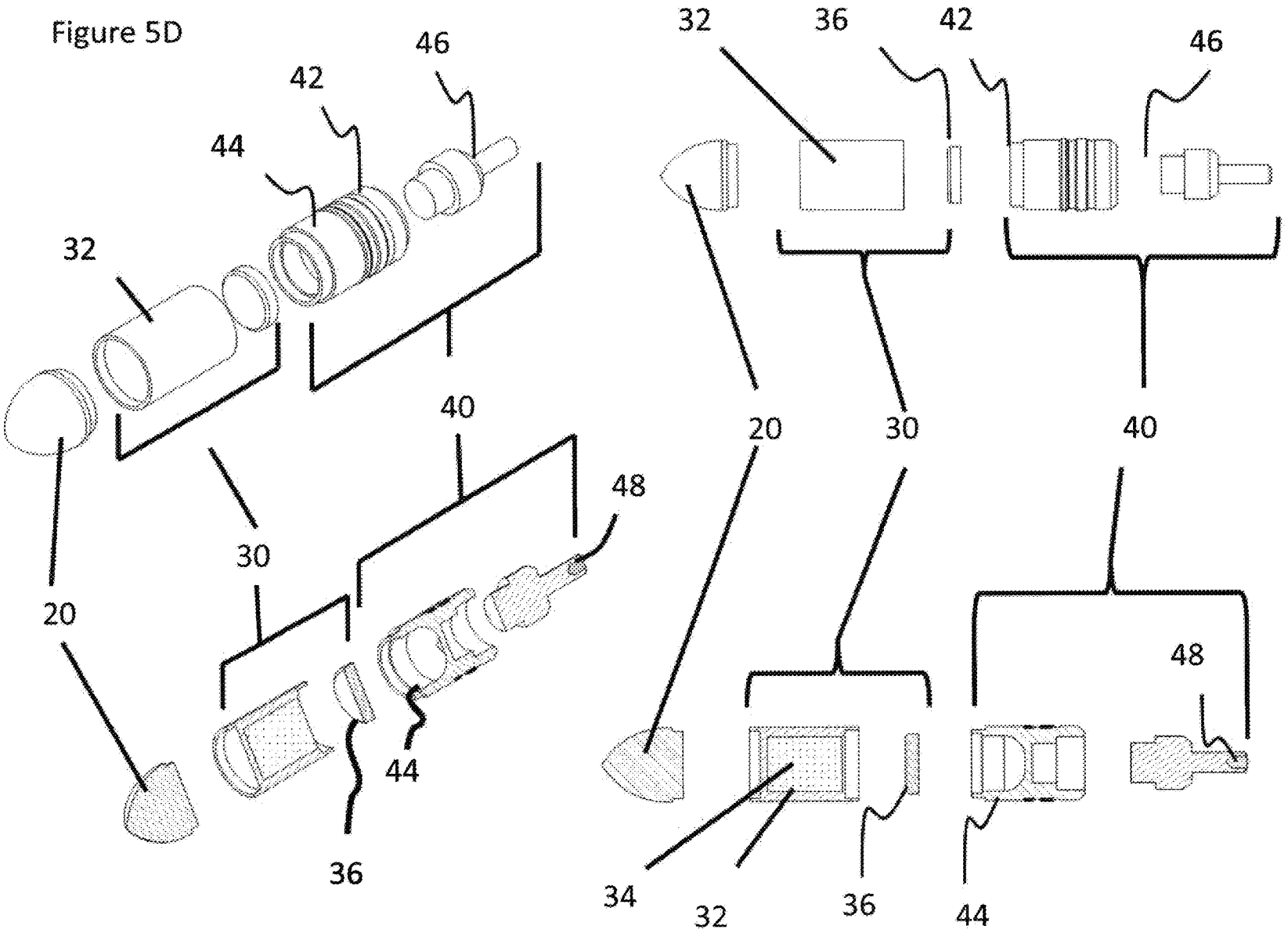

FIG. 5D depicts and exploded view of a 105 mm marking projectile (10), the principle elements (20,30 and 40) and an exploded view of the marking body (30) including a pusher plate (36), and a base including a driving band (42) affixed to a non-frangible body (44), tracer assembly (46) and tracer element (48).

Figure 6A:
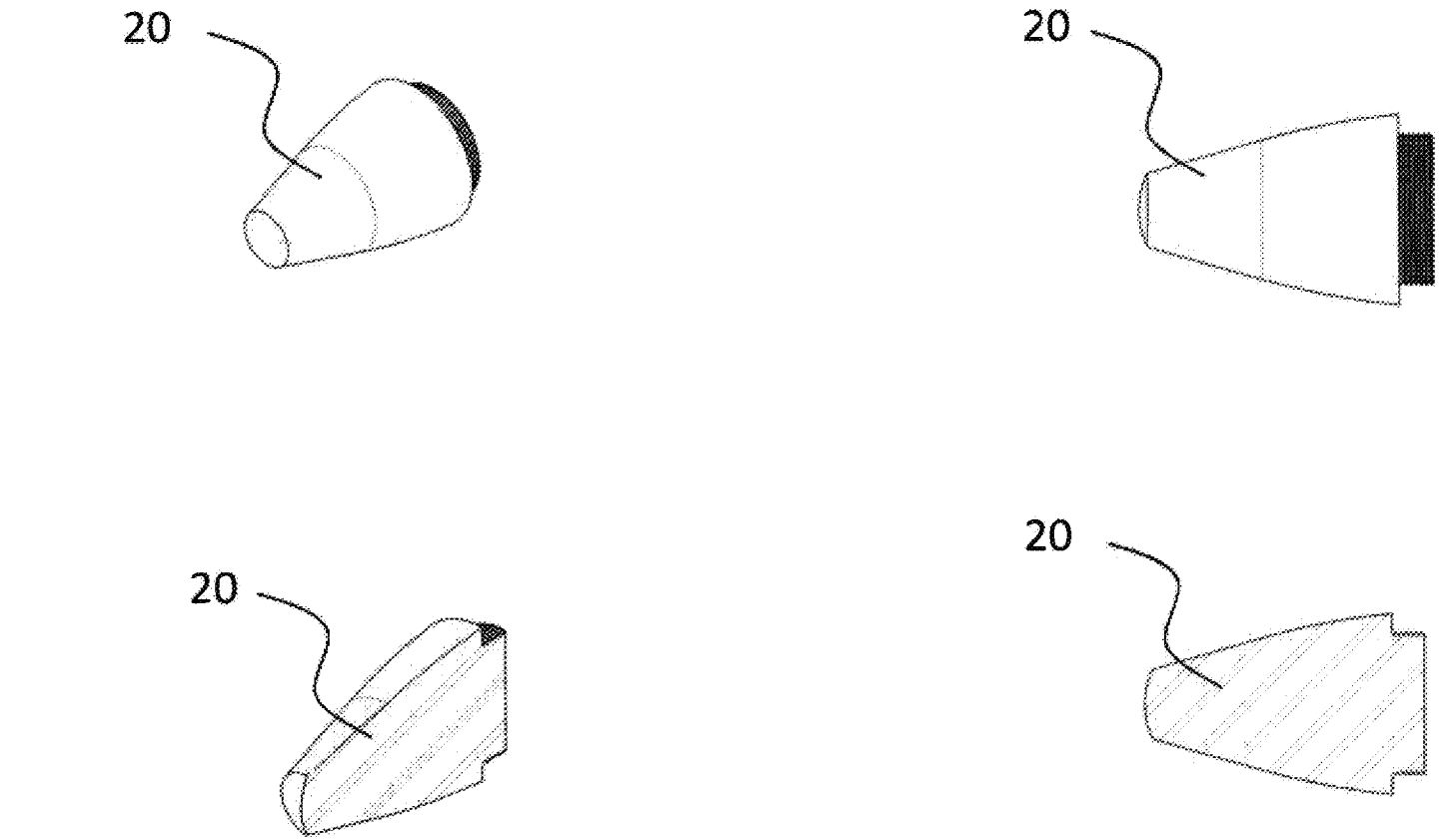
Figure 6B:
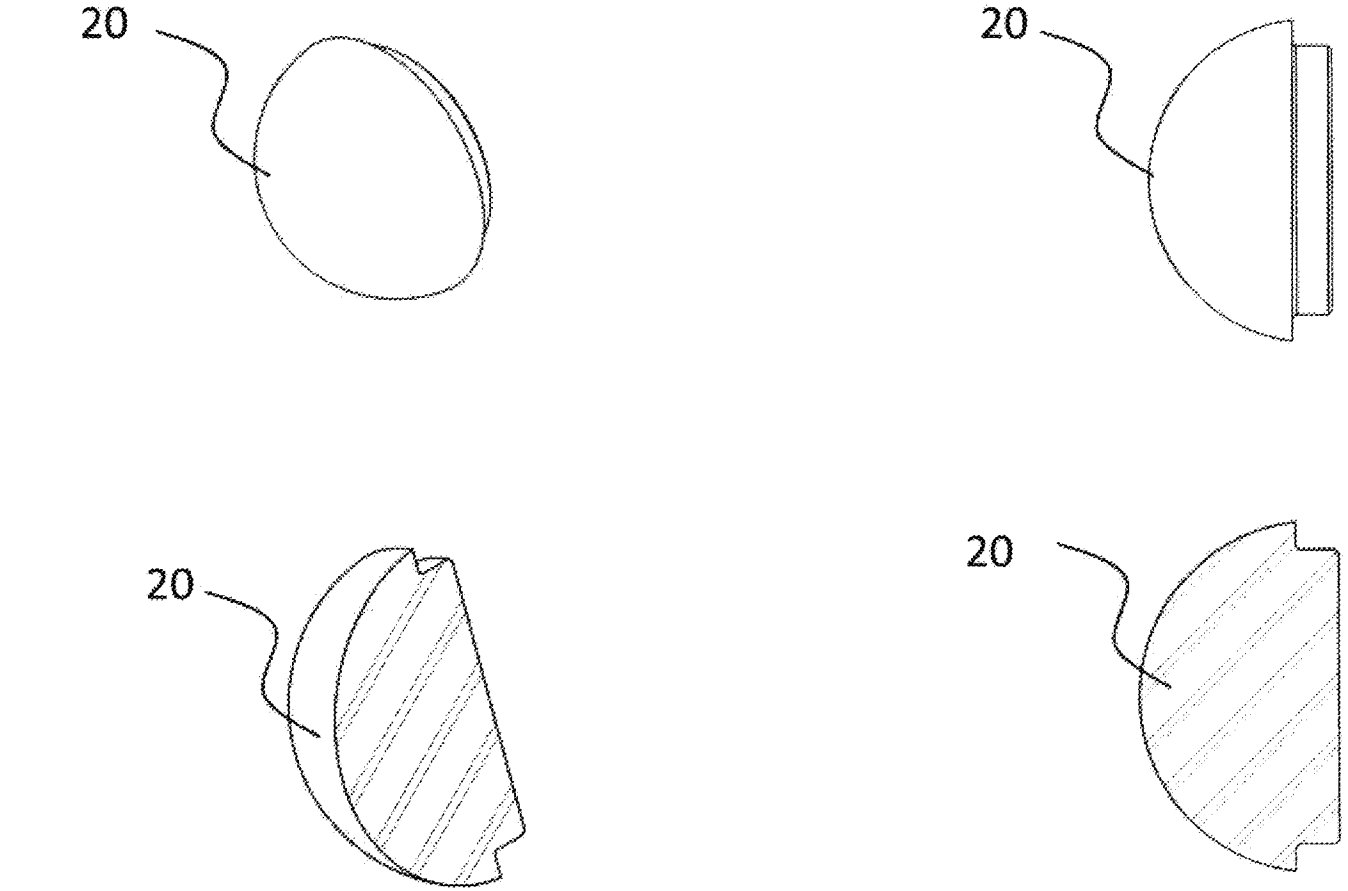
Figure 6C:
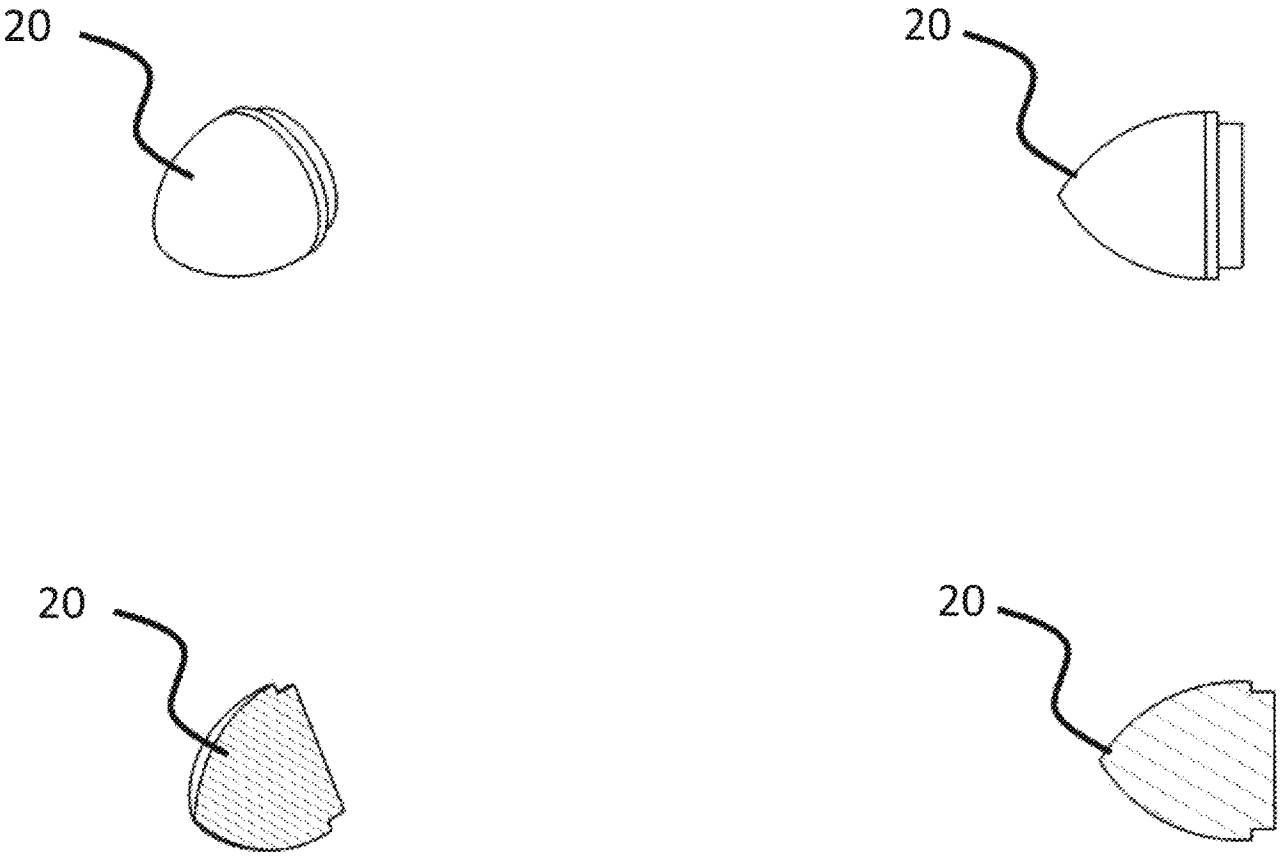

FIG. 6A-6C depict metallic nose caps (20) for 30 mm, 40 mm and 105 mm projectiles.

Figure 7A:
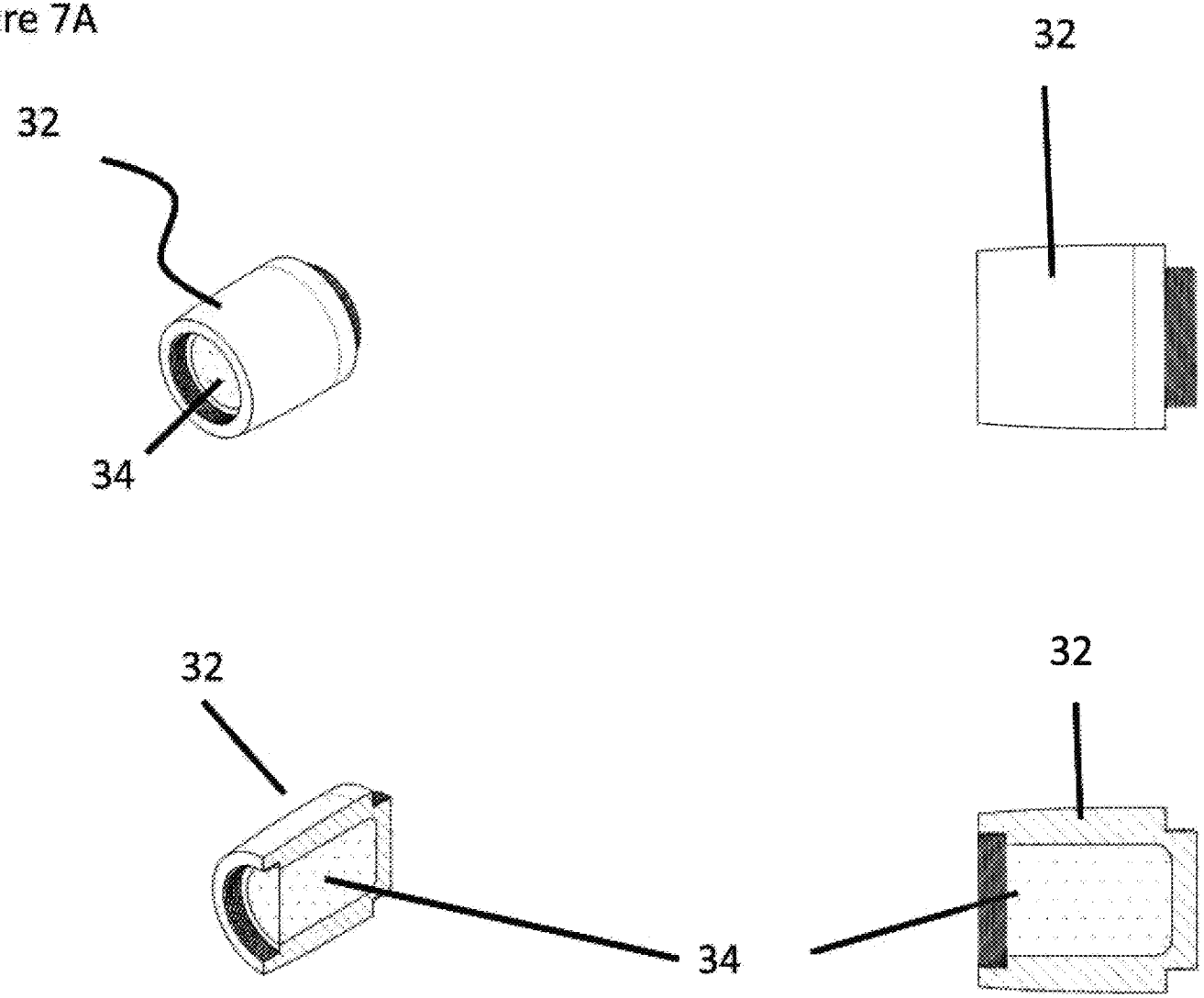
Figure 7B:
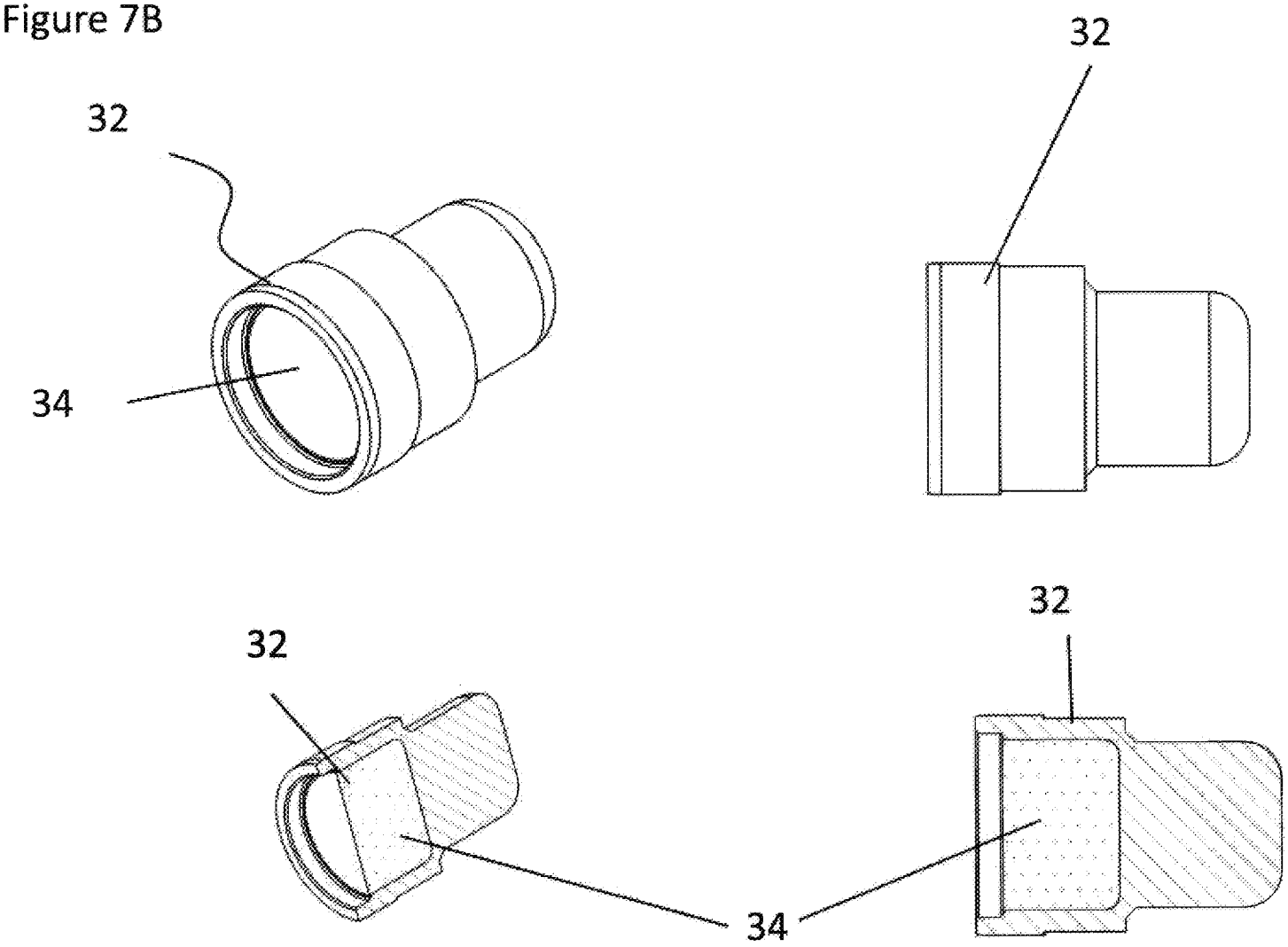
Figure 7C:
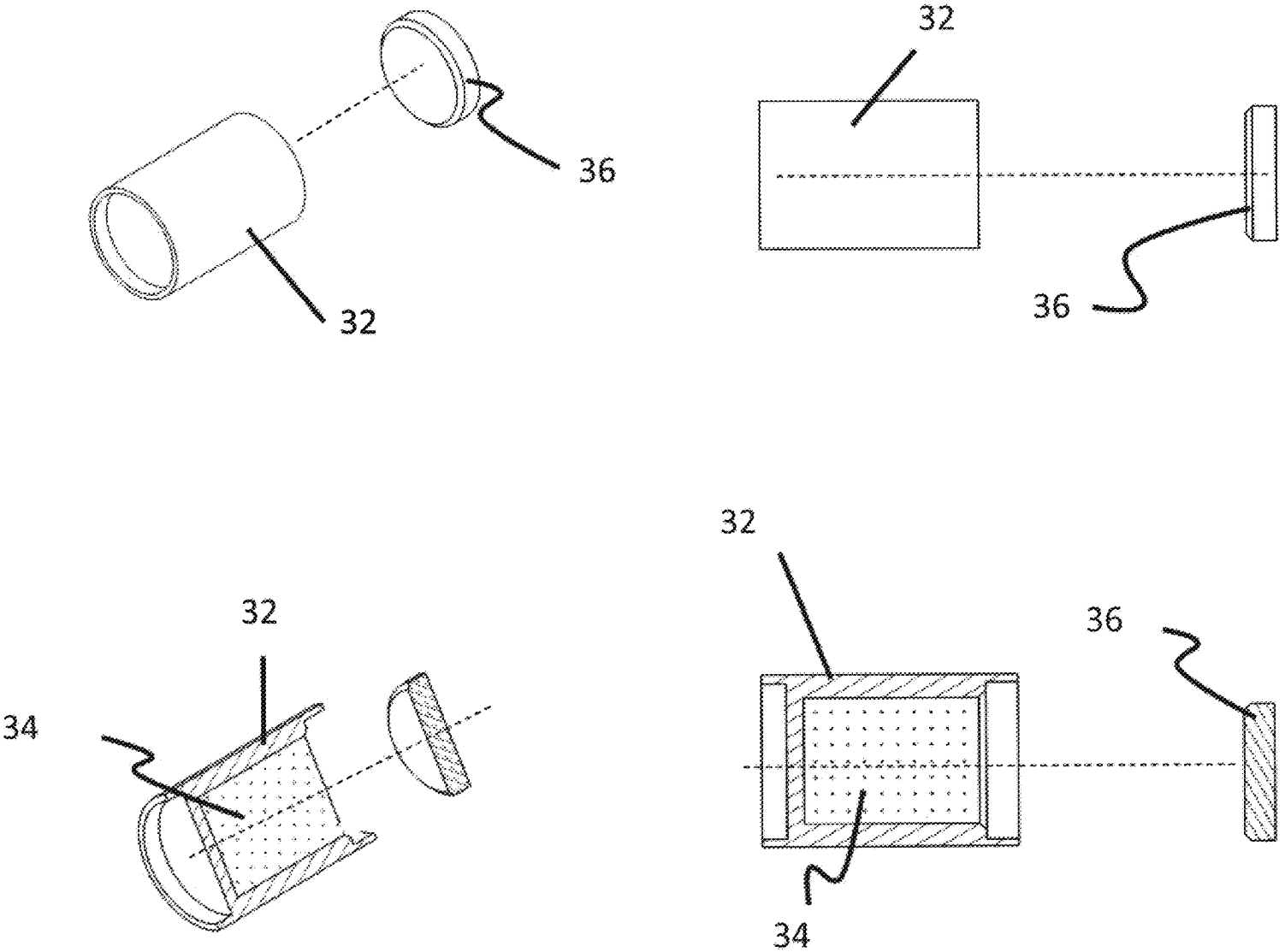

FIG. 7A-7B depict mid body marking bodies fabricated from a frangible body (32) and encapsulating a marking powder (34). FIG. 7C Depicts components in a 105 mm marking body including a frangible body (32), Contained marking powder (34) and a pusher plate (36).

Figure 8A:
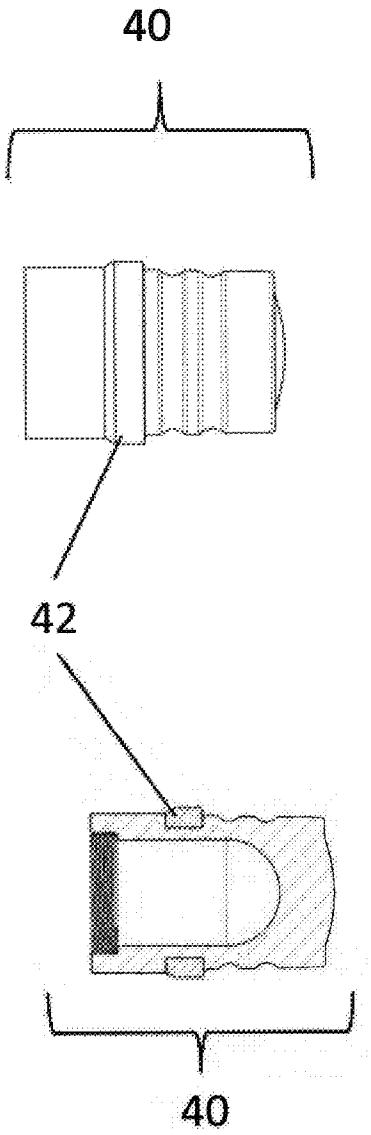
Figure 8A:
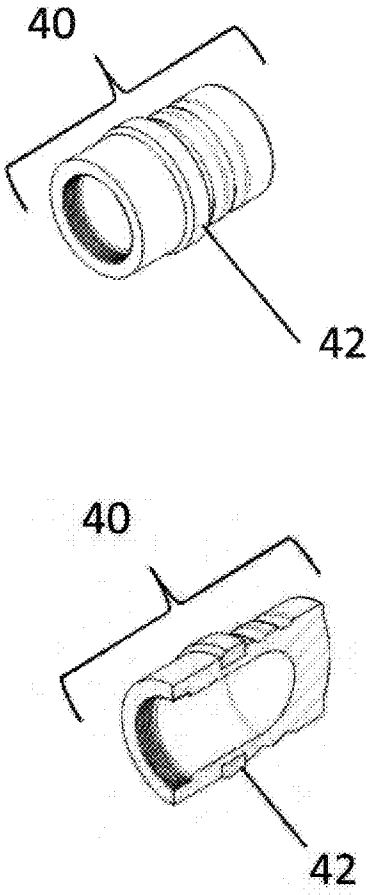
Figure 8B:
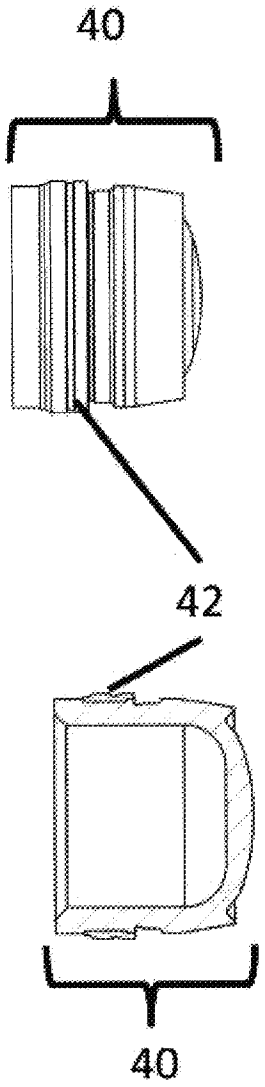
Figure 8B:
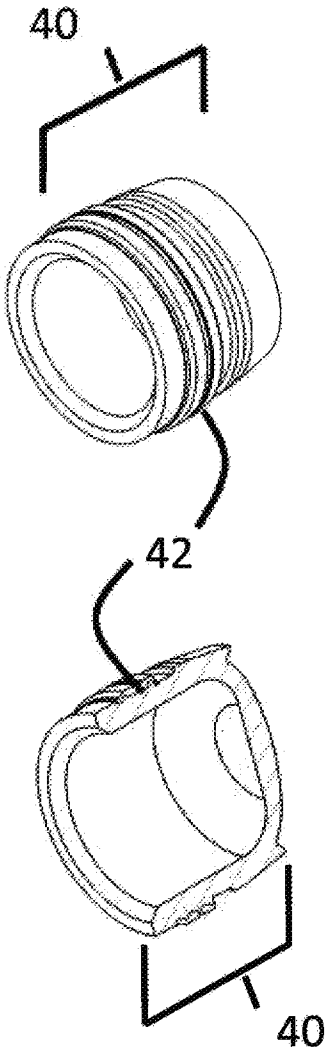
Figure 8C:
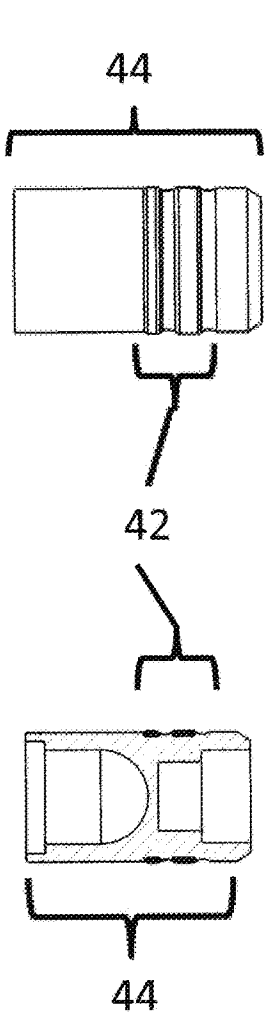
Figure 8C:
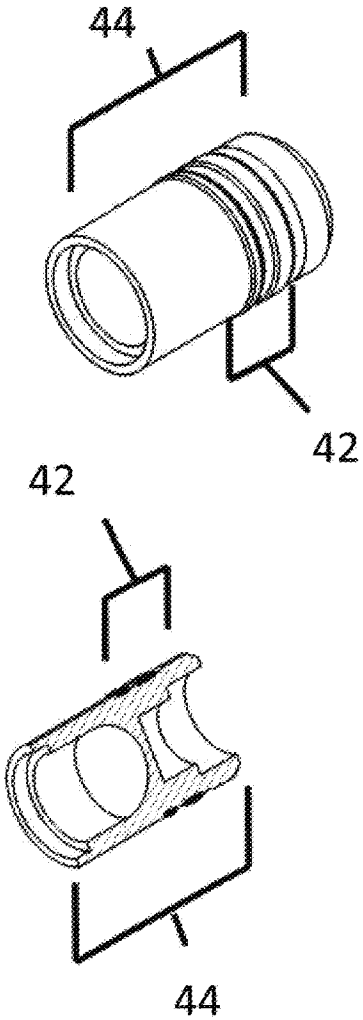

FIG. 8A-8B depict the non-frangible base preferably produced from a dense metal and incorporates a driving band (42). FIG. 8C depicts the non-frangible body (44) with driving band (42).

Figure 9A:
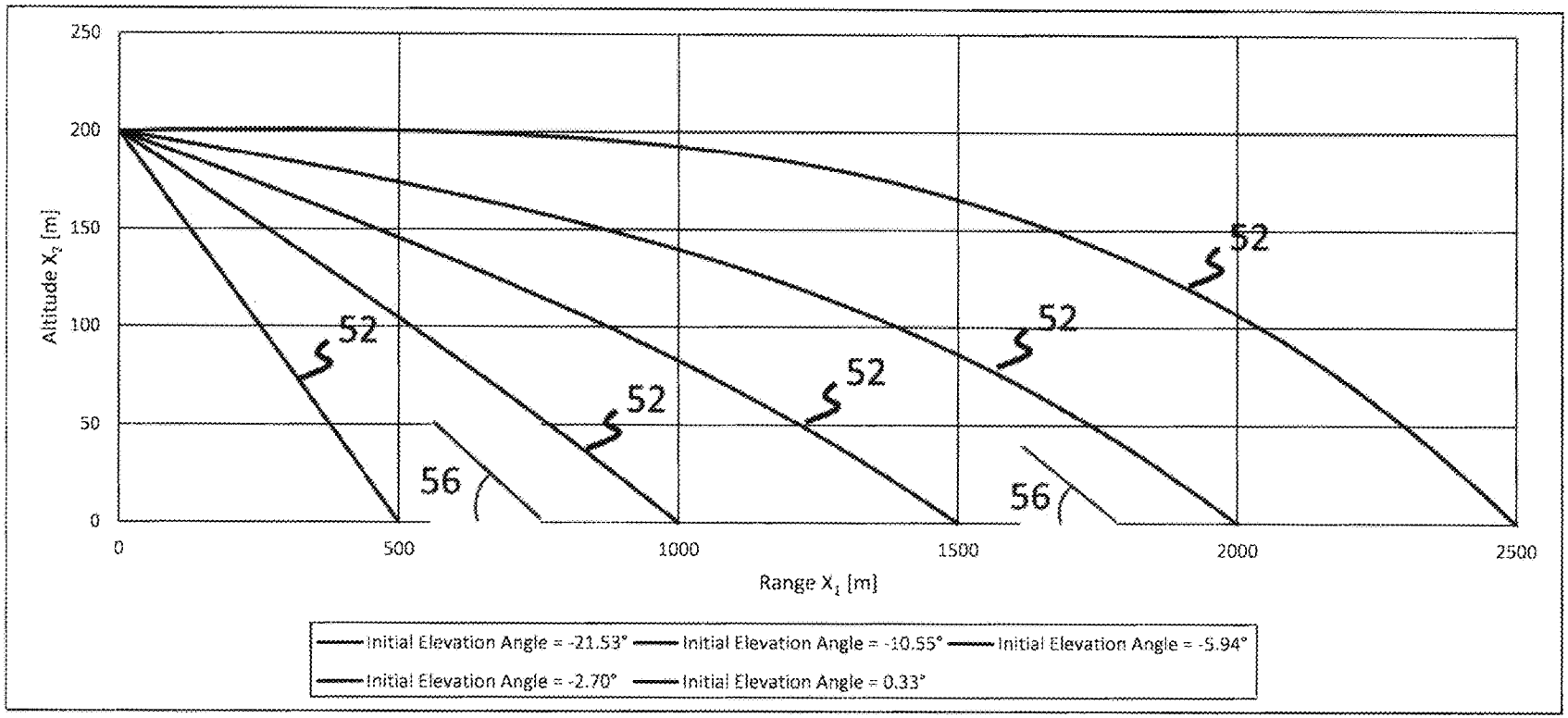

FIG. 9A depicts the trajectory and impact angle of 30 mm×113 projectiles fired from a helicopter firing at targets from 500-2500 meters. The table below the diagram (altitude versus range) identifies the impact angle of 30 mm projectiles at various ranges.

Figure 9B:
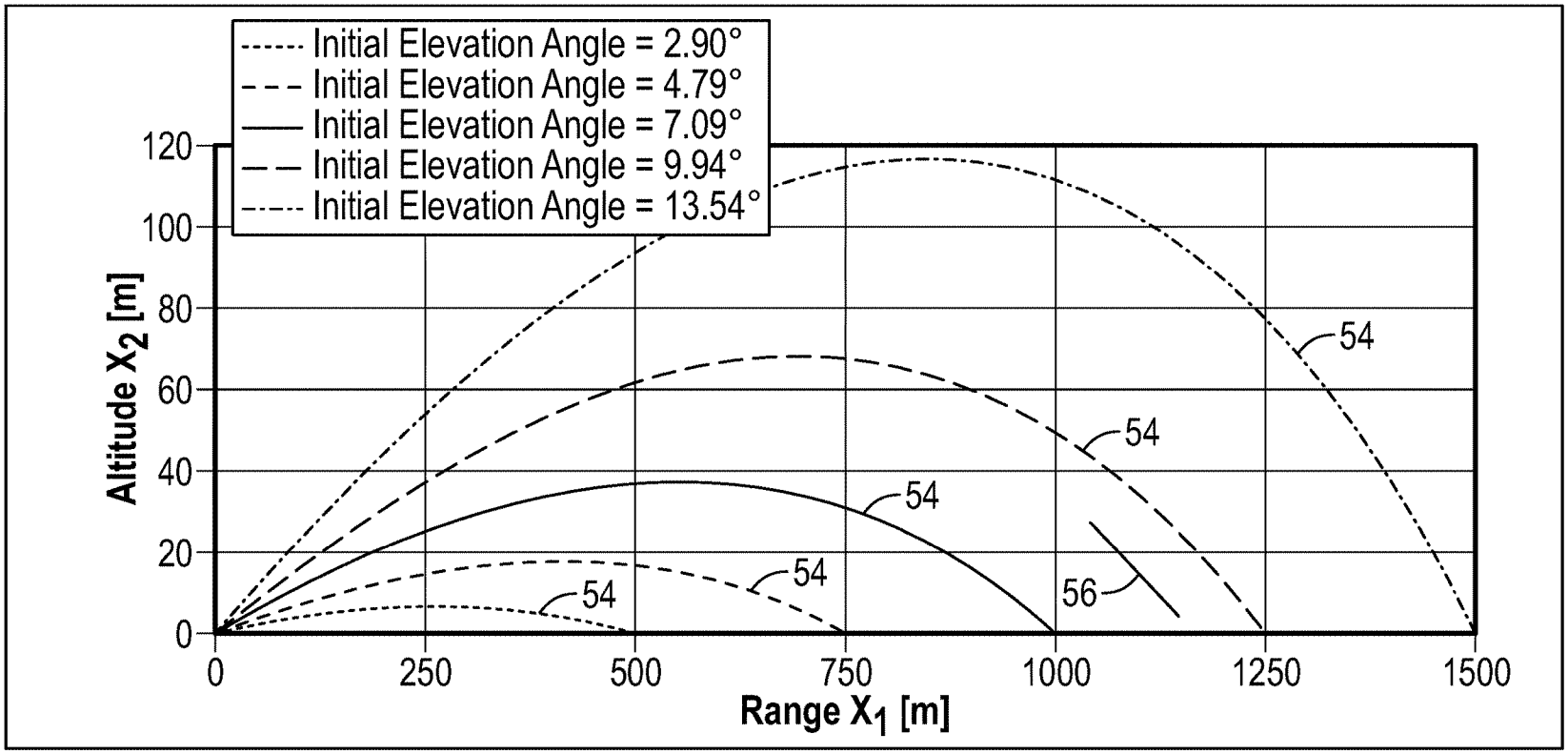

FIG. 9B depicts the trajectory and impact angle of 40 mm×53 projectiles fired from a ground position at ranges for 500-1500 meters. The table below the diagram (altitude versus range) identified the impact angle of the 40 mm projectile.

PROJECTILE IMPACT, BREAK-UP AND MARKING SIGNATURE

Impact Geometry and Signature: FIG. 10A-10F illustrate the impact function of the projectile, where translational momentum and inertia (124), coupled with rotational moment and inertia (128) and impact shear forces (130), incident to impact, produce wall compression (66), wall tension (68) and shear forces (130) the cause the frangible body to fracture (76) ejecting the marking material perpendicular to translational (linear momentum and inertia) vector (124) in various impact angles (56), surface angles (58) with various trajectories (52, 54) usable in most training environments.

Figure 10A:
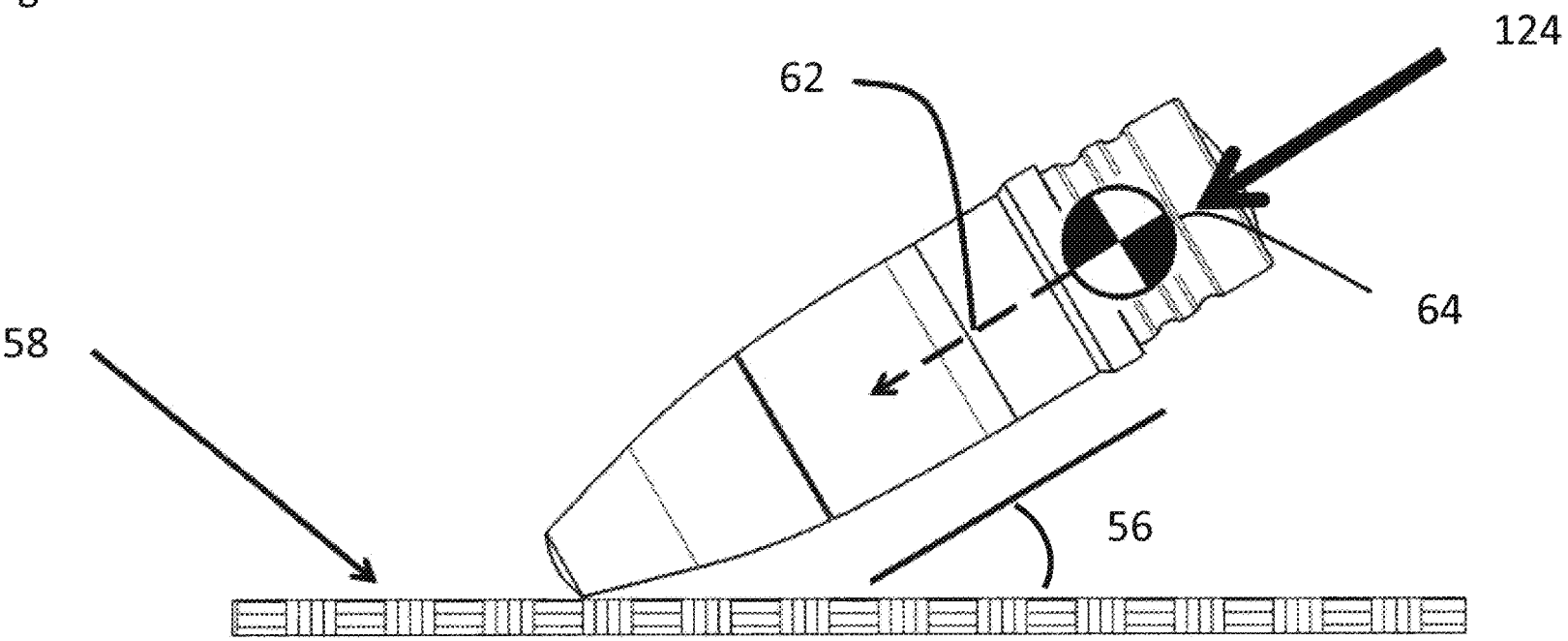

FIG. 10A depicts the impact angle (56) of a 30 mm projectile impacting on a surface (58) with a residual travel vector (62) and the projectile's center of gravity (64), and forward momentum (124) at the moment of impact.

Figure 1A:
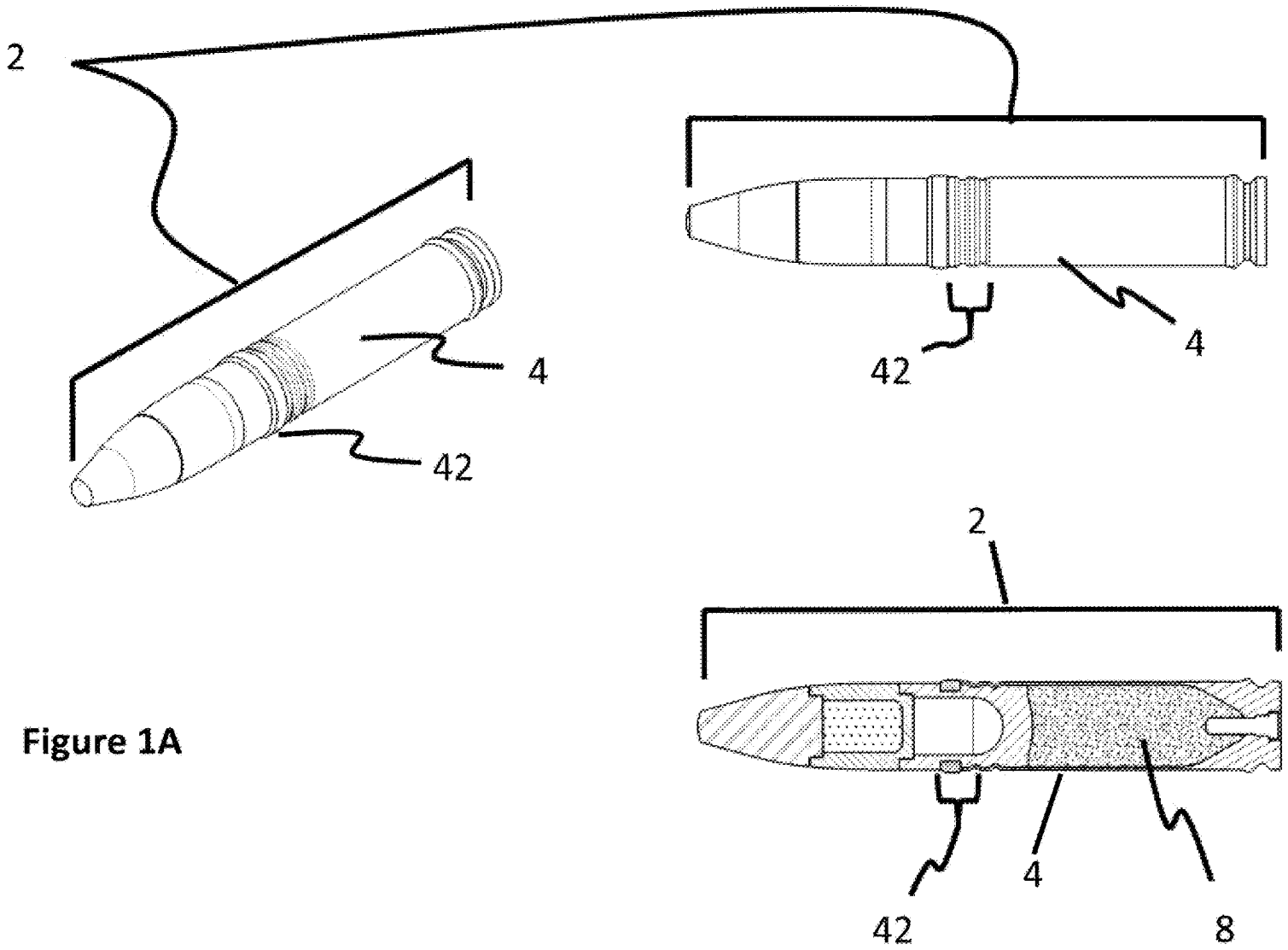
Figure 1B:
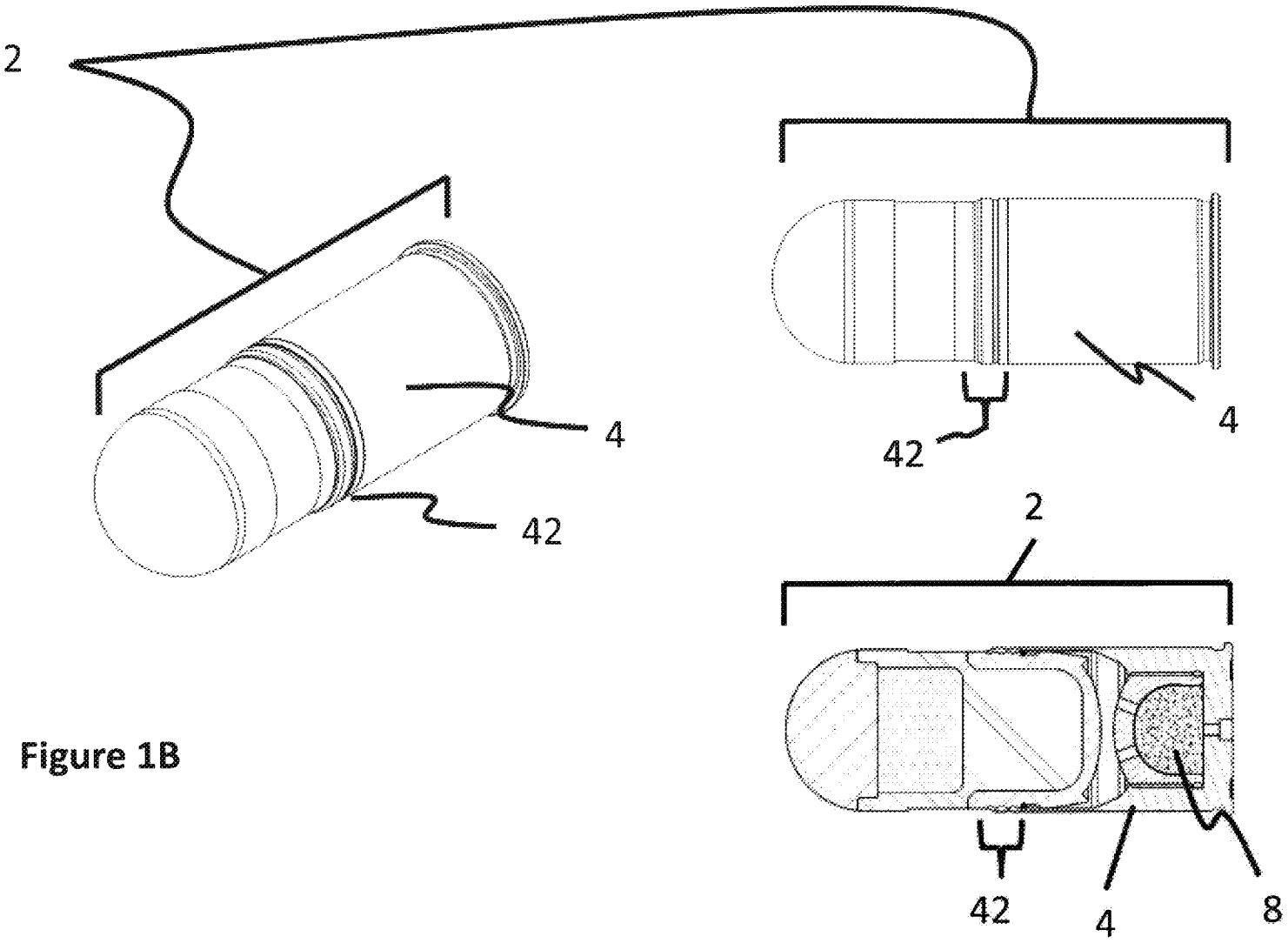
FIG. 1B depicts 40 mm gun fired cartridges (2) with driving bands (42). A cartridge case (4) encloses propellant powder (8).
Figure 1C:
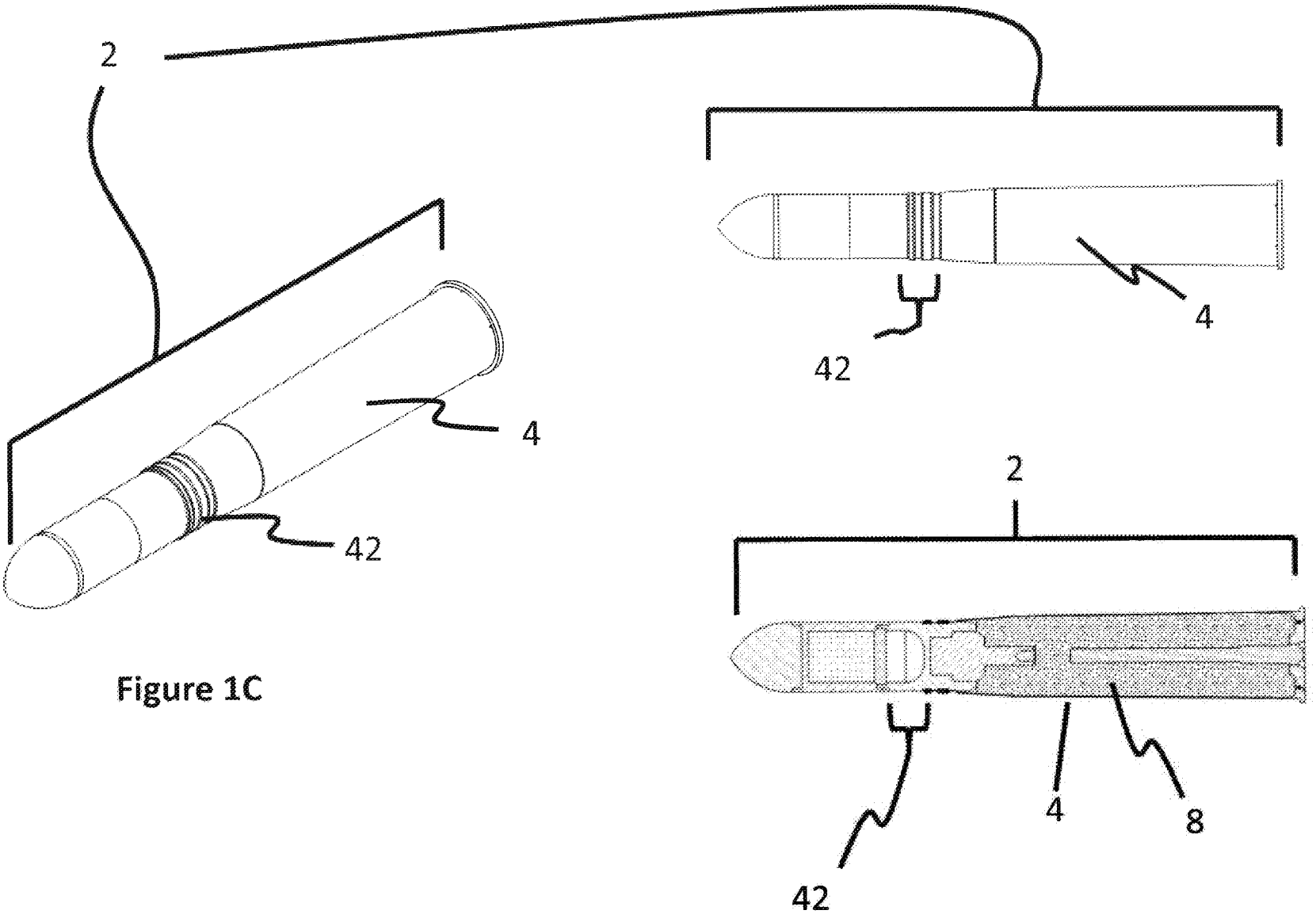
FIG. 1C depicts 105 mm (tank) gun cartridges (2) with driving bands (42). A cartridge case (4) encloses propellant powder (8).
Figure 2A:
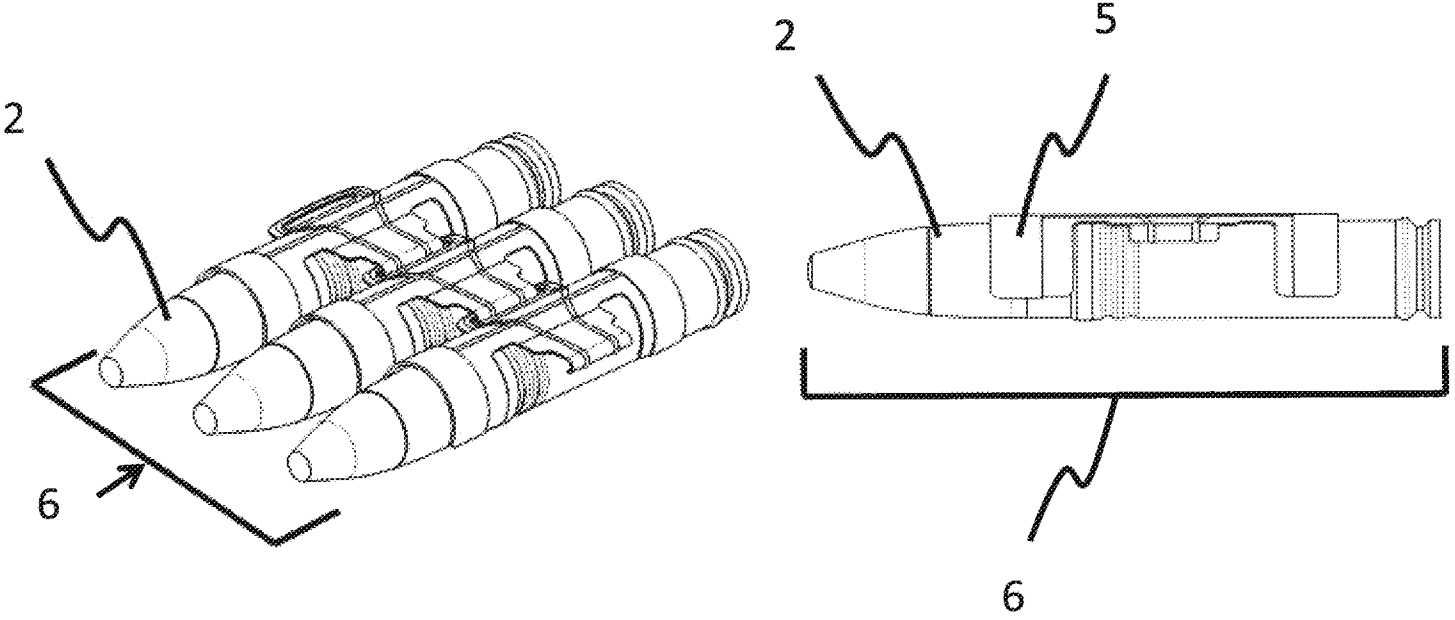
FIG. 2A depict a 30 mm cartridge (2) configured in a belt of ammunition (6).
Figure 2B:
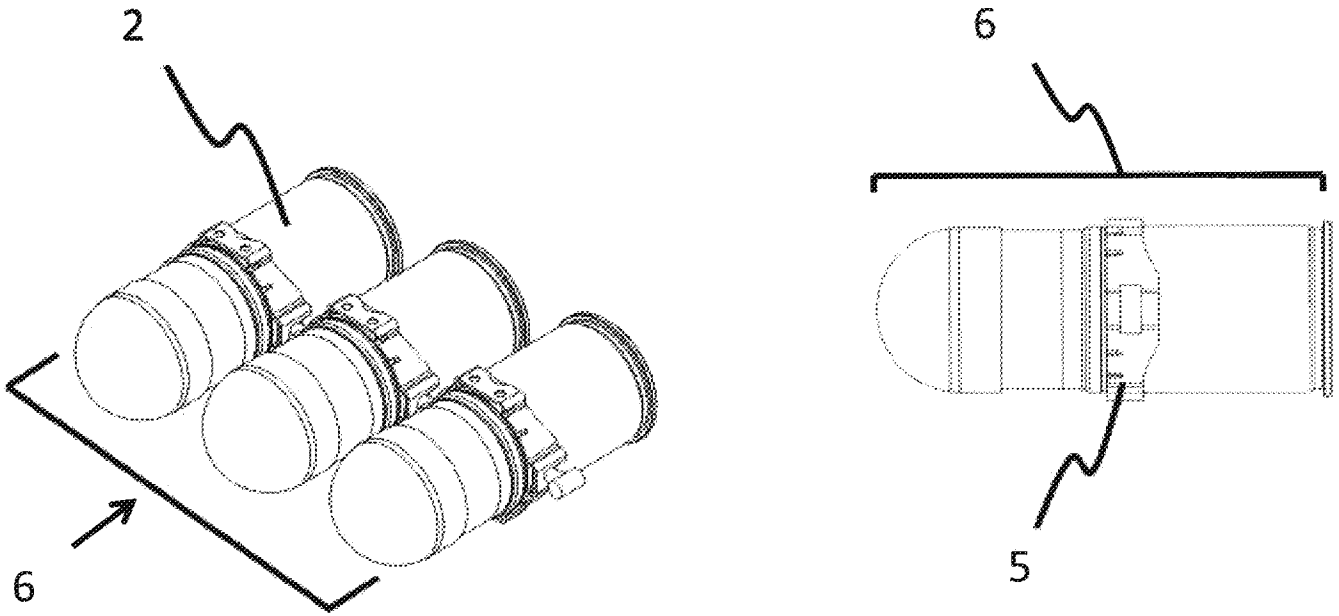
FIG. 2B depict a 40 mm cartridge (2) configured, connected by a link (5), forming a belt of ammunition (6).

FIGS. 10B1 and 10B2 depicts a 30 mm projectile's travel vector (62) when impact on the surface (58) milliseconds after the moment of impact, where the forward momentum (124) creates areas of compression (66) and tension (68) in the projectile's mid body.

Figure 10C:
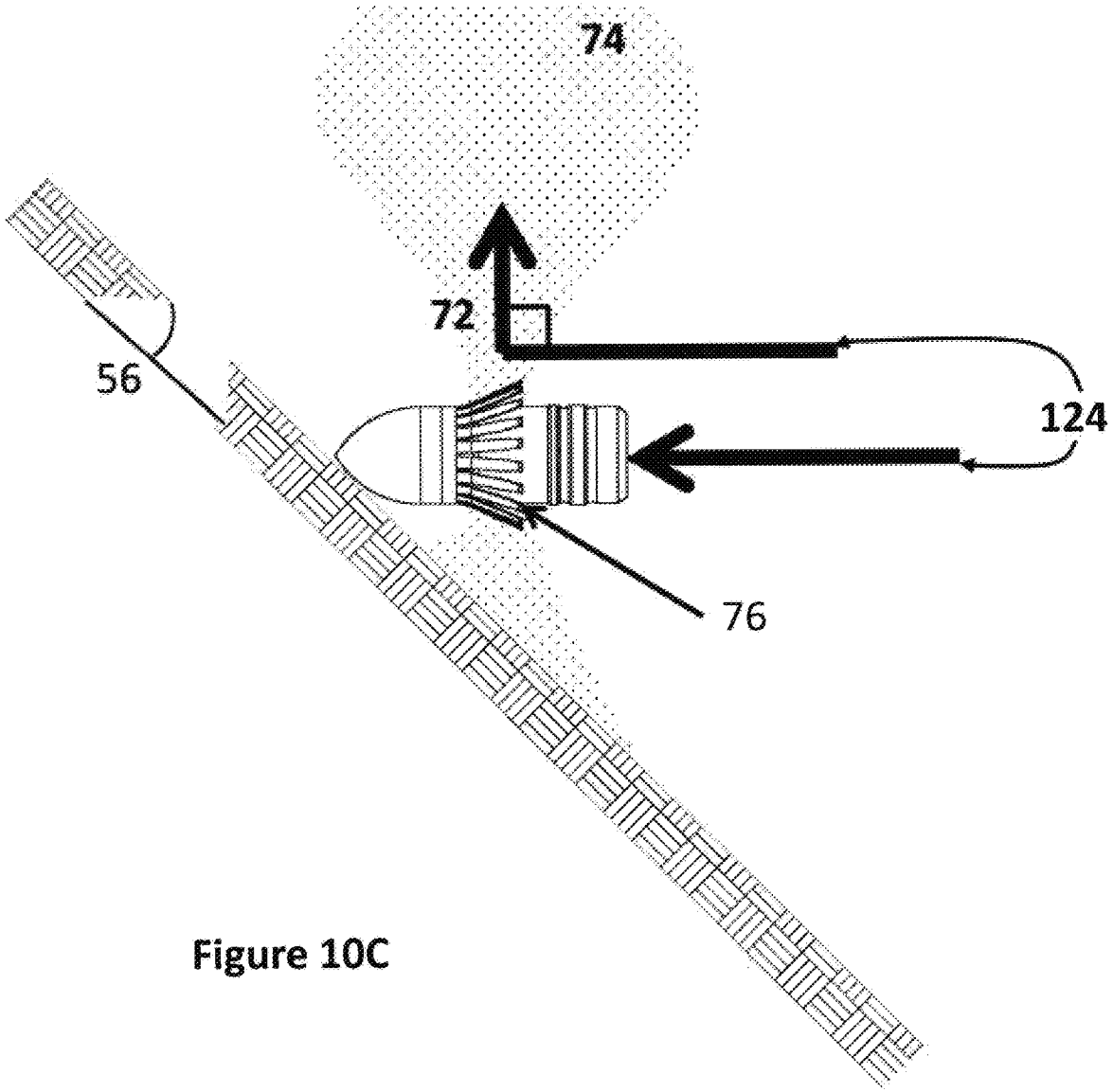

FIG. 10C depict a 105 mm projectile's translational (Linear) Momentum and Inertia Vector (124), milliseconds after impact on an upright angular surface, with an impact angle (56) marking material ejected perpendicular to the translational (Linear) moment and inertia vector (72), decelerating in the atmosphere becoming momentarily suspended in the atmosphere (74).

Figure 10D:
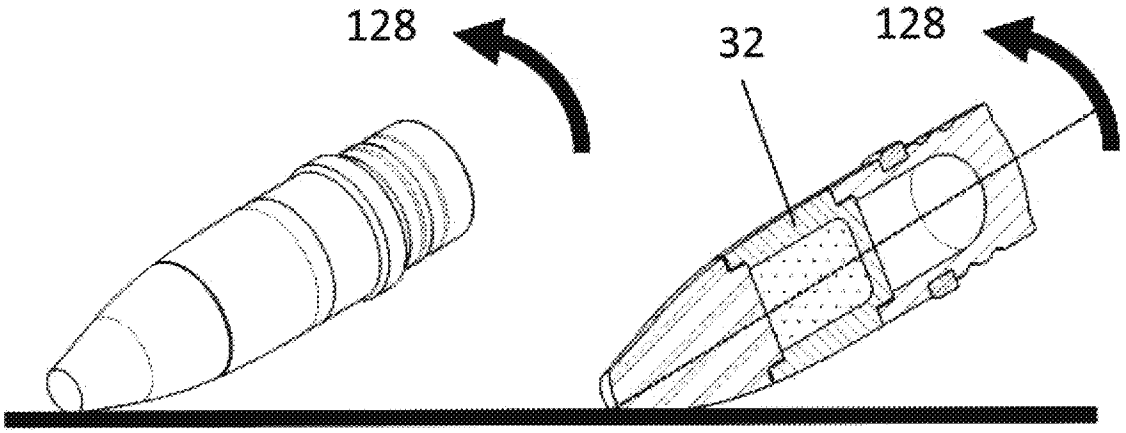

FIG. 10D depicts the body fracture (70) caused when the forward momentum (124) and impact shear force (130) produced by the impact on a surface (58).

Figure 10E:
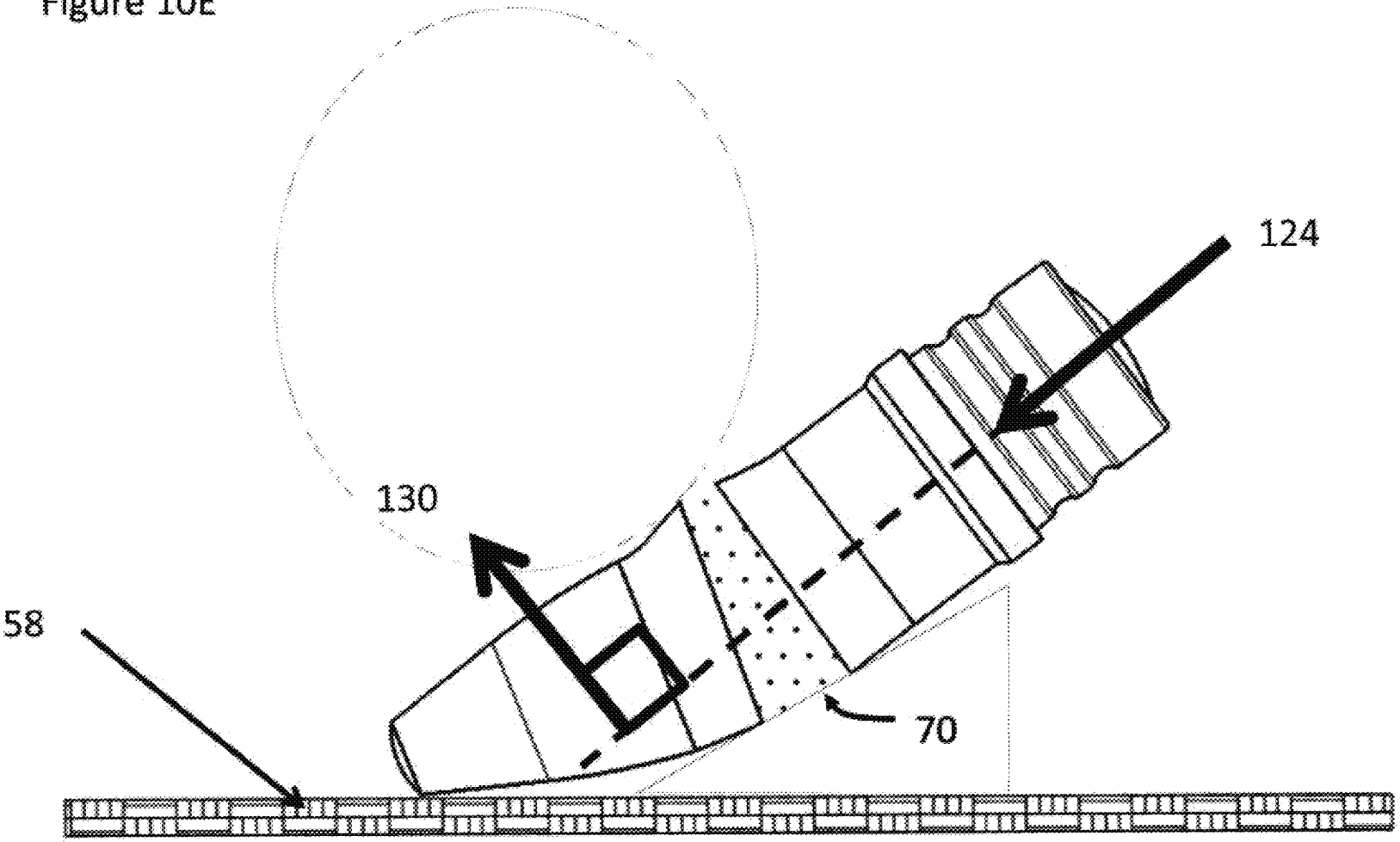
Figure 10F:
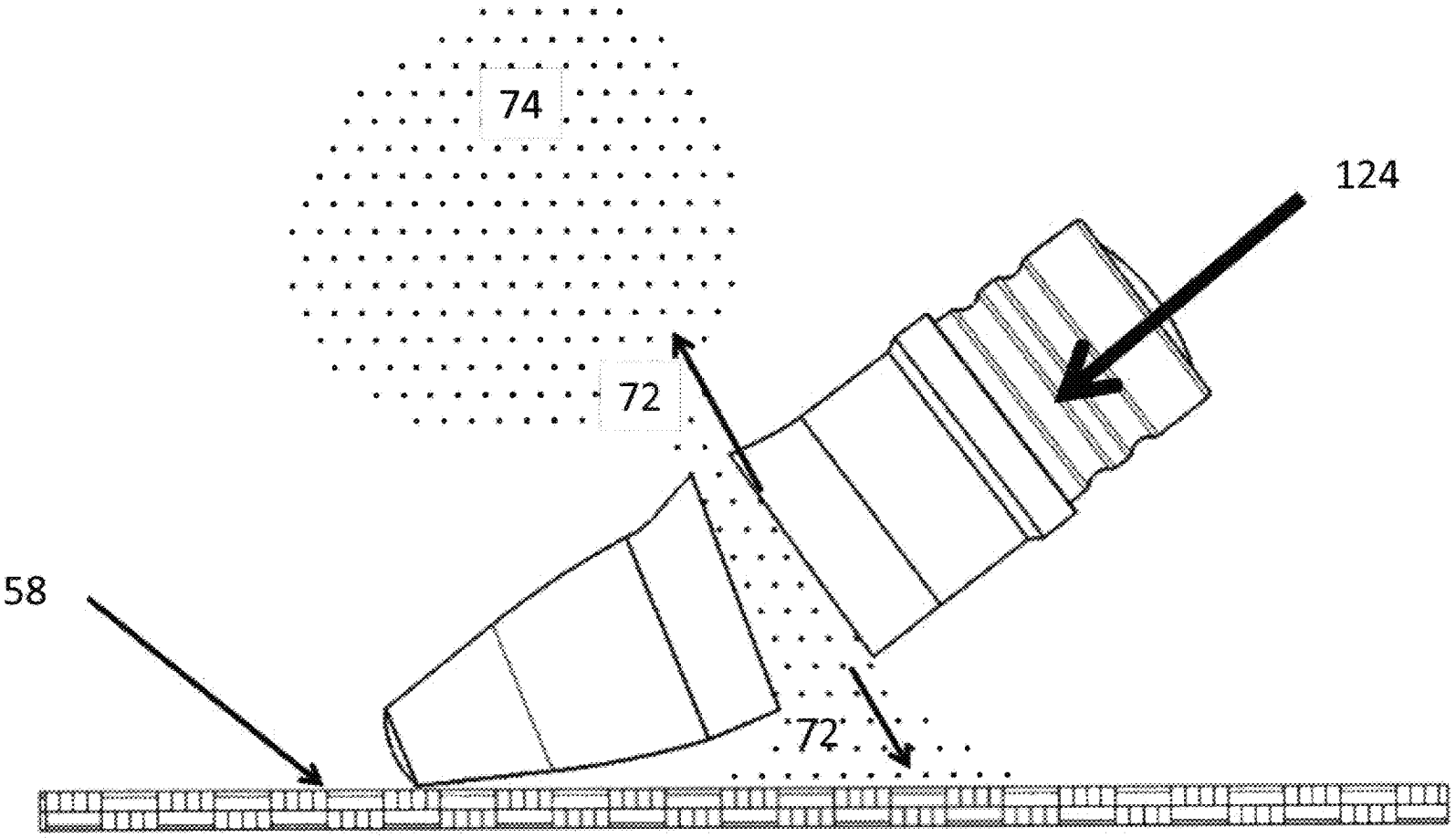

FIG. 10E depicts a 30 mm projectile, at the moment of impact, where rotational inertia (128A) of the base (40), is different than the marking body (30) rotational inertia (128B) and the nose cap's rotational inertia (128C). In combination, the differing inertias at impact, impart torsional loads that tear the mid body marker apart with a twisting action, the broken body wall, with residual rotation, releasing and ejecting marking material (72) into the atmosphere. At the moment of impact, the friction between the surface (58) and the projectile's nose (132) coupled with the residual inertia in each of the projectile's three components (10,20,30) produce torsional loads about the residual axis of rotation (134A,B,C), which, in combination with impact related compression and tension, act to fracture (70) the wall of the marking body (30).

Impact, Frangible Body Break Up and Release of a marking Signature: With continued reference to FIGS. 10A-10E, when a projectile impacts on the ground or on a target, the impact angle (56) and surface angle (58) geometry coupled with the translational (linear) momentum (124) of the projectile base's mass (40) induce a rotational momentum and inertias (128) and at impact shear forces (130) may also act to induce wall compression (66) and wall tension (68). The forgoing four forces (124, 128 and, 130) act in combination to fracture (70) the mid body' wall. Further compression and residual rotation forces acting further to eject the marking material (72) such that the low-density marking powder, preferably incorporating a high contrasting pigment or dye is released into the atmosphere, air-resistance rapidly de-accelerating becoming momentarily suspended (74) in the vicinity of the impact point.

Figure 11A:
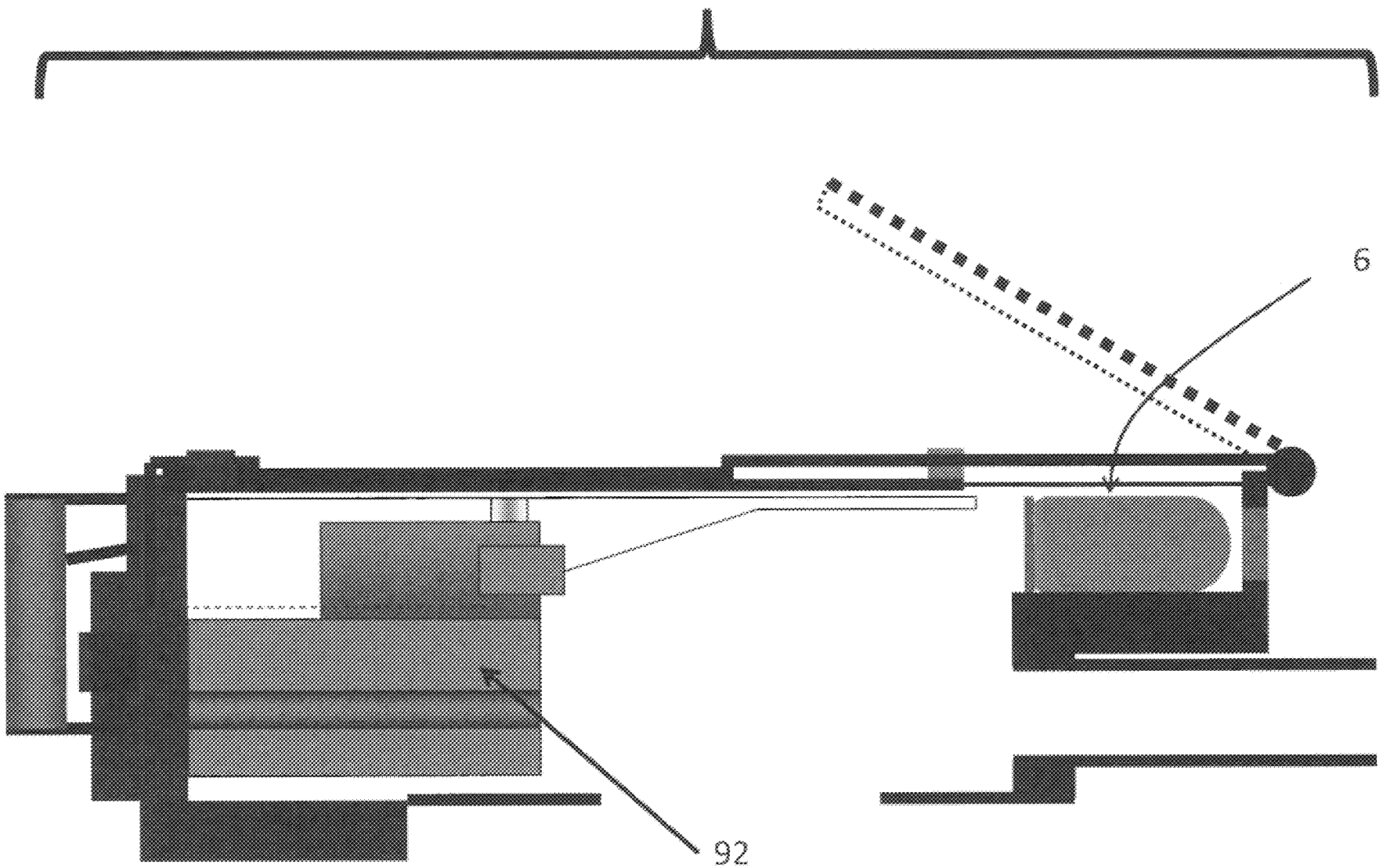
Figure 11B:
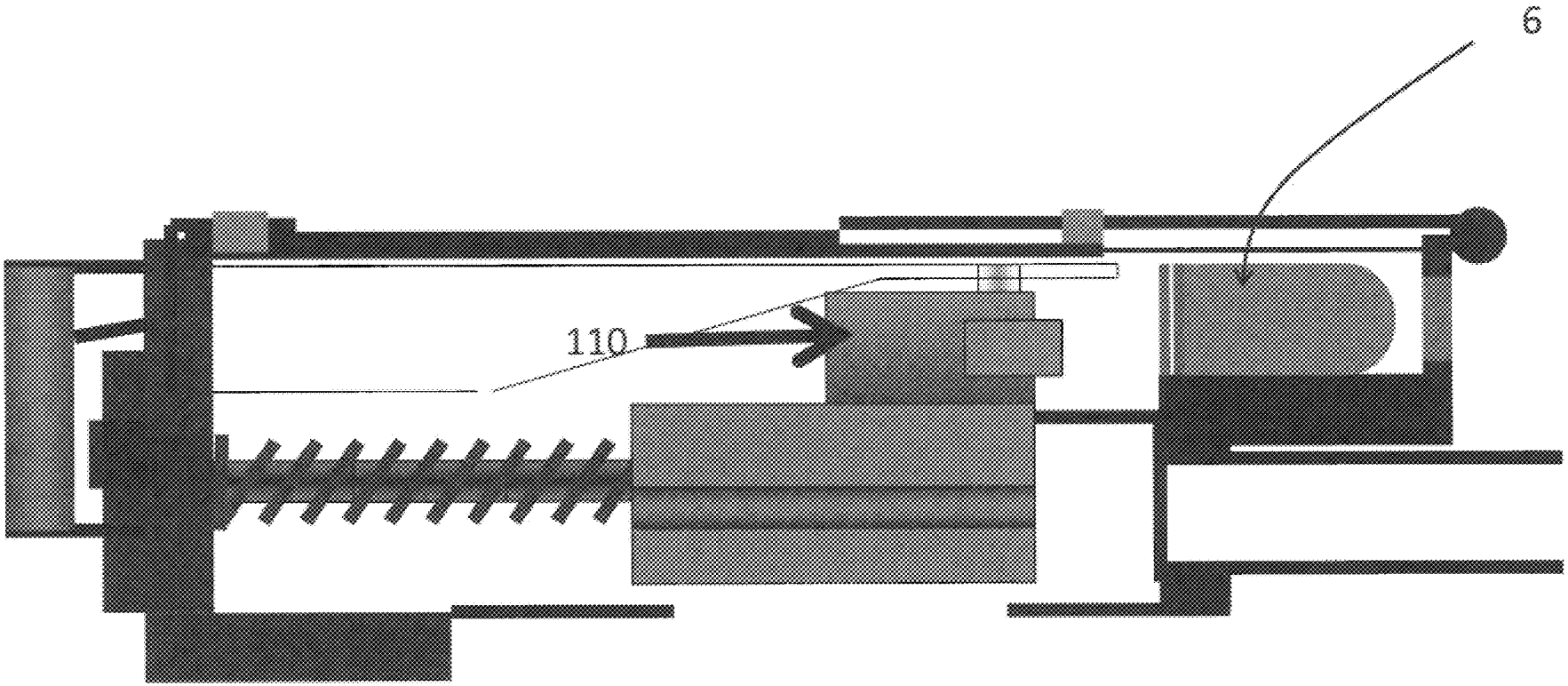
Figure 11C:
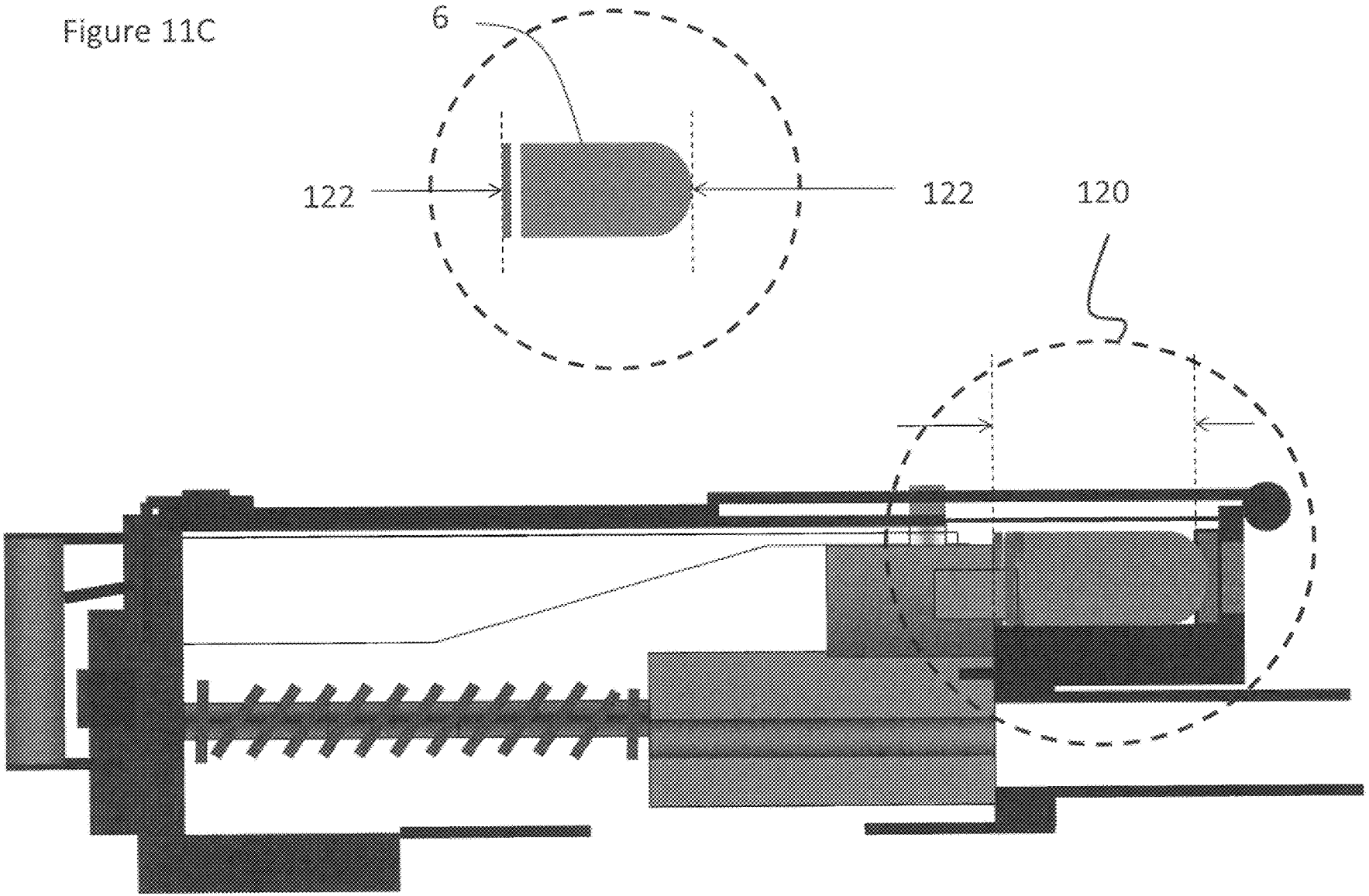
Figure 11D:
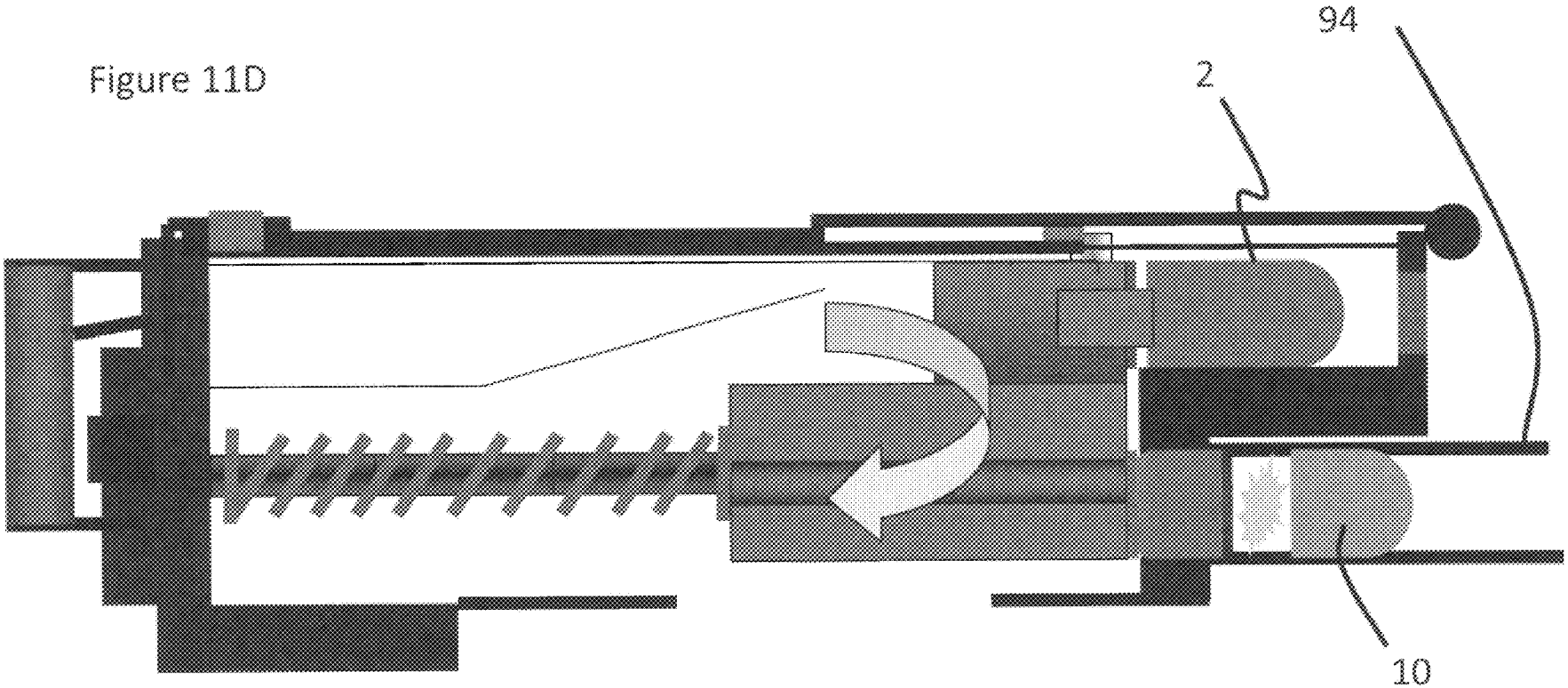
Figure 11E:
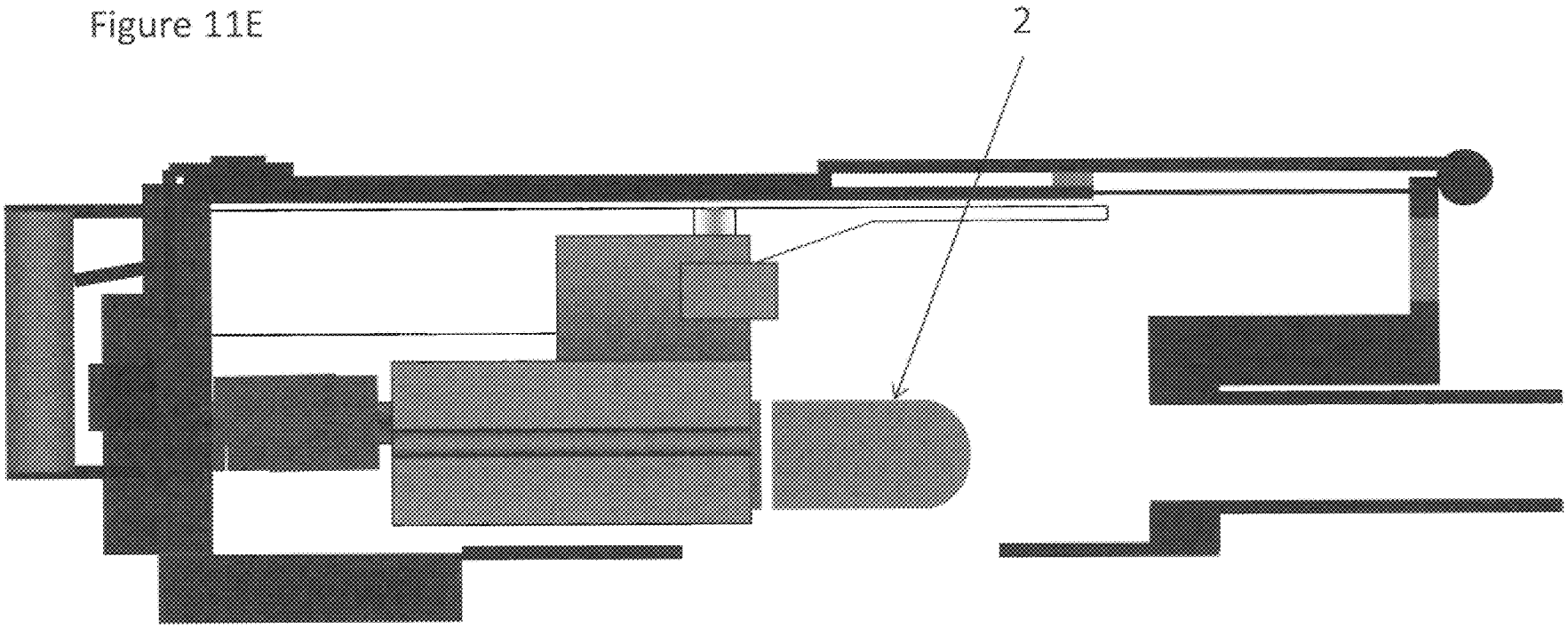
Figure 11F:
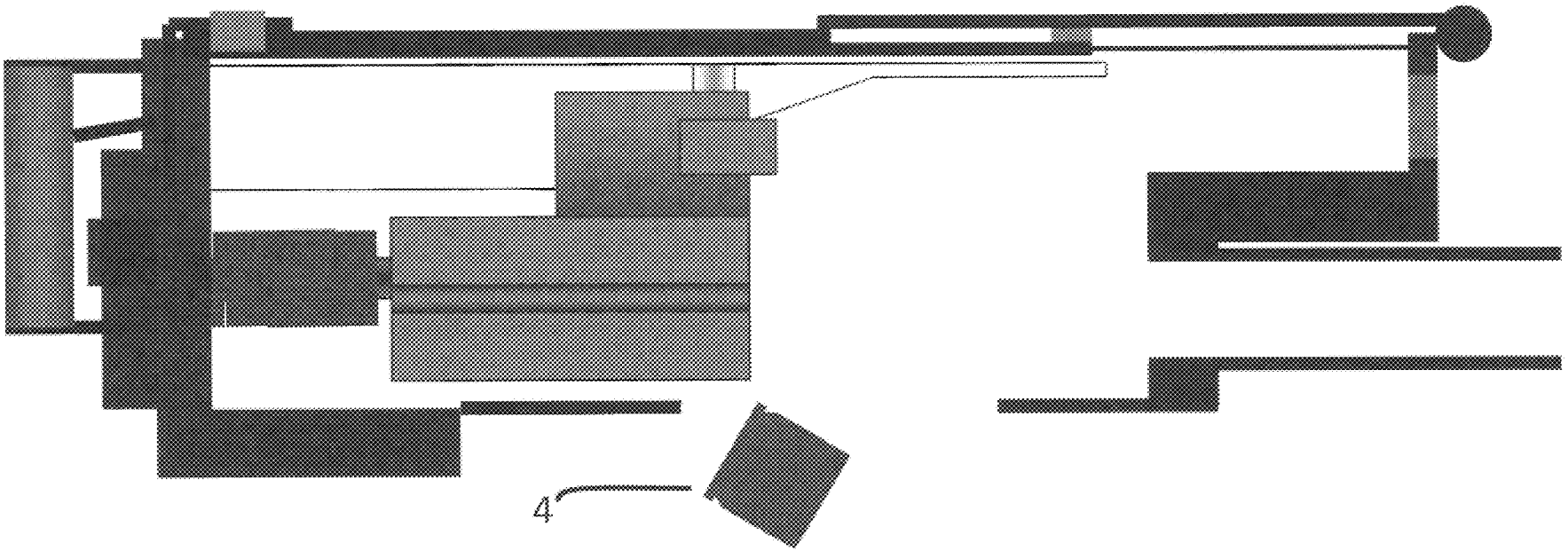

Weapon Feeding and Cartridge Modes of Use: FIG. 11A-F illustrate modes of function fire for a 40 mm cartridge function fired from a MK19 weapon system. FIG. 11A depict the feeding cycle of an open bolt MK19 40 mm AGL. When a liked cartridge (6) loaded into a weapon, a weapon's feeding system, that normally includes a bolt (92) and a barrel (94). As depicted in FIG. 11B, the bolt is released, and a compressed spring releases the bolt (110) forward to the closed bolt position depicted in FIG. 11C. In this position, the linked cartridge (6) is in a compressed position (120, 122). The bolt's extractors de-link the cartridge chambering and functioning the cartridge, firing the projectile (1) thru the barrel (94). The process of "feeding" a weapon may include extraction of the cartridge (2) from the linked ammunition belt (6). The process of feeding induces compression (120) and tension (112) requiring the entire cartridge remains intact prior to function fire. At function fire the projectile (10), at cartridge ignition, moves through the barrel (94), and the lands and grooves in the barrel (not depicted) engrave the projectile's driving band (42) inducing rotation of the projectile (10), said projectile (10) remaining assembled acting as a unitary body, with the base (40) inducing rotation on the frangible marking body (30), which in turn, induces spin on the nose (20).

Figure 12:
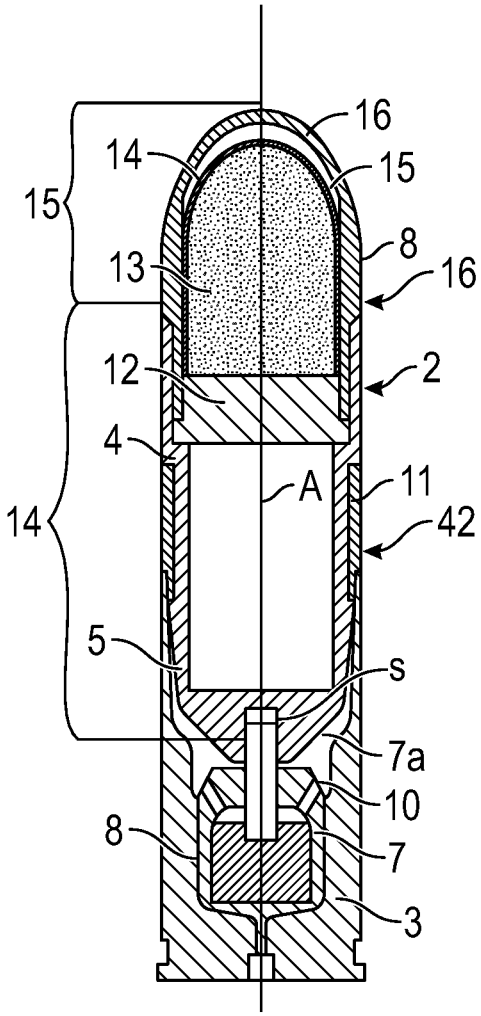
(Prior Art) FIG. 12
Figure 12:
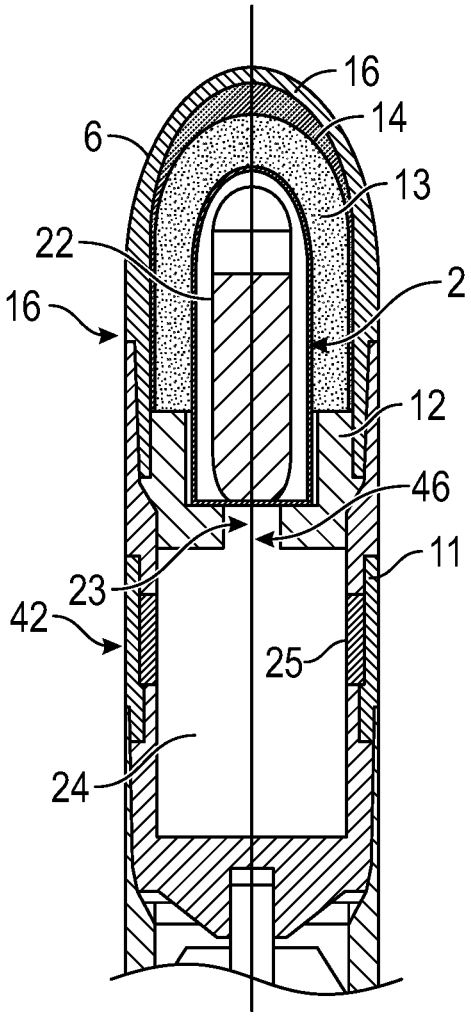
(Prior Art) FIG. 12

FIG. 12 depicts annotated drawings from U.S. Pat. No. 8,065,962 to Haeselich, showing a projectile with a frangible nose cap (15), and a monolithic projectile body with a forward bore riding feature (16) and a driving band (42) incorporated into the same projectile body. The frangible liquid payload (18) is located forward of the projectile's center of gravity (46).

Figure 13A:
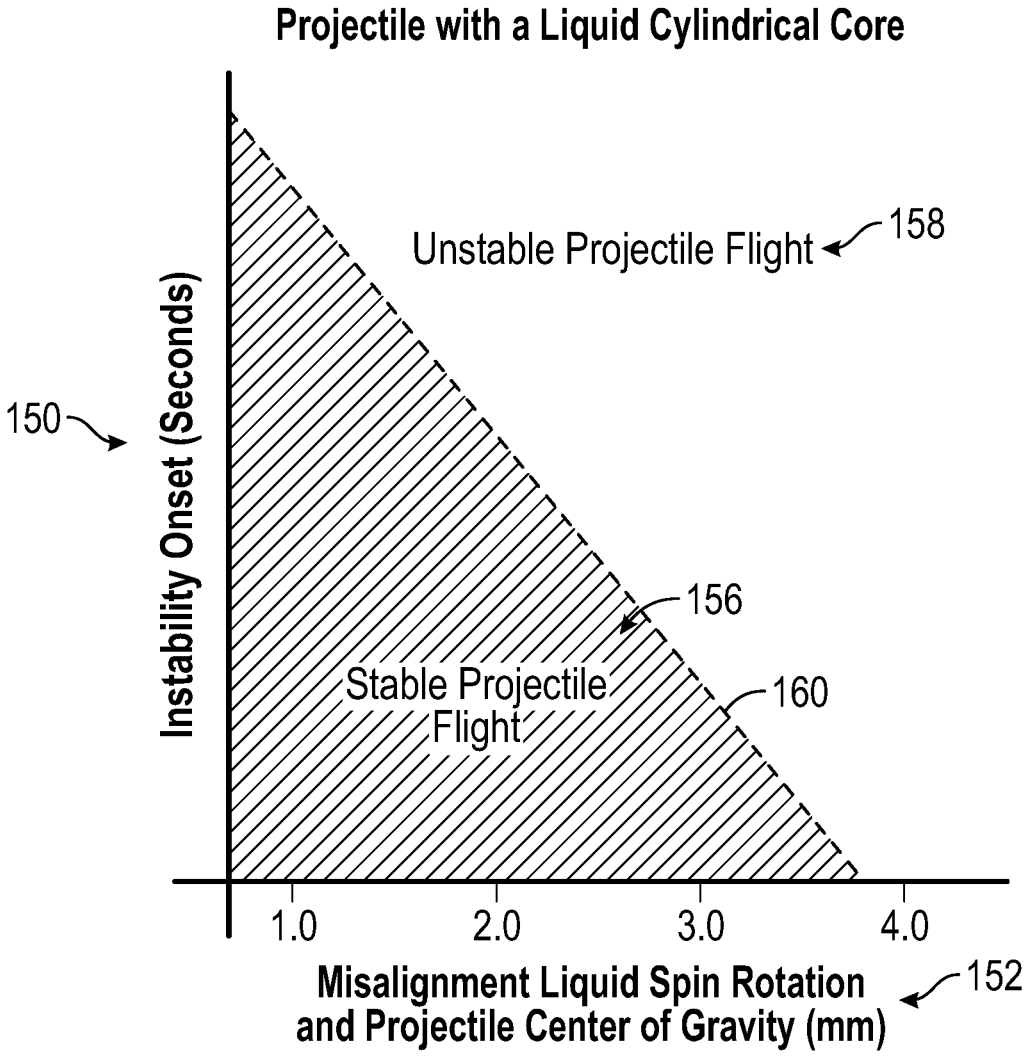
Figure 13B:
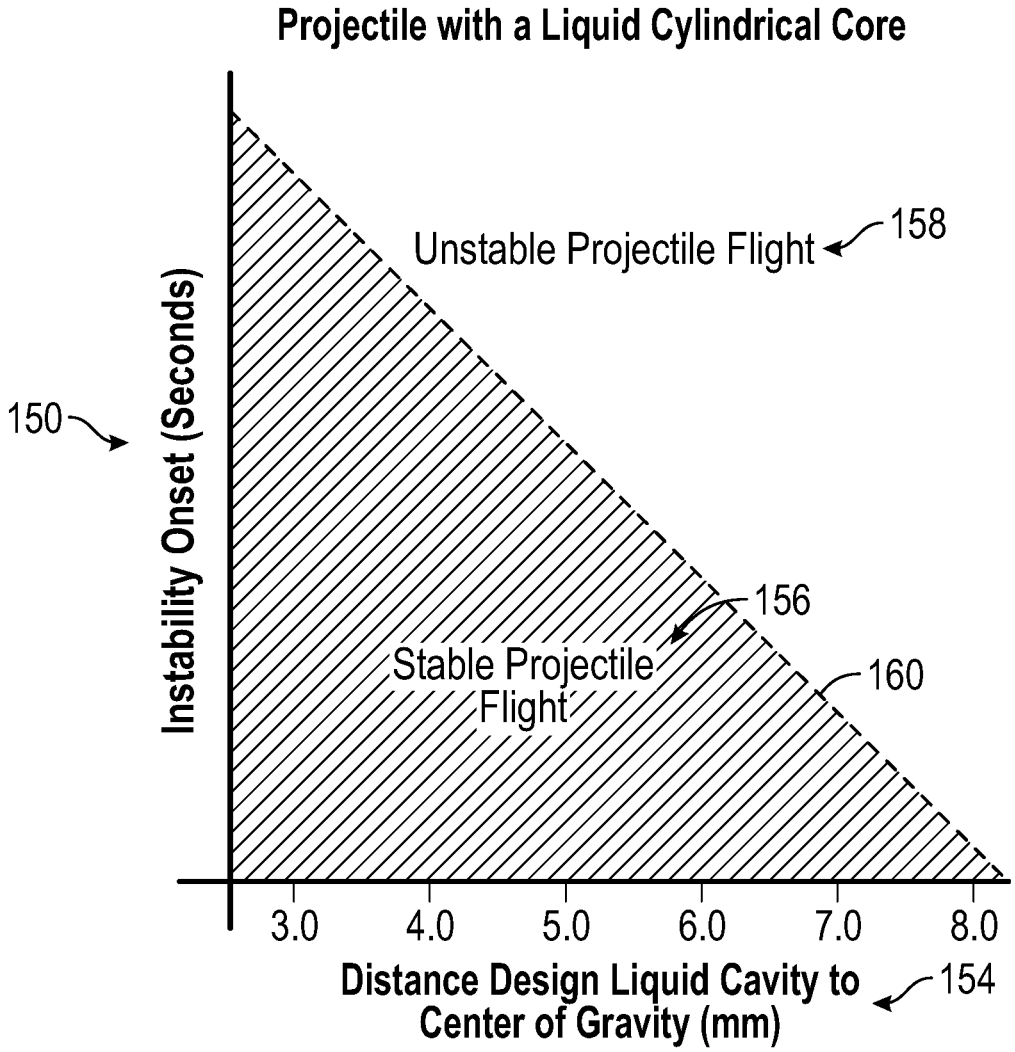
Figure 14A:
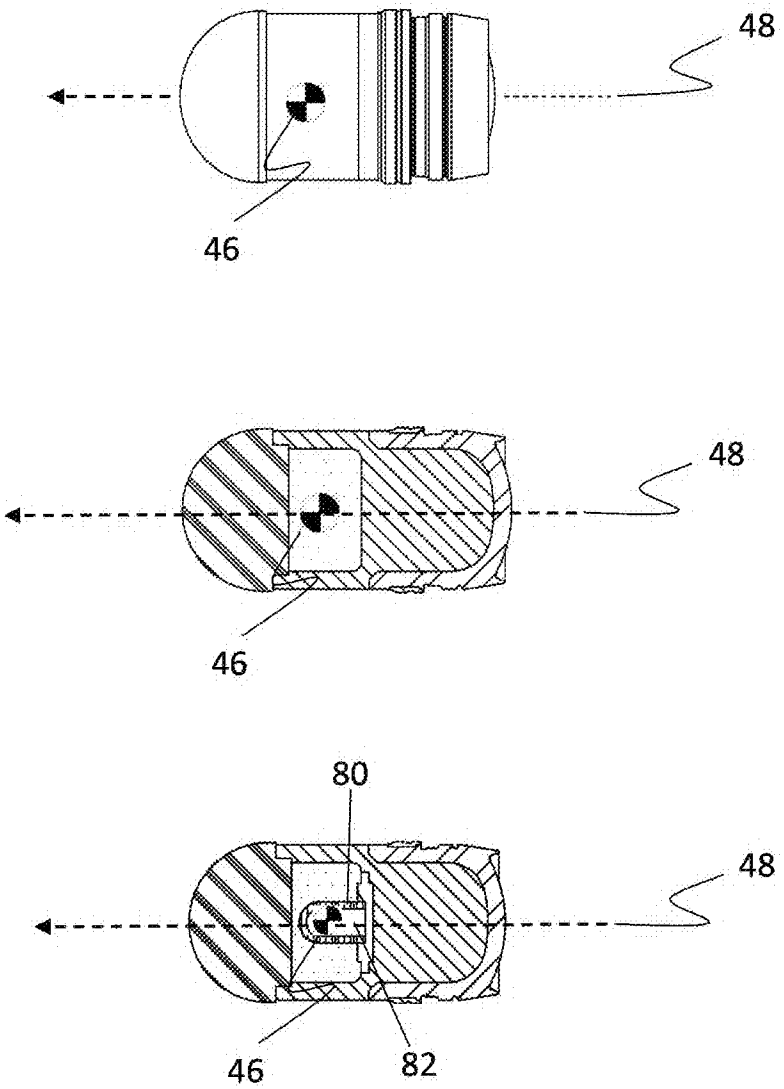

With reference to FIG. 14A, FIG. 13A sets forth the measurable effects where misaligned liquid rotation (152) about the projectile's center of gravity causes a measurable instability in flight (150), the relationship identifying conditions for stable (156) and unstable projectile flight (158). Similarly, FIG. 13B sets forth the measurable effects related to the distance (154) between the liquid cavity (80) and the projectile's center of gravity (46). The measurable relationship strongly correlates to the time a projectile exhibits observable instability (150).

Figure 14B:
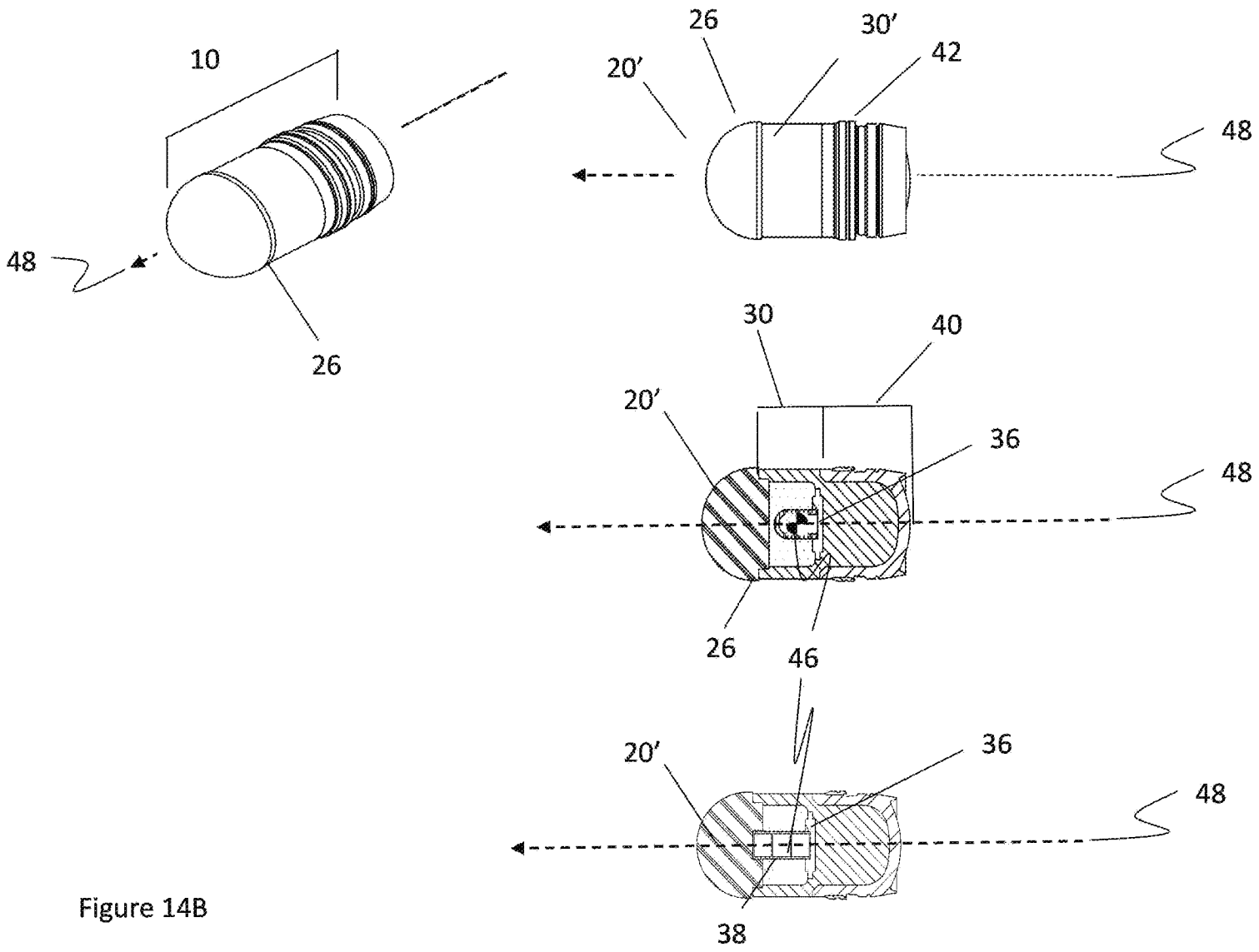
Figure 14C:
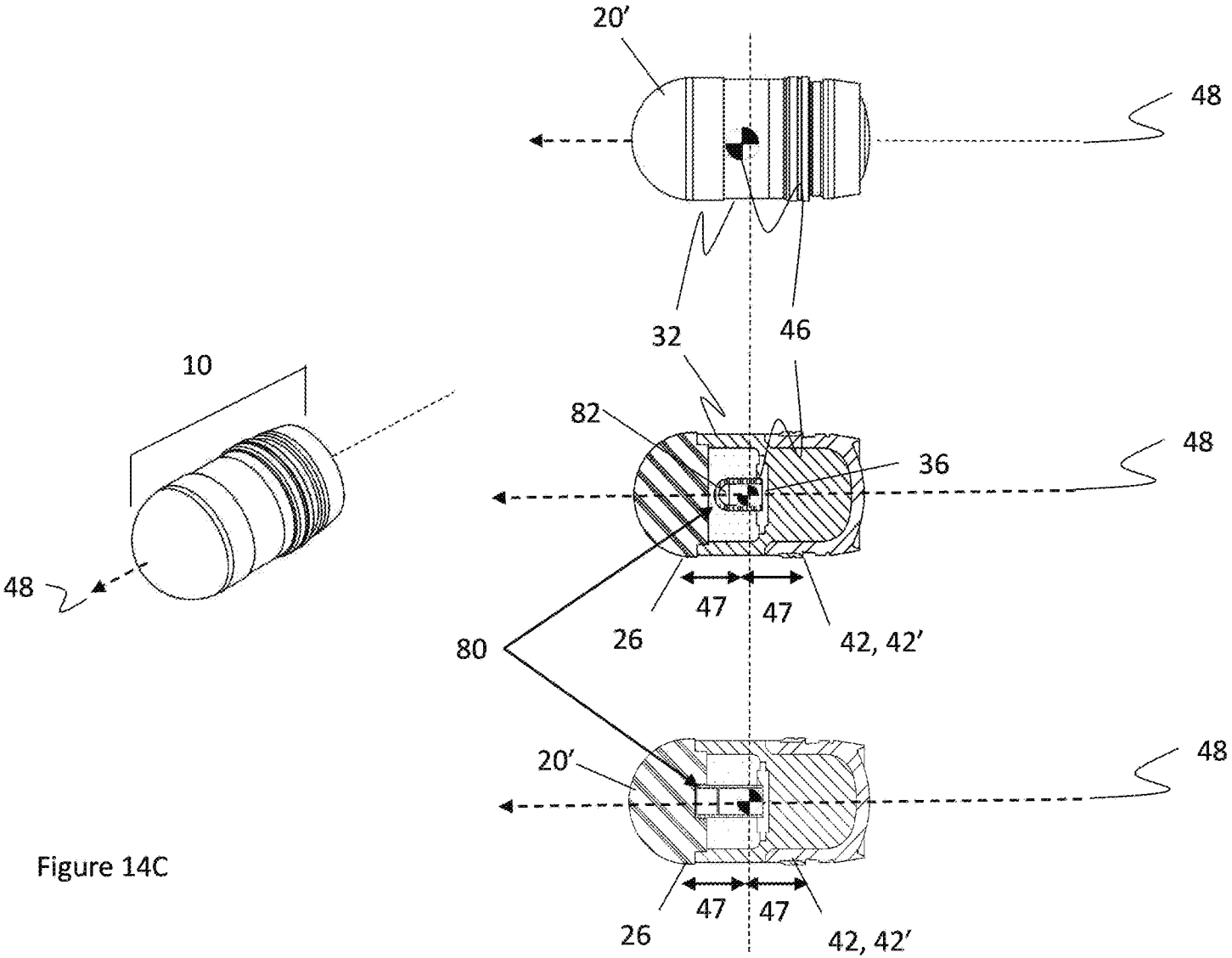
Figure 15:
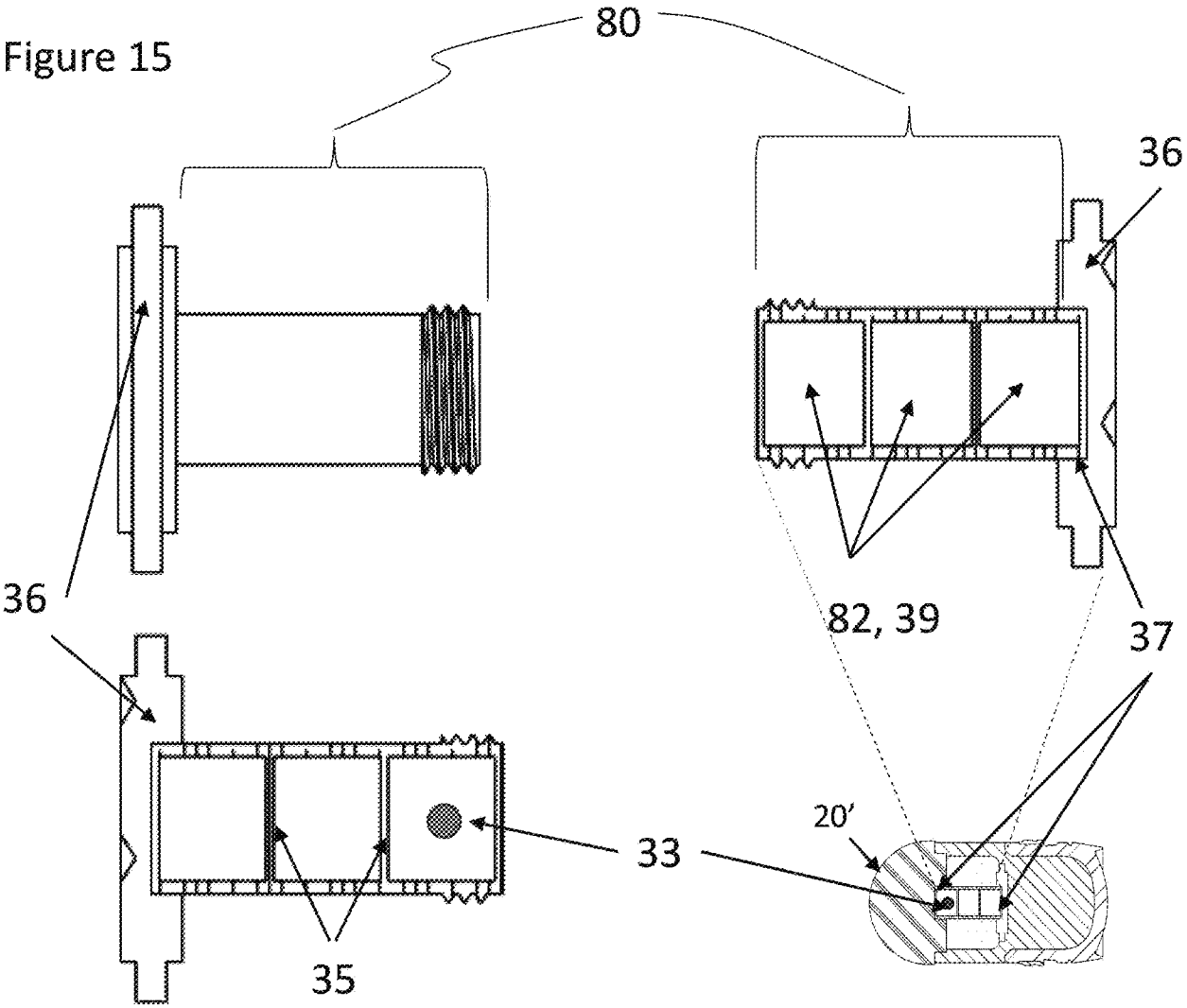

FIG. 14A depicts the projectile's center of gravity (46) aligned with the projectile's axis of rotation (48). It also depicts the alignment of the liquid payload capsule (80) and liquid payload (82) proximate to the center of gravity (46). FIG. 14B depicts a projectile (10') that has a forward bore riding feature (26) to provide good rotational alignment of the projectile's rotational axis (48), to align with the centerline of the barrel (95). The projectile (10') consists of a forward nose cap (e.g., ogive) (20'), a mid-body (30'), and a projectile base (40'). The forward nose cap (20') is configured to incorporate the forward bore riding feature (26) and may be formed of a ductile material such as metal (e.g., aluminum, brass, copper, etc.). With reference to FIGS. 14B, 14C and 15, the liquid capsule (80) may be affixed to a base (36) or alternatively may be affixed to the ogive (20') by either being either crimped or otherwise connect with a retaining feature (37) to either or both components (36,20'). The metal plate (36) or ogive (20'), at impact, imparts a shearing and twisting action on the capsule (80) housing containing the liquid, the forces in combination acting to break the capsule, releasing the liquid payload (not depicted).

FIG. 14C depicts the liquid payload capsule (80) that is fabricated from a frangible polymer and physically connected to a metal base (36), or alternative connected to the ogive (20') the metal base, the connections imparting a torque and shear action (not depicted) on the frangible cylindrical container (38) at impact. The projectile's center of gravity (46) aft-to-nose is positioned approximately equidistant (47) between the forward bore riding feature (26) and the aft driving band (42,42').

FIG. 15 depicts the capsule (80) housing one or more liquid marking payloads may include solid and/or liquid payloads (82) in compartments (39). Where more than one liquid is utilized, the capsule (80) may have barriers segregating the different liquids (82). The forward capsule may house a solid mass (33). At set-back the solid mass perforates the capsule's inner compartment walls (35), allowing the different chemicals in the department to mix during spin up and in initial flight. The chemical mixing in the capsule (80) is initiated as the projectile undergoes spin-up in the barrel and continues as the projectile is in external ballistic flight, the reacting chemicals producing a chemiluminescent, optically emissive liquid payload or a thermally heated liquid payload, the reaction emitting light or heat in certain spectrum (visual, IR, thermal).

Figure 16A:
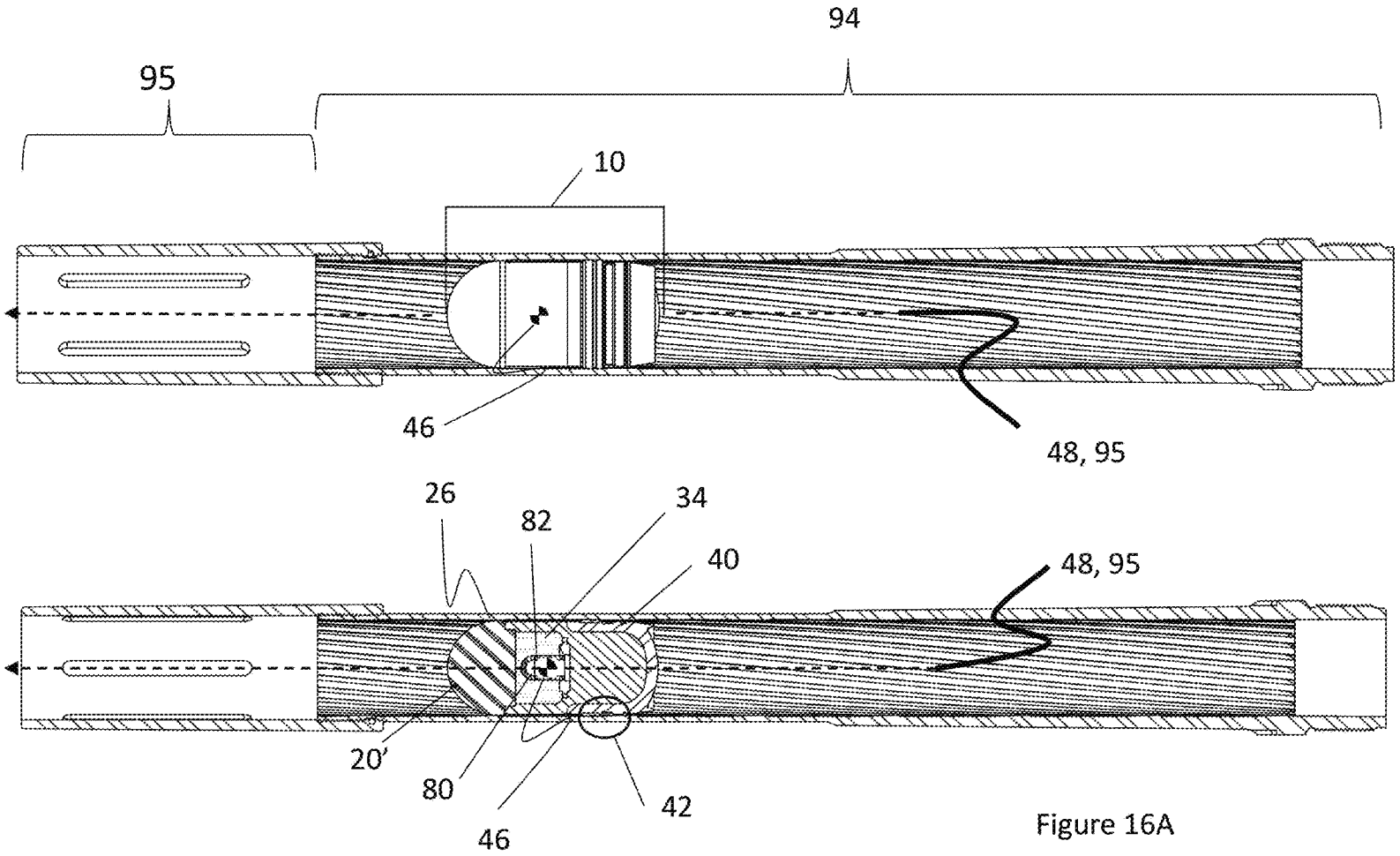
Figure 16B:
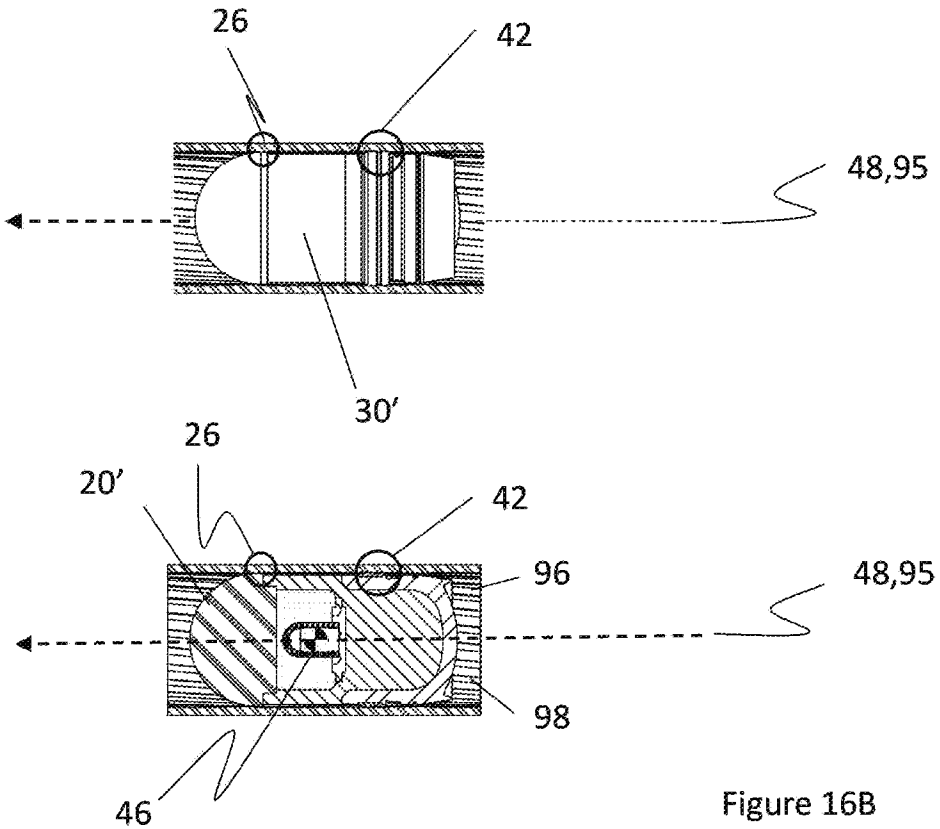
Figure 16C:
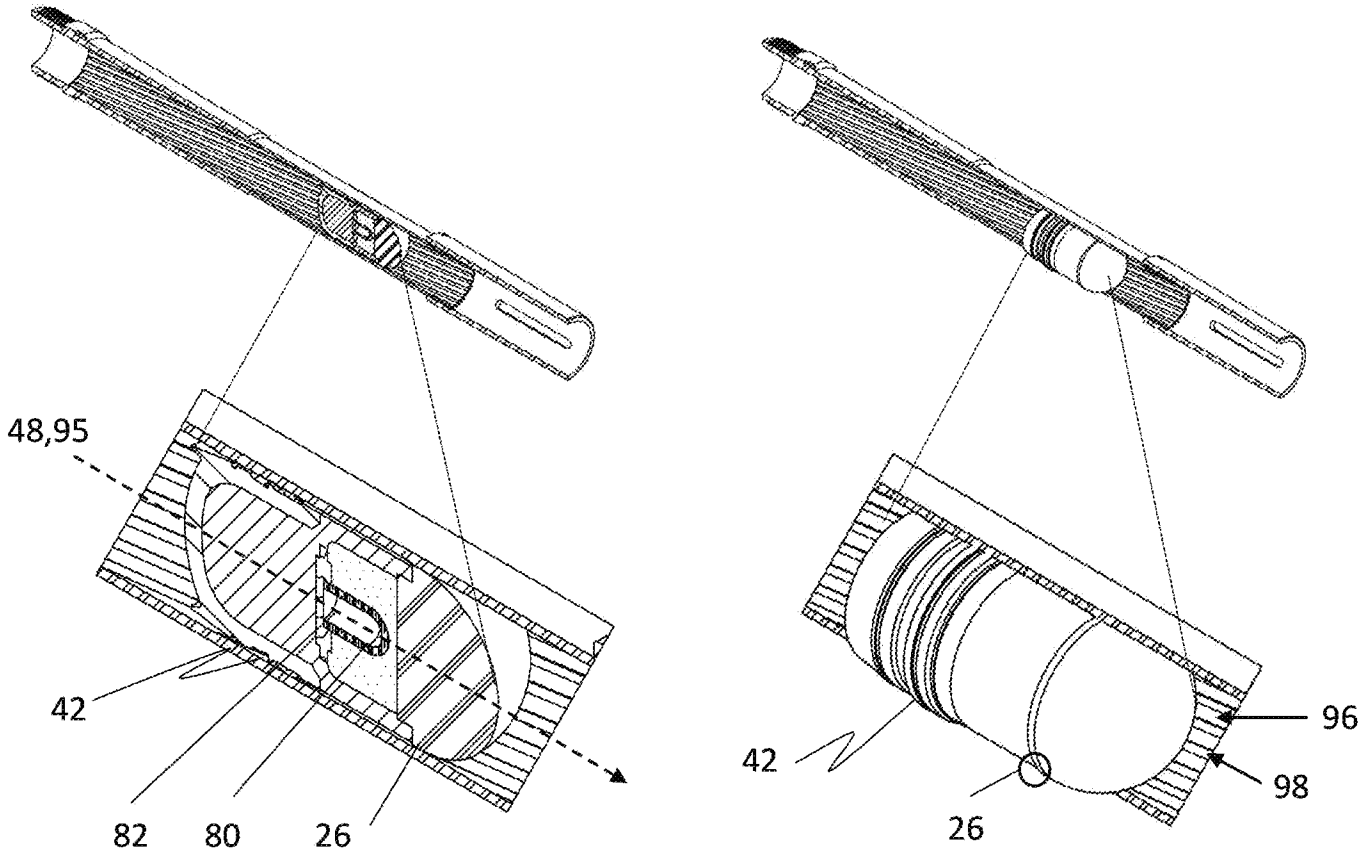

FIG. 16A-16C depicts a projectile (10') that features two bore riding features, the forward bore riding feature (26) incorporated in the ogive (20') and a driving band (42') incorporated in the projectile base (40'). The projectile (10') is further comprised of a frangible capsule (80) configured within in the projectile's mid body (30') the capsule (80) in the stored configuration houses one or more liquid payloads (82). The liquid payloads (82) in the cylindrical container (38) are aligned proximate to the center with the projectile's (10') center of gravity/mass (46). When the cartridge (2) fires (not depicted), the projectile (10'), the projectile undergoes "set-back" traversing the length of the barrel (94), and the bore riding features (26, 42') on the projectile (10') engage the barrel lands (96) and grooves (98) on the inner diameter of the barrel, the barrel transit, engaging and engraving the driving band (42') and forward bore riding feature (26). The projectile's engagement of barrels twisted lands (96) and groves (98) on the barrel's (94) inner diameter impart rotational force on the projectile (10'), the spinning projectile (10') exiting the barrel (not depicted) on a ballistic flight trajectory (50'), the liquid payload (82) in the cylindrical capsules (80) having laminar flow of mixing chemicals inside the rotating capsule (not depicted). The capsule configuration is fabricated to allow for mixing of one or chemicals, the mixing occurring at set-back or at impact. The projectile's (10') forward bore ridding feature (26) and driving band (42,42') equidistant from the projectile's (10') center of gravity (46), such geometry minimizing induced yaw and pitch at barrel exit (not depicted). The capsule (80) housing a liquid chemical marking payload (82) is located in the projectile's mid body (30, 30'), precisely alignment with the projectile's center of rotation (48) and in close proximity to the projectile's center of gravity (46), such that liquid (82) in the rotating projectile (10') encounters minimal destabilizing perturbations, with the liquid marking payload material (82) housed in the frangible mid-body (30') of the projectile (10') exhibits laminar flow (not depicted) about the projectile's axis of rotation (48) as the projectile (10') is in ballistic flight (50').

Figure 17A:
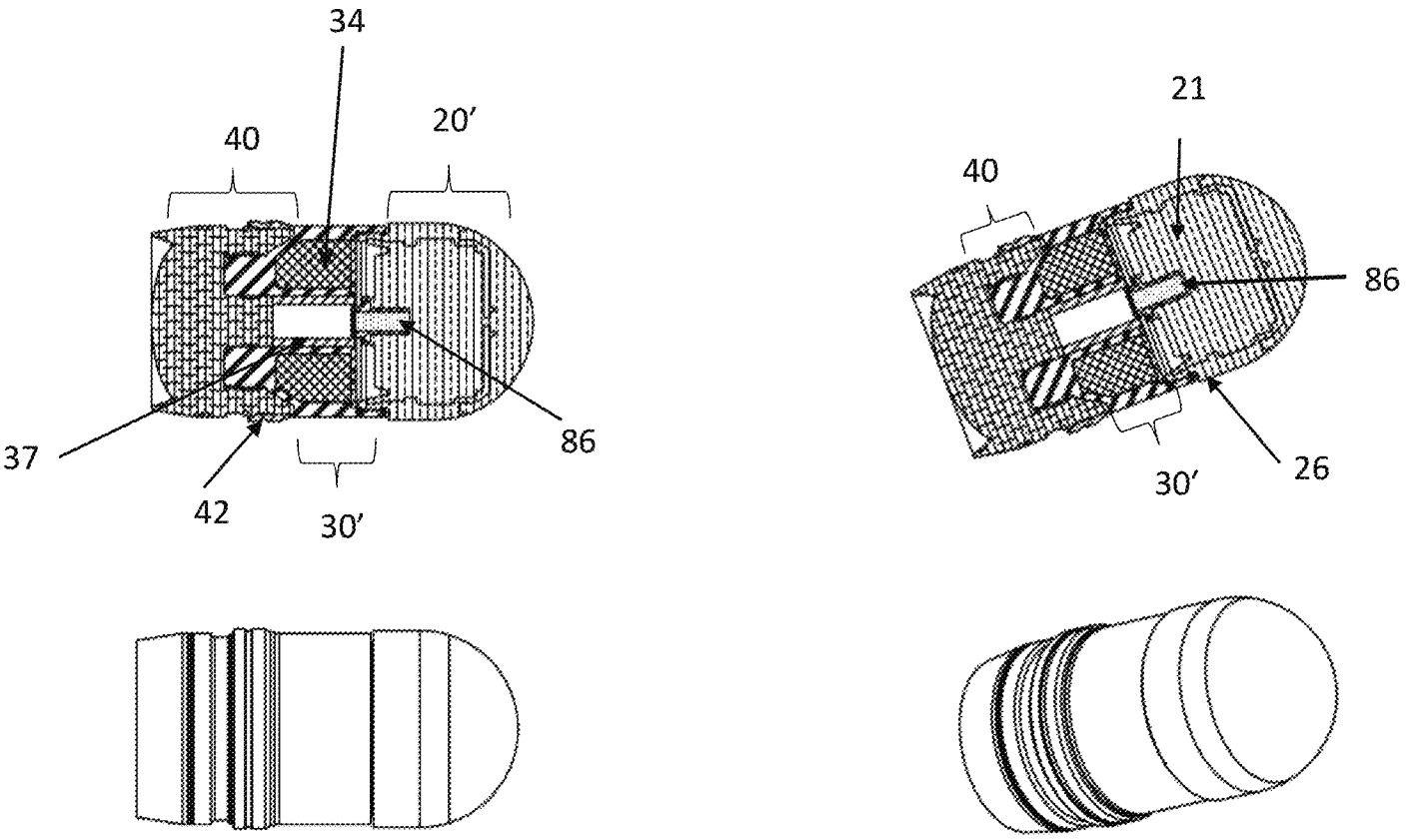
Figure 17C:
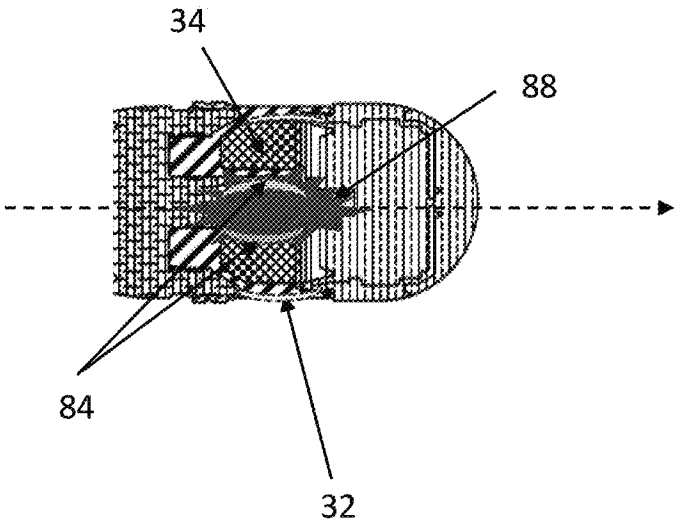

FIG. 17A-17C disclose an alternative embodiment where the metallic ogive (20') includes a safe and arm device (24) which is a principle component of a fuze (21). This projectile's mid body marking component (30') is configured to break when impacting on a surface (58), or preferably when the fuze (21) initiates the energetic squib (86). Either impact or fuze function may cause the mid-body (30') to eject and release one or more marking payloads (e.g., marking powder 34, ejected atomized chemiluminescent droplets 76, and heat low-density metal powder 78). When the fuze (21) ignites an energetic squib, igniter or a detonator (86) in proximity to the mid-body (30, 30') the ignition (88) pulverizes and heats the frangible cylinder material in the internal cavity (31) of the mid-body (30'). The frangible cylinder material then atomizes and flows under pressure, pushing on the lower density marking powder (34). The overpressure within the mid-body (30') breaches the outer wall (32) of the frangible mid-body (30'). As a consequence of the pressurization, gas ejects the low-density marker (72, 72') and heated, denser pulverized material (78), ejecting the materials (72, 72' and 78) perpendicular to the axis of rotation (48). The ejected materials quickly deaccelerate and become momentarily suspended in the atmosphere (136) for a few seconds, depending on conditions. As such, the atomized low density materials or droplets (72, 72', 78, 104) are momentarily suspended in the atmosphere (102), emitting or reflecting light in a spectrum that provides for an optical contrasts with the foreground earth (134) and vegetation (104) and ambient atmosphere (136).

Therefore, the embodiments of the projectile (10') in accordance with the present disclosure differs from prior art, FIG. 12 depicts the prior art with a modest liquid payload within a frangible ogive, located forward of the projectile's center of gravity and with a bore rider and driving band incorporated into a monolithic projectile body. The embodiments of FIG. 13A depict the relationship between instability, alignment of the projectiles center of gravity and a liquid payload. Further, FIG. 13B further depicts how the location (aft or forward) of the liquid cavity relates to projectile stability. FIGS. 14A-D, 15 and FIGS. 16A-D depict a projectile (10') with a center of gravity/mass (46) aligned with the axis of rotation (48) with the cylindrical capsule (80) containing liquid marking payload (82) centered approximately equidistant (47) between the forward bore riding feature 26 and the driving band (42,42'). Such equidistant relationship positions the cylindrical liquid payload such that at spin-up, in the barrel (94) the centerline of the barrel (95) aligns precisely with the projectile's axis of rotation (48), the precise alignment minimizing projectile balloting (not depicted) in the barrel, such that the encapsulated liquid (82) at spin-up, realizes laminar flow about the axis of rotation (48), the controlled component relationships and geometry within the projectile (10') minimizing disruptive perturbations that induce yaw and pitch at barrel exit (not depicted).

FIG. 15 depicts the cylindrical capsule (80) with an attachment interface (37) to a metal disk or the forward ogive (20'), with the cylindrical capsule (8) having barriers (35) forming containers, or ampoules (39) housing one or more liquids (82). The container (39) forward to the projectile nose, may have a mass (33) suspended in a liquid (82). The mass (33) at set-back is forced aft, breaking barriers (35) segregating the liquids (82).

FIGS. 16A-D also depict a projectile (10") with a mid-body (30) having an outer frangible body (32), housing a marking compound (34) and an encapsulated liquid payload (80, 82) positioned perpendicular to the axis of rotation (48) and an adjacent to a plate (36). The marking compound (34) may be marking powder.

Figure 18A:
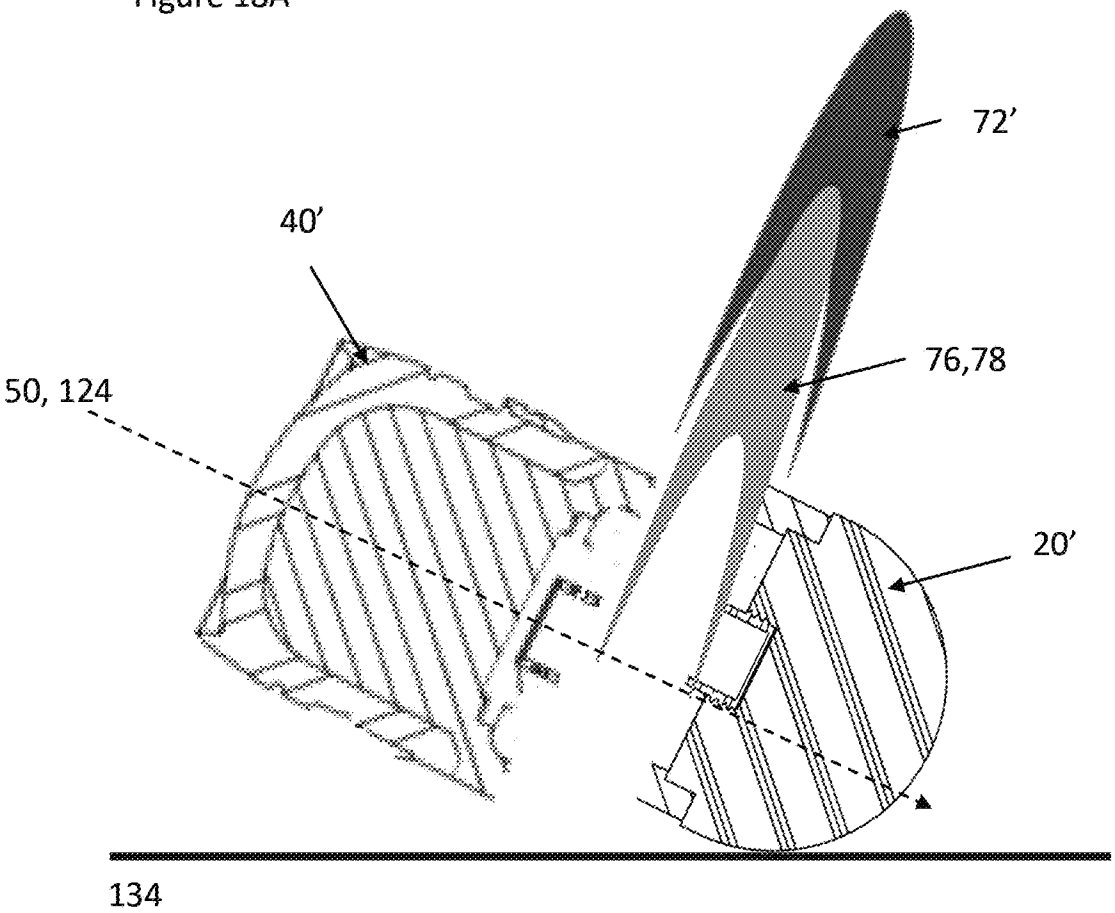

Further, the additional embodiments include details regarding chemical payload and signature emissions, as set forth in FIG. 15 depicting a capsule (80), with segregated compartments (36) housing liquid payloads (82). Liquid payloads may include chemiluminescent compounds that generate chemical reaction. Diphenyl oxalate (Cyalume™) is a solid whose oxidation products when mixed with hydrogen peroxide are responsible for the visible chemiluminescence in a glowstick. Unfortunately, both these chemicals are toxic, and, when used as marker materials in gun-fired ammunition, and the light emission from these mixed chemicals rapidly fall off when exposed to air. While chemiluminescent payloads generate visible light, a wide range of chemical reactions are exothermic. Many exothermic reactions rapidly heat mixed chemicals and when released into the atmosphere, the chemical mix radiates heat emissions in longer wavelength region of the electromagnetic spectrum. Importantly, these emissions are radiated in the wavelengths of 3 to 5 and 8 to 14 micrometer regions. These wavelengths provide for an optimum transmission of heat emissions, in atmospheric windows, allowing for observation by thermal imaging devices. Examples of safe highly exothermic reactions are (1) anhydrous metal salts (e. g. calcium chloride) in combination with water, and (2) sodium sulfite with sodium hypochlorite (bleach). With reference to FIG. 14C, 15, and FIG. 18A the images depicts the projectile (10') at impact on a surface (134), the shear and torsional stresses, coupled with retained momentum of the base fracture the projectile's frangible mid body (30'), causing the collapse of both the mid body frangible wall (32) and frangible container (80) at impact function, the impact causing ejection of both dry powder (34, 72') and release of the reactive liquid payload (76,78) creating a marking plume adjacent to the impact point.

Figure 17C:
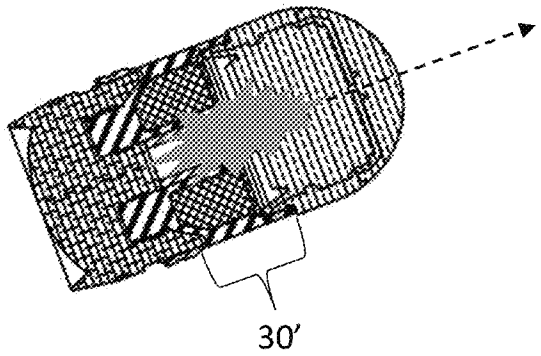
Figure 18B:
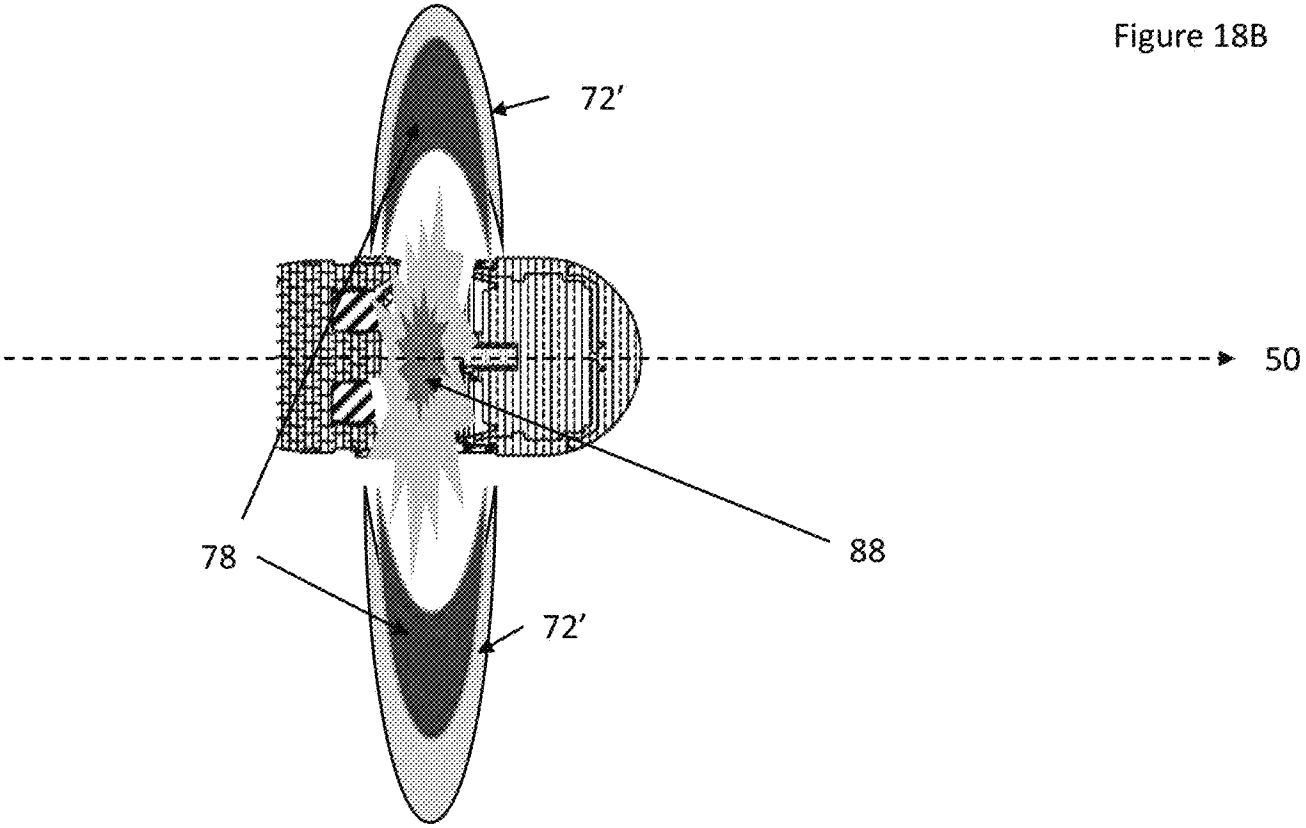
Figure 19:
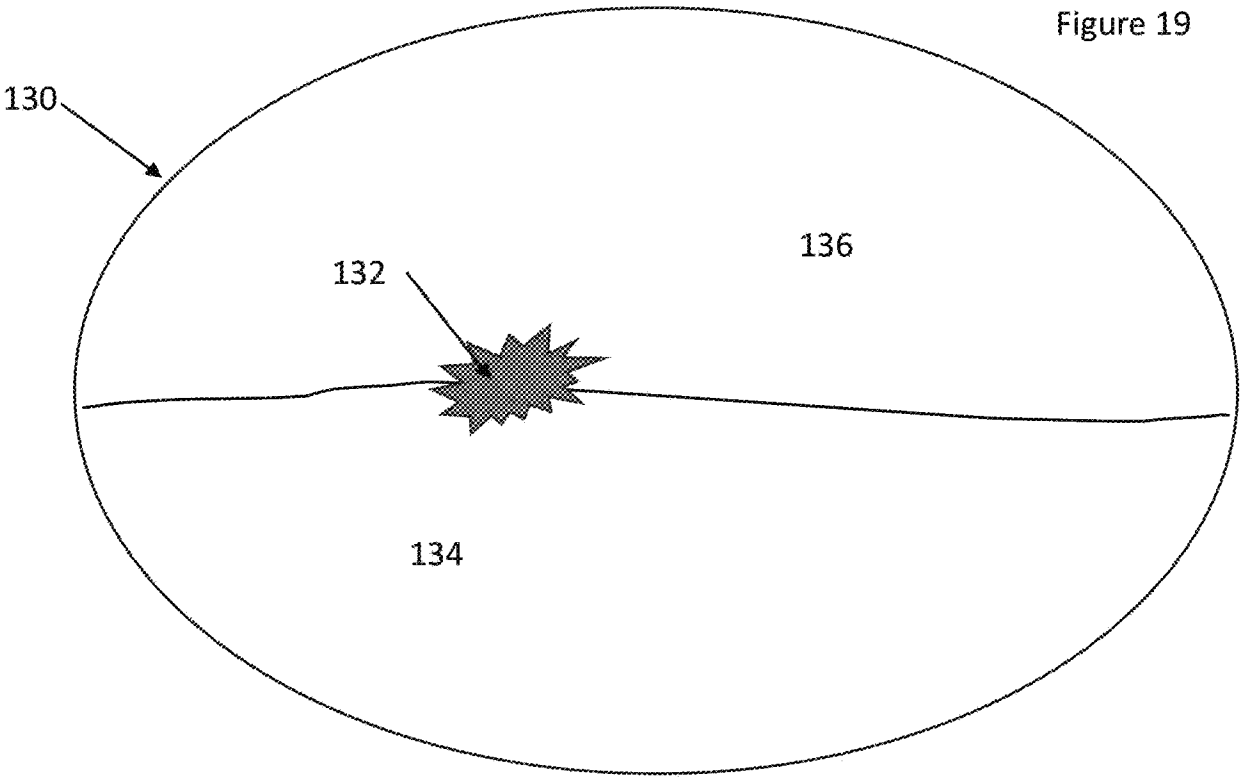

An alternate embodiment of a mid-body marker FIGS. 17A-C depict a projectile (10") with a forward ogive bore rider (26) located forward of the projectile's center of gravity (46), and a driving band (42) aft of the center of gravity (46) within a barrel (94) where the forward ogive bore rider (26) is fabricated from a ductile metal and is configured to be engraved by barrel lands (96) and the barrel grooves (98) at spin-up. The projectile (10') usefully incorporates a safe and arm component (24) housed in a metal ogive (20') that is located forward of a mid-body (30'), the safe and arm precludes initiation of the energetic component after two environments, typically set-back (launch g-force) and spin (centrifugal force) are measured or induced in the safe and arm component. The safe and arm component (24) is adjacent to a forward end of the cylindrical container (38) and is incorporated in the metal ogive (20') and the mid-body (30'). The mid-body (30') includes a cylindrical container (38) containing a liquid marking payload (not shown) and an internal cavity (31). The figures depict an energetic squib, igniter or detonator (86') aligned to the axis of rotation (48) adjacent to a safe and arm device (24). The safe and arm device (24) is positioned proximate to a special frangible cylinder container (84) surrounded by a marking powder (34) housed in the projectile's mid body frangible wall (32). The frangible cylinder (84) is fabricated from a powdered low-density metal, ceramic or silicate, the material adjacent to and when functioning receiving heat from ignition of the igniter (88). The mid body marker (30') configuration allows for break-up on function or impact; however, differing from the impact markers, this embodiment provides for air-burst function (FIG. 18), where pressurization of the mid-body component as depicted in FIG. 17C depicts the frangible side walls (32) bursting at the moment of energetic ignition, the metal cylinder (84) decomposes under pressure and heat, and the decomposed metal powder and dry marking materials (34) housed in the projectile (10') are thus ejected perpendicular to the projectile's flight path (50) as depicted in FIG. 18, the projectile (10') functioning in free flight, before impacting on a hard surface. FIG. 17C depict an action at ignition (88) of an energetic component produces gases that pulverize the frangible component (84) at ignition. At ignition, combustion gases pressurize the frangible cylinder (84) and the gases and material push on the dry marker (34) within the interior of a frangible mid-body (30'), the expanding gases acting on the interior side of the mid body marker wall (32). FIG. 18B depicts the ejection of marking material (72, 72') from a design as set forth in FIG. 17 A-C, where a denser, slower moving heated residual powder (78) created by the energetic (88) decomposing the metal cylinder (84), and a low density powder (72') both materials propelled and engulfed by gases ejecting the material from the projectile's mid body (30') perpendicular to the projectile's flight path (50). FIG. 19 depicts a mid-body projectile (10') in reticule image (130) with released marker material suspended momentarily in the atmosphere (132) contrasting with foreground images (134) and ambient background (136).

Like other embodiments of a mid-body marker, the marking material is ejected into the atmosphere and the low density of powder materials allows for momentary suspension in the atmosphere.

There has thus been shown and described a novel, marking cartridge which fulfills all of the object and advantage sought, therefore. Many changes, modifications, variations and other use and applications of the subject invention, will become apparent to those skilled in the art after considering this specification and the accompany drawings which disclose the preferred embodiments thereof. All such changes, modifications, variation and other uses and applications which do not depart from the spirit and scope of the invention are deeded to been covered by the invention which is to be limited only by the claims which follow.

What is claimed is:

1. A gun fired ammunition cartridge incorporating a spin stabilized projectile, said projectile comprising:

(1) a metal ogive comprising a forward metal bore riding feature, (2) a mid-body frangible cylindrical assembly coupled to the forward metal bore riding feature at a forward end, the mid-body cylindrical assembly incorporating a cylindrical capsule configured to house a liquid marking payload comprising one or more chemical liquid materials, the liquid marking payload being aligned to the projectile's axis of rotation and proximate to the projectile's center of gravity; and (3) an aft metal base comprising a driving band, wherein the liquid marking payload is centered approximately equidistant between the forward bore riding feature and the driving band, and wherein the cartridge retains strength when compressed upon being loaded into a weapon, and upon firing, the projectile exhibits a ballistic flight stability over the trajectory of the projectile and, upon impact, the projectile breaks up and releases.

2. The ammunition cartridge in claim 1, wherein the forward metal bore riding feature in combination with the driving band allows the projectile to be spun-up when transiting a barrel, and exterior features of the projectile impart rotational forces about the projectile's center of gravity.

3. The ammunition cartridge in claim 2, wherein rotation imparted on the projectile transiting the barrel induces rotational laminar flow in the cylindrical capsule about the projectile's axis of rotation, reducing perturbations resident in the liquid marking payload, preventing a deleterious degradation in the ballistic flight stability of the projectile and allowing the projectile to have a stable ballistic flight in a flight path in direct fire.

4. The ammunition cartridge in claim 1, wherein said cylindrical capsule includes one or more segregated compartments allowing for segregation of respective one or more chemical liquid marking materials in storage.

5. The ammunition cartridge in claim 4, wherein the cylindrical capsule includes a mass suspended in a chemical liquid marking material housed in a forward compartment of the one or more segregated compartments, the mass, at set-back, moving aft and puncturing a barrier material segregating the one or more segregated compartments.

6. The ammunition cartridge in claim 4, wherein the projectile traversing the barrel induces rotation on the exterior of the projectile, mixing all of the chemical liquid marking material in the cylindrical capsule.

7. The ammunition cartridge of claim 6, wherein the viscosity of the mixed chemical liquid marking materials affords laminar flow in the cylindrical capsule, the flow induced by the capsule's rotation around the projectile's axis of rotation.

8. The ammunition cartridge of claim 7, where the mixed liquid marking materials comprise at least 70% of the volume of the cylindrical capsule, the mixing of the one or more chemical liquid marking materials creating a chemical reaction.

9. The ammunition cartridge of claim 8, wherein the chemical reaction occurs in flight before projectile impact.

10. The ammunition cartridge of claim 9, wherein the chemical reaction creates a chemiluminescent reaction.

11. The ammunition cartridge of claim 9, wherein the chemical reaction creates an exothermic reaction.

12. The ammunition cartridge of claim 11, wherein the mixed liquid marking materials is heated based at least in part on the exothermic reaction, becoming atomized into droplets, when ejected from the projectile after impacting a surface.

13. The ammunition cartridge of claim 1, wherein the projectile houses an additional dry marking material surrounding the capsule, the dry marking material including high contrast pigment or dye.

14. The ammunition cartridge of claim 1, wherein the forward metal bore riding feature and the driving band are equidistant from the center of gravity of the projectile.

* * * * *